US009812815B2

(12) United States Patent
Chen

(10) Patent No.: US 9,812,815 B2
(45) Date of Patent: Nov. 7, 2017

(54) COMBINATORIAL LIGHT STRING PLUG AND RECEPTACLE

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 15/355,178

(22) Filed: Nov. 18, 2016

(65) Prior Publication Data

US 2017/0141516 A1 May 18, 2017

Related U.S. Application Data

(60) Provisional application No. 62/257,098, filed on Nov. 18, 2015.

(51) Int. Cl.

| | |
|---|---|
| ***H01R 13/506*** | (2006.01) |
| ***H01R 13/516*** | (2006.01) |
| ***H01R 13/64*** | (2006.01) |
| ***H01R 4/18*** | (2006.01) |
| ***H01R 13/05*** | (2006.01) |
| ***H01R 13/11*** | (2006.01) |
| ***H01R 13/432*** | (2006.01) |
| ***H01R 13/46*** | (2006.01) |
| ***H01R 13/717*** | (2006.01) |
| ***H01R 24/20*** | (2011.01) |

(Continued)

(52) U.S. Cl.

CPC ..... *H01R 13/64* (2013.01); *H01R 4/185* (2013.01); *H01R 13/052* (2013.01); *H01R 13/111* (2013.01); *H01R 13/432* (2013.01); *H01R 13/46* (2013.01); *H01R 13/7175* (2013.01); *H01R 24/20* (2013.01); *H01R 24/28* (2013.01); *H01R 2107/00* (2013.01)

(58) Field of Classification Search

CPC ..... H01R 13/506; H01R 13/516; H01R 13/5219; H01R 13/5202; H01R 13/514; H01R 13/658

USPC ..... 439/686, 701, 271, 904, 905

See application file for complete search history.

(56) References Cited

U.S. PATENT DOCUMENTS 4,464,003 A * 8/1984 Goodman ..... H01R 13/6593 439/404

4,784,617 A * 11/1988 Oda ..... H01R 13/4364 439/595

(Continued)

*Primary Examiner* — Gary Paumen

(74) *Attorney, Agent, or Firm* — Christensen, Fonder, Dardi & Herbert PLLC

(57) ABSTRACT

A connector having enhanced protection against arcing during live or "hot" connection of a plug assembly to a receptacle assembly. The terminals of the connector, including the connection point of exposed wiring, are electrically isolated from each other with dielectric barriers built in to the connector, such as polymer partitions. Accordingly, protection against arcing is provided in a connector that is assembled fast and inexpensively, without need for a time consuming installation of wire and terminal coatings or sleeves (e.g., "shrink tube"), and with greater reliability. The connector can be used in a modular system for decorative lighting and having a controller module that is not hard wired to a light string. Use of the controller module independent of any of the light strings enables the controller to be used with any light string or with a replacement light string, in the event that the immediately connected light string fails.

22 Claims, 40 Drawing Sheets

(51) Int. Cl.
*H01R 24/28* (2011.01)
*H01R 107/00* (2006.01)

(56) References Cited

U.S. PATENT DOCUMENTS 5,632,639 A * 5/1997 Hayashi ..... H01R 13/5227
439/271
6,102,740 A * 8/2000 Murakami ..... H01R 13/5205
439/271
6,285,140 B1 9/2001 Ruxton
6,368,130 B1 * 4/2002 Fukuda ..... H01R 13/52
439/271
6,547,584 B2 * 4/2003 Myer ..... H01R 13/641
439/271
6,641,417 B2 * 11/2003 Tanaka ..... H01R 13/5216
439/205
7,371,115 B1 * 5/2008 Hsieh ..... H01R 13/5208
439/271
8,096,833 B2 * 1/2012 Tobey ..... H01R 13/501
439/540.1
8,113,889 B2 * 2/2012 Zhang ..... H01R 43/24
439/606
8,203,275 B2 6/2012 Ruxton
8,390,306 B2 3/2013 Hamann et al.
8,491,323 B2 * 7/2013 Ishibashi ..... H01R 13/5221
439/205
8,777,648 B2 * 7/2014 Kitajima ..... H01R 13/506
439/271

* cited by examiner

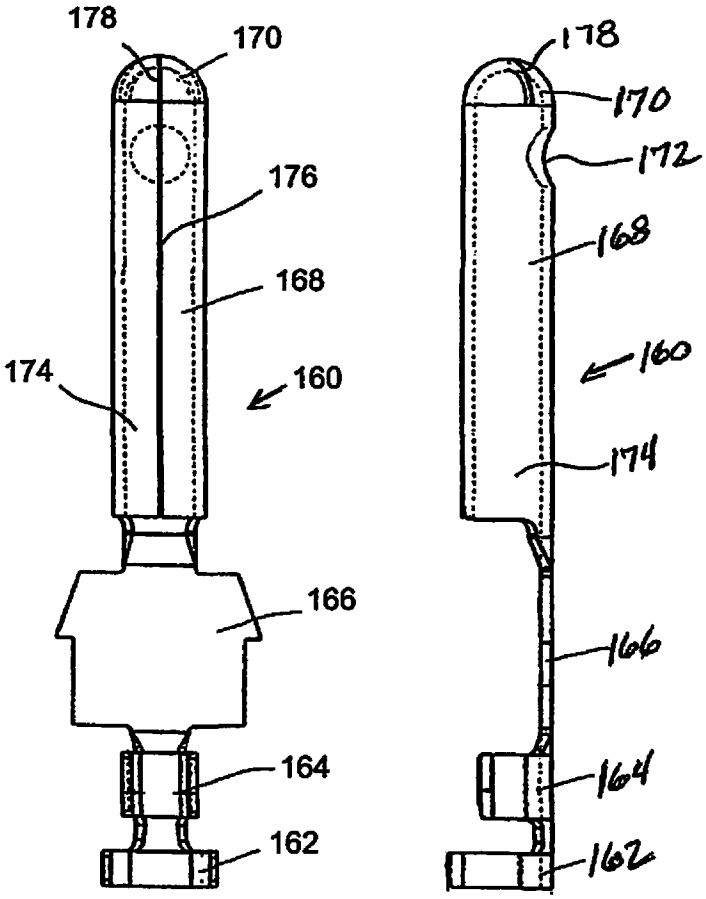
FIG. 6A
FIG. 6B
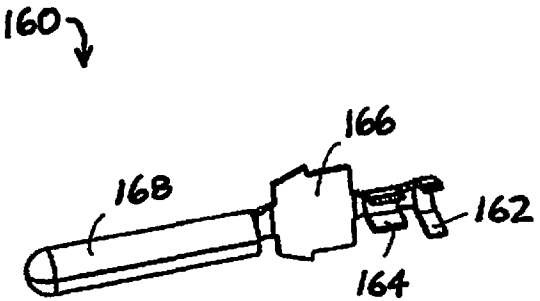
FIG. 6

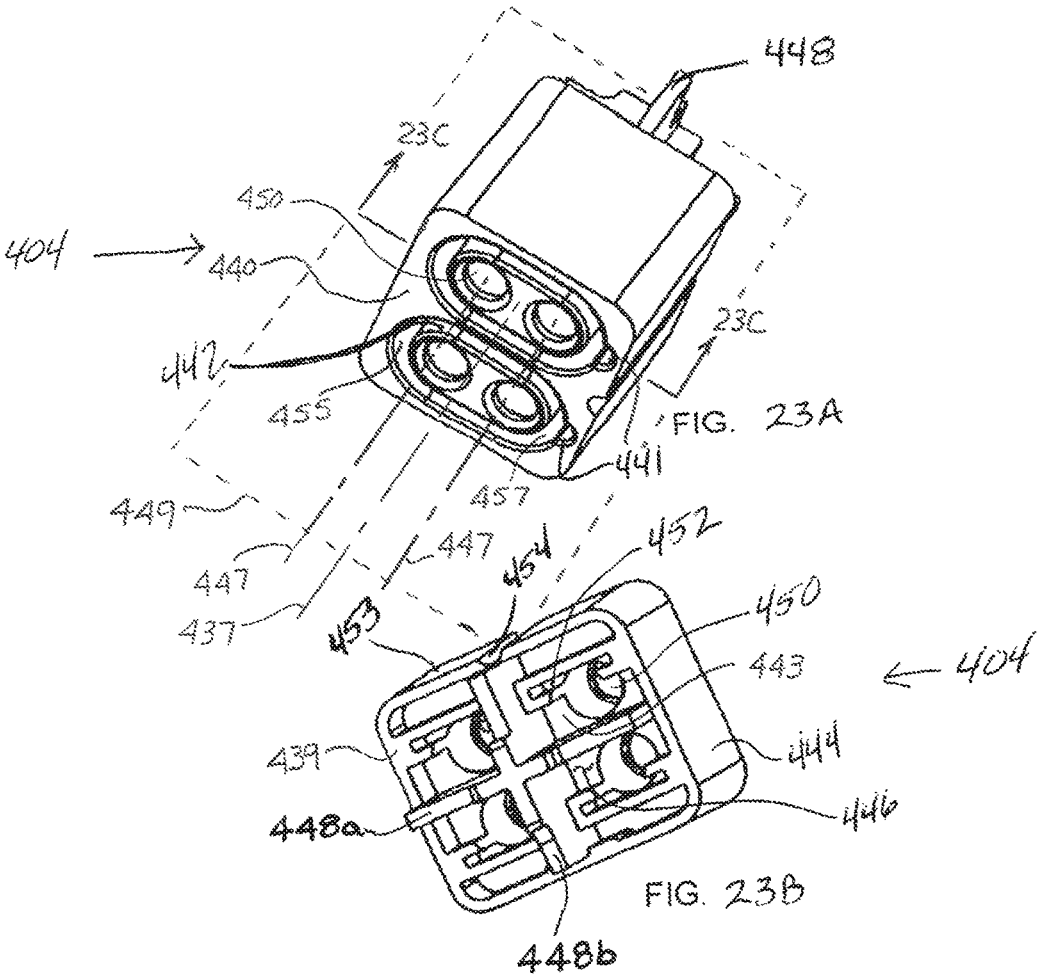
FIG. 23A
FIG. 23B
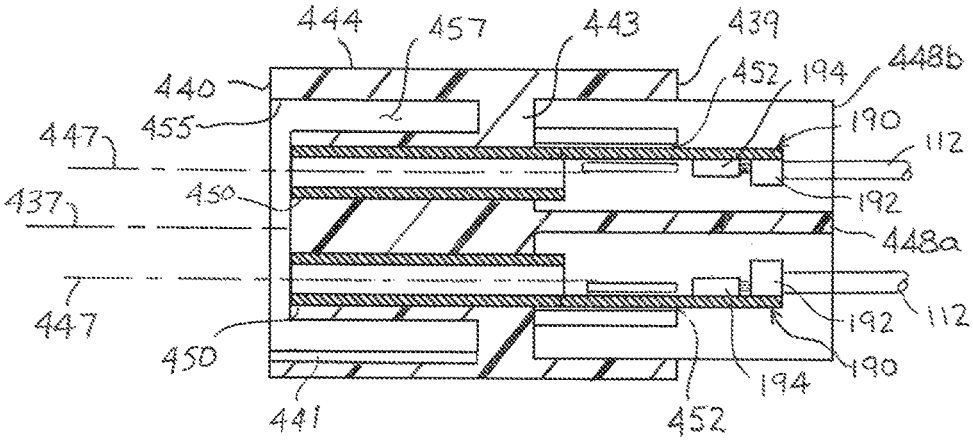
FIG. 23C

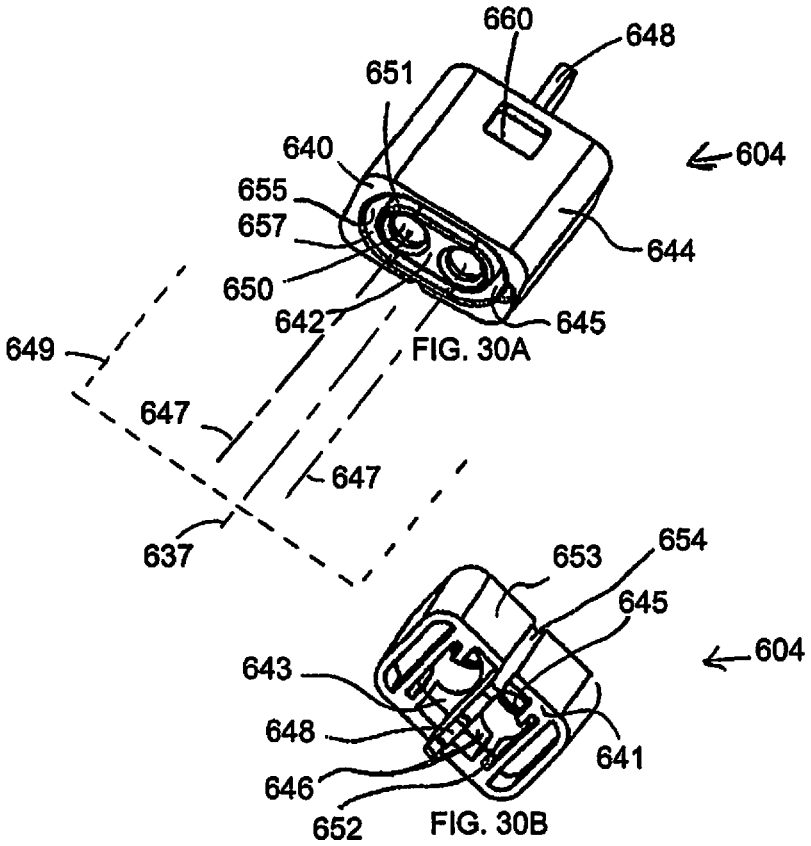
FIG. 30A
FIG. 30B
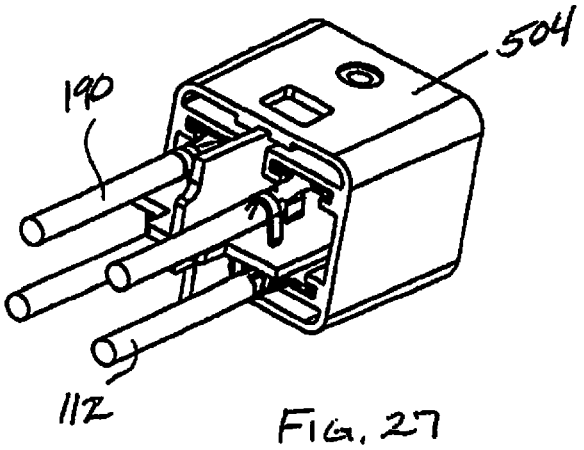
FIG. 27

COMBINATORIAL LIGHT STRING PLUG AND RECEPTACLE

RELATED APPLICATIONS

This application claims the benefit of U.S. Provisional Patent Application No. 62/257,098 entitled "Combinatorial Light String Plug and Receptacle", filed Nov. 18, 2015, the disclosure of which is incorporated by reference herein in its entirety.

FIELD OF THE DISCLOSURE

The disclosure relates to light strings, and in particular, to light strings comprised of LED lights wired in parallel. Specifically, the disclosure relates to light strings that can have a plurality of light arrays or a subsequent light string having arrays where each light array can operate independently of any other light array. More specifically, the disclosure relates to light strings having multi-function controllers allowing programming of color and motion, where the light strings can have plugs and receptacles whose terminals carry both power and data. Even more specifically, the disclosure relates to light string plugs having pin type terminals and light string socket receptacles configured to receive pin type light string plugs.

BACKGROUND OF THE DISCLOSURE

A decorative light string typically includes a plug on one end, and a plug receptacle or "end connector" for receiving a plug from a second light set at another end. The plug receptacle of the first decorative light string provides power to the second decorative light string. While such power plugs and plug receptacles are well known and typically of a standardized design, for decorative light strings having controllers so that the lights are selectively powered on and off, or provide varying colors, the situation is quite different. Decorative light strings having controllers often do not include plug receptacles at the one end, and cannot be connected end-to-end with other light strings thus requiring numerous controllers and light string sets that are each individually programmed or set. Furthermore, of the few known decorative light strings with controllers that are configured to connect to other light strings, the connectors are not standard, and the plugs and receptacles are not typically configured to efficiently transmit data and power.

SUMMARY OF THE DISCLOSURE

Various embodiments of the disclosure provide a connector having enhance protection against arcing during live or "hot" connection of a plug assembly to a receptacle assembly, without need for a time consuming installation of wire and terminal coatings or sleeves (e.g., "shrink tube"). The terminals of the connector, including the connection point of exposed wiring, are electrically isolated from each other with dielectric barriers, such as polymer partitions. Accordingly, protection against arcing is provided in a connector that is assembled fast and inexpensively, and with greater reliability.

Various embodiments of the disclosure also provide spline and groove arrangements for easy and secure assembly, as well as for keyed connector orientations.

Structurally a connector is depicted and described having a receptacle assembly, including a receptacle housing having an open end and a closed end separated by at least one side wall, the receptacle housing defining a receptacle housing cavity. A receptacle insert is disposed in the receptacle housing cavity, the receptacle insert including: a receptacle body having an outer peripheral surface that extends rearward from a forward face to a rearward face, the receptacle body including an internal bulkhead and defining a first forward cavity forward of the internal bulkhead; a first rodular projection extending forward from the internal bulkhead into the first forward cavity and being centered about a first rodular projection axis, the first rodular projection axis being perpendicular to the internal bulkhead, an outer surface of the first rodular projection cooperating with an inner surface of the first forward cavity to define a first annular gap that surrounds the first rodular projection, the first rodular projection defining a first pair of terminal bores extending through the first rodular projection and through the internal bulkhead, the first pair of terminal bores defining a first pair of terminal bore axes that are perpendicular to the internal bulkhead, the first pair of terminal bore axes being parallel and defining a plane; a first receptacle partition wall extending rearward from the receptacle body, the first receptacle partition wall extending between the bores of the first pair of terminal bores and perpendicular to the plane of the first pair of terminal bore axes; and a first pair of female electrical terminals, each disposed in a respective one of the first pair of terminal bores, the first pair of female electrical terminals extending rearward from the receptacle insert adjacent opposing sides of the first receptacle partition wall.

The receptacle housing may include one of a detent and a recess formed on the at least one side wall of the receptacle housing, and the receptacle insert may include the other of the detent and the recess formed on surface of the receptacle body, wherein the detent is arranged and configured to snappingly engage within the recess when the receptacle insert is inserted into the receptacle housing to secure the receptacle insert within the receptacle housing.

In some embodiments, one of the inner surface of the receptacle housing and the outer peripheral surface of the receptacle body includes a receptacle spline extending perpendicular to the open end of the receptacle housing, and the other of the inner surface of the receptacle housing and the outer peripheral surface of the receptacle body defines a receptacle groove extending perpendicular to the open end, the receptacle spline being disposed within the receptacle groove. The inner surface of the first forward cavity may include one of a first spline and a first groove formed thereon that extends perpendicular to the internal bulkhead. In some embodiments, a plurality of receptacle spacers project from an inner surface of the receptacle housing into the receptacle housing cavity, where in the receptacle insert is registered against the plurality of receptacle spacers to provide separation between the receptacle body and the closed end of the receptacle housing. The plurality of receptacle spacers may be dimensioned so that the forward face of the receptacle insert is substantially flush with the receptacle housing. The closed end may define a receptacle feedthrough aperture, and wherein a portion of the first receptacle partition wall is registered within the receptacle feedthrough aperture. The at least one side wall, the open end, and the closed end of the receptacle housing may define a hollow cuboid.

In some embodiments, the receptacle body defines a first pair of receptacle catch plate slots that extend rearward of the internal bulkhead, each of the first pair of receptacle catch plate slots being adjacent a respective one of the first pair of terminal bore axes and is accessible from the rearward face of the receptacle body. Each of the first pair of female electrical terminals may include a catch plate disposed in a respective one of the first pair of receptacle catch plate slots.

The receptacle housing may also include a flange having a face that is proximate the open end of the receptacle housing. The face of the flange of the receptacle housing may be flush with the open end of the receptacle housing. In some embodiments, a plurality of protrusions extend from an outer surface of the at least one of the side wall of the receptacle housing, the plurality of protrusions being proximate the closed end of the receptacle housing.

In some embodiments, a pair of receptacle wings that extend from an outer surface of opposed sides of the plug housing, each of the pair of wings having a connection to the at least one side wall of the plug housing proximate the closed end, each of the pair of wings extending forward of the connection. The connection of each of the pair of receptacle housing wings may be integral to the receptacle housing.

Various embodiments of the disclosure include a plug assembly, with a plug housing including an open end and a closed end separated by at least one side wall, the plug housing defining a plug housing cavity. A plug insert is disposed in the plug housing cavity of the plug housing, the plug insert including: a plug body having an outer peripheral surface that extends rearward from a front wall to a rearward face, the front wall defining a first pair of terminal apertures extending therethrough, the first pair of terminal apertures defining a first pair of terminal aperture axes that are perpendicular to the front wall, the first pair of terminal aperture axes being parallel and defining a plane; a first tubular projection centered about a first tubular projection axis that is perpendicular to the front wall, the first tubular projection extending forward from the front wall of the plug insert and surrounding the first pair of terminal apertures; and a first plug partition wall extending rearward from the plug body, the first plug partition wall extending between the apertures of the first pair of terminal apertures and perpendicular to the plane of the first pair of terminal aperture axes. A first pair of male electrical terminals, each disposed in a respective one of the first pair of terminal apertures, the first pair of male electrical terminals extending rearward from the plug insert adjacent opposing sides of the first plug partition wall, wherein the first tubular projection is configured for insertion into the first annular gap of the receptacle assembly, the first tubular projection is configured to receive the first rodular projection of the plug assembly, and the first pair of male electrical terminals are configured for insertion into the first pair of female electrical terminals of the receptacle assembly.

In some embodiments, the plug housing includes one of a detent and a recess formed on the at least one side wall of the plug housing, the plug insert includes the other of the detent and the recess formed on surface of the plug body, and the detent is arranged and configured to snappingly engage within the recess when the plug insert is inserted into the plug housing to secure the plug insert within the plug housing. In some embodiments, one of the inner surface of the plug housing and the outer peripheral surface of the plug body includes a plug spline extending perpendicular to the open end, and the other of the inner surface of the plug housing and the outer peripheral surface defines a receptacle groove extending perpendicular to the open end, the plug spline being disposed within the receptacle groove. The inner surface of the first forward cavity may include one of a first spline and a first groove formed thereon that extends perpendicular to the internal bulkhead, with an outside surface of the first tubular projection including the other of the first spline and the first groove formed thereon that extends perpendicular to the front wall. The first spline may be configured to slidingly engage the first groove when the plug assembly is inserted into the receptacle assembly.

In some embodiments, the connector includes a plurality of plug spacers that project from an inner surface of the plug housing into the plug housing cavity, where in the plug insert is registered against the plurality of plug spacers to provide separation between the plug body and the closed end of the plug housing. The plurality of plug spacers may be dimensioned so that the front wall of the plug insert is substantially flush with the plug housing.

The closed end of the plug housing may define a plug feedthrough aperture, with a portion of the first plug partition wall is registered within the plug feedthrough aperture. Also, the plug body may define a first pair of plug catch plate slots that extend rearward of the front wall, each of the first pair of plug catch plate slots being adjacent a respective one of the first pair of terminal aperture axes and is accessible from the rearward face of the plug body. Each of the first pair of male electrical terminals may include a catch plate disposed in a respective one of the first pair of plug catch plate slots. The plug housing may include a flange having a face that is proximate the open end of the plug housing. In one embodiment, the face of the flange of the plug housing is flush with the open end of the plug housing. A plurality of gripping protrusions extend from an outer surface of the at least one of the side wall of the plug housing, the plurality of protrusions being proximate the closed end of the plug housing.

In some embodiments, a pair of plug housing wings that extend from an outer surface of opposed sides of the plug housing, each of the pair of plug housing wings having a connection to the at least one side wall of the plug housing proximate the closed end of the plug housing, each of the pair of plug housing wings extending from the connection toward the open end of the plug housing to a free end of the plug housing wings. A pair of retractable tabs may extend through the at least one side wall, each being configured for actuation by the free end of a respective one of the plug housing wings.

In some embodiments, the receptacle body defines a second forward cavity forward of the internal bulkhead. A second rodular projection extends forward from the internal bulkhead into the second forward cavity and is centered about a second rodular projection axis, the second rodular projection axis being perpendicular to the internal bulkhead. An outer surface of the second rodular projection cooperates with an inner surface of the second forward cavity to define a second annular gap that surrounds the second rodular projection, the second rodular projection defining a second pair of terminal bores extending through the second rodular projection and through the internal bulkhead, the second pair of terminal bores defining a second pair of terminal bore axes that are perpendicular to the internal bulkhead. A second receptacle partition wall may extend rearward from the receptacle body and perpendicular to the first receptacle partition wall and extending between the first pair of apertures and the second pair of apertures. A female electrical terminal may be disposed in one of the second pair of terminal apertures, the female electrical terminal extending rearward from the receptacle insert adjacent the first plug partition wall and the second plug partition wall.

In some embodiments, the front wall of the plug body defines a second pair of terminal apertures extending therethrough, the second pair of terminal apertures defining a second pair of terminal aperture axes that are perpendicular to the front wall. A second tubular projection may be centered about a second tubular projection axis that is perpendicular to the front wall, the second tubular projection extending forward from the front wall of the plug insert and surrounding the second pair of terminal apertures. A second plug partition wall extending rearward from the plug body, the second plug partition wall extending between the apertures of the first pair of terminal apertures and between the apertures of the second pair of terminal apertures and perpendicular to the first plug partition wall. A male electrical terminal may be disposed in a respective one of the second pair of terminal apertures, the male electrical terminal extending rearward from the plug insert adjacent the second plug partition wall. Accordingly, for this embodiment, the second tubular projection is configured for insertion into the second annular gap of the receptacle assembly, the second tubular projection is configured to receive the second rodular projection of the plug assembly, and the male electrical terminal is configured for insertion into the female electrical terminal of the receptacle assembly.

The inner surface of the first forward cavity may include one of a first spline and a first groove formed thereon that extends perpendicular to the internal bulkhead. An outside surface of the first tubular projection includes the other of the first spline and the first groove formed thereon that extends perpendicular to the front wall. The inner surface of the second forward cavity may include one of a second spline and a second groove formed thereon that extends perpendicular to the internal bulkhead. In one embodiment, an outside surface of the second tubular projection includes the other of the second spline and the second groove formed thereon that extends perpendicular to the front wall. Accordingly, the first spline is configured to slidingly engage the first groove and the second spline is configured to slidingly engage the second groove when the plug assembly is inserted into the receptacle assembly. The first spline and the second spline may be disposed on a same side of a plane defined by the first tubular projection axis and the second tubular projection axis when the plug assembly is coupled to the receptacle assembly to provide a keyed connection.

In some embodiments, the female electrical terminal disposed in one of the second pair of terminal bores is one of a second pair of female electrical terminals, each disposed in a respective one of the second pair of terminal bores, the second pair of female electrical terminals extending rearward from the plug insert adjacent opposing sides of the first plug partition wall. Each female electrical terminal may include a crimping end and a female barrel separated by a catch plate, wherein a semi-spherical projection is disposed on the inside surface of the female barrel.

In some embodiments, the female barrel defines a slit that extends longitudinally along the female barrel. Each male electrical terminal includes a crimping end and a male barrel separated by a catch plate. A semi-spherical indentation may be disposed on the outside surface of the male barrel. In one embodiment, the semi-spherical indentation of the male electrical terminal and the semi-spherical projection of the female electrical terminal are positioned and configured to mate together when the plug assembly is connected to the receptacle assembly. A semi-spherical end cap may define a plurality of slits. In some embodiments, one of the plurality of slits of the semi-spherical end cap extends longitudinally along the male barrel. For certain embodiments, a force to separate the plug assembly from the receptacle assembly is in a range of 3 lbf to 15 lbf inclusive.

In various embodiments of the disclosure, the connector comprises a second plug assembly, including a second plug housing including an open end and a closed end separated by at least one side wall, the second plug housing defining a second plug housing cavity. A second plug insert is disposed in the second plug housing cavity of the second plug housing, the second plug insert including a second plug body having an outer peripheral surface that extends rearward from a second front wall to a rearward face, the second front wall defining a second pair of terminal apertures extending therethrough, the second pair of terminal apertures defining a second pair of terminal aperture axes that are perpendicular to the second front wall, the second pair of terminal aperture axes being parallel and defining a plane. A second tubular projection is centered about a second tubular projection axis that is perpendicular to the second front wall, the second tubular projection extending forward from the second front wall of the second plug insert and surrounding the second pair of terminal apertures. A second plug partition wall extends rearward from the second plug body, the second plug partition wall extending between the apertures of the second pair of terminal apertures and extending perpendicular to the plane of the second pair of terminal aperture axes. A second pair of male electrical terminals, each disposed in a respective one of the second pair of terminal apertures, the second pair of male electrical terminals extending rearward from the plug insert adjacent opposing sides of the second plug partition wall. The second tubular projection may be configured for insertion into the second annular gap of the receptacle assembly, the second tubular projection is configured to receive the second rodular projection of the second plug assembly, and the second pair of male electrical terminals are configured for insertion into the second pair of female electrical terminals of the receptacle assembly.

In some embodiments, the male electrical terminal disposed in one of the second pair of terminal apertures is one of a second pair of male electrical terminals, each disposed in a respective one of the first pair of terminal apertures, the second pair of male electrical terminals extending rearward from the plug insert adjacent opposing sides of the first plug partition wall. The plug body may define a first pair of plug catch plate slots that extend rearward of the front wall, each of the first pair of plug catch plate slots being adjacent a respective one of the first pair of terminal aperture axes and is accessible from the rearward face of the plug body, each of the first pair of male electrical terminals including a catch plate disposed in a respective one of the first pair of plug catch plate slots. In one embodiment, the plug body defines a second pair of plug catch plate slots that extend rearward of the front wall, each of the second pair of plug catch plate slots being adjacent a respective one of the second pair of terminal aperture axes and is accessible from the rearward face of the plug body, each of the second pair of male electrical terminals including a catch plate disposed in a respective one of the second pair of plug catch plate slots.

In some embodiments, a fastener aperture is defined through the at least one side wall of the receptacle housing, a retaining bridge extends from the first tubular projection to the second tubular projection, the retaining bridge defining a tap hole, and a fastener is disposed through the fastener aperture and into the tap hole to secure the receptacle assembly to the plug assembly.

Some embodiments of the disclosure provide a modular system, with a controller module that is not hard wired to a light strings. Use of the controller module that is independent of the integrity of any of the light strings enables the controller to be used with any light string or with a replacement light string, in the event that the immediately connected light string fails, thus reducing the expense of removing or replacing the first of a series of light strings. The modularity also enables the control module and the light strings to be manufactured by separate vendors that are preferred for these different manufacturing tasks.

Structurally, various embodiments of the disclosure detail a light string assembly comprising a plug having a plurality of standard terminal blades, a controller connected via conductive wires to the plug, a light array connected to the controller via the conductive wires, a receptacle assembly having a plurality of female electrical terminals fixedly connected to the light array via conductive wires, and a plug assembly having a plurality of male electrical terminals, the plug assembly being detachably engageable with the receptacle assembly. In this embodiment, the receptacle assembly and the plug assembly are disposed between the controller and the light array to provide selective electrical connection therebetween.

The plug assembly of the light string assembly may also include a plug housing having an open end, at least one side wall, and a semi-closed end to define a plug housing cavity. A plug insert may be disposed within the plug housing cavity, the plug insert including a plug body having a forward face. One or more tubular projections may extend from the forward face, the forward face shaped to corresponding to the open end of the plug housing and including a plurality of apertures surrounded by the one or more tubular projections, each of the plurality of apertures sized to correspond with the outer diameter of the male electrical terminals. The plurality of male electrical terminals may be fixedly attached at one end to conductive wires at attachment points that are disposed in the plug body so that portions of the male electrical terminals extend through the plurality of apertures and are shrouded by the one or more tubular projections.

The receptacle assembly of the light string may also include a receptacle housing having an open end, at least one side wall, and a semi-closed end to define a receptacle housing cavity. A receptacle insert may be disposed within the receptacle housing cavity, the receptacle insert including a receptacle body having an internal bulkhead and defining a forward cavity extending forward of the internal bulkhead, one or more rodular projections extending from the internal bulkhead into the forward cavity, the rodular projections being recessed within the body, the one or more rodular projections and the internal bulkhead defining a plurality of terminal bores sized to correspond with the outer diameter of the female electrical terminals. The plurality of female electrical terminals may be fixedly attached at one end to conductive wires at attachment points, the female electrical terminals and wires being disposed in the receptacle body so that the female electrical terminals line the terminal bores and are shrouded by the one or more rodular protrusions.

In some embodiments of the disclosure, a chain of light strings with each having its own local controller is disclosed. The controllers communicate with each other to produce a coordinated lighting effect between the light strings. Though chained together in series, the chain of light strings provides full power to each light string, without line losses associated with long runs of multiple light strings.

Structurally, various embodiments of the disclosure include a series of light strings, comprising a first light string that includes a plug including a pair of primary power terminals and at least one low voltage terminal. A pair of primary power wires extend from the pair of primary power terminals of the plug. At least one low voltage wire extending from the at least one low voltage terminal of the plug, with a controller in communication with the plug via the pair of primary power wires and the at least one low voltage wire. An array of lights in communication with the controller via the at least one low voltage wire. A receptacle is in communication with the array of lights via the at least one low voltage wire and in communication with the pair of primary power terminals of the plug via a pair of bypass wires that bypass the controller and the array of lights. The series of light strings may also include the at least one low voltage terminal of the first light string is retractable into the plug.

In some embodiments, the at least one low voltage terminal of the first light string is a pair of low voltage terminals, and the at least one low voltage wire of the first light string is a pair of low voltage wires extending from the pair of low voltage terminals to the controller, the array of lights, and the receptacle. The controller of the first light string transmits both DC power and data to the array of lights and to the receptacle over the pair of low voltage wires.

In other embodiments, the at least one low voltage terminal of the first light string is a trio of low voltage terminals, with the at least one low voltage wire of the first light string is a trio of low voltage wires extending from the trio of low voltage terminals to the controller, the array of lights, and the receptacle. The controller of the first light string transmits DC power a first low voltage wire and a second low voltage wire of the trio of low voltage wires, and the controller transmitting the data to the array of lights and to the receptacle over a third low voltage wire of the trio of low voltage wires.

The series of light strings may also include a second light string, including a plug including a pair of primary power terminals and at least one low voltage terminal. A pair of primary power wires extending from the pair of primary power terminals of the plug, and at least one low voltage wire extending from the at least one low voltage terminal of the plug. A controller in communication with the plug via the pair of primary power wires and the at least one low voltage wire, and an array of lights in communication with the controller via the at least one low voltage wire. The second light string receives primary power from the receptacle of the first light string, and the controller of the first light string communicates with the controller of the second light string via the at least one low voltage wire. The series of light strings may be adapted for mounting to an artificial tree.

BRIEF DESCRIPTION OF THE DRAWINGS

FIG. 6 is a perspective view of a male electrical terminal according to an embodiment of the disclosure.

FIG. 6A is a bottom view of the male electrical terminal of FIG. 6.

FIG. 6B is a side view of the male electrical terminal of FIG. 6.

FIG. 23A depicts a front and side perspective view of an embodiment of a four-conductor receptacle insert according to an embodiment of the disclosure.

FIG. 23B depicts a rear perspective view of an embodiment of a four-conductor receptacle insert according to an embodiment of the disclosure.

FIG. 23C is a sectional view of the four-conductor receptacle insert of FIG. 23A according to an embodiment of the disclosure.

FIG. 27 depicts the rear and top perspective view of another embodiment of a receptacle insert for a four-conductor receptacle where the female electrical terminals, with fixedly attached wiring, are disposed in the receptacle insert according to an embodiment of the disclosure.

FIG. 30A depicts a front and top perspective view of an embodiment of a two-conductor receptacle insert according to an embodiment of the disclosure.

FIG. 30B depicts a rear and bottom perspective view of an embodiment of a two-conductor receptacle insert according to an embodiment of the disclosure.

DETAILED DESCRIPTION

Described herein are decorative light strings with controllers, the light strings having plug assemblies and receptacle assemblies where the plugs and receptacles are provided with combinatorial power and data terminals.

Figure 1A:
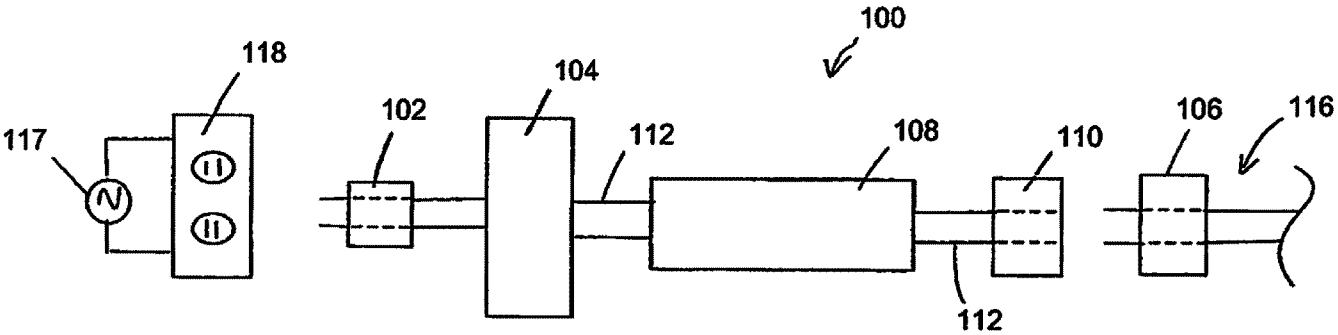
FIG. 1A illustrates an embodiment of a two terminal light string according to an embodiment of the disclosure.
Figure 1B:
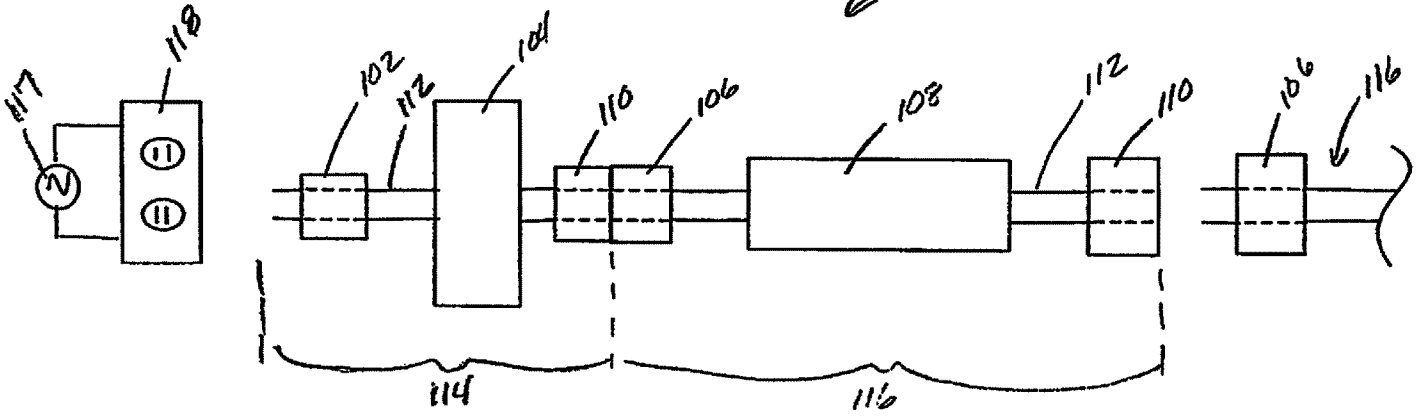
FIG. 1B illustrates an embodiment of a two terminal light string having an intermediate plug and receptacle according to an embodiment of the disclosure.
Figure 1C:
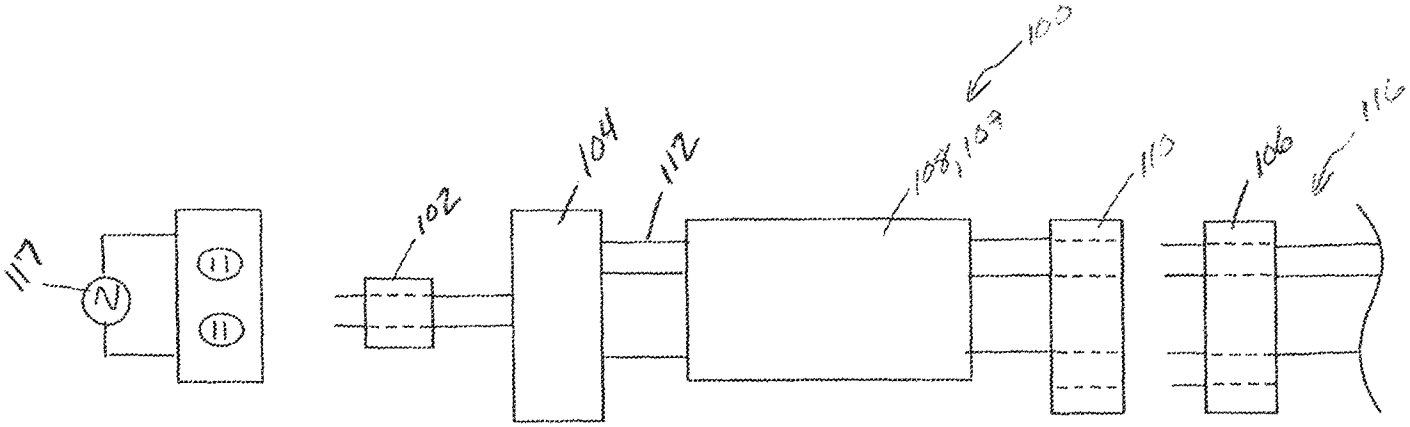
FIG. 1C illustrates an embodiment of a three terminal light string according to an embodiment of the disclosure.
Figure 1D:
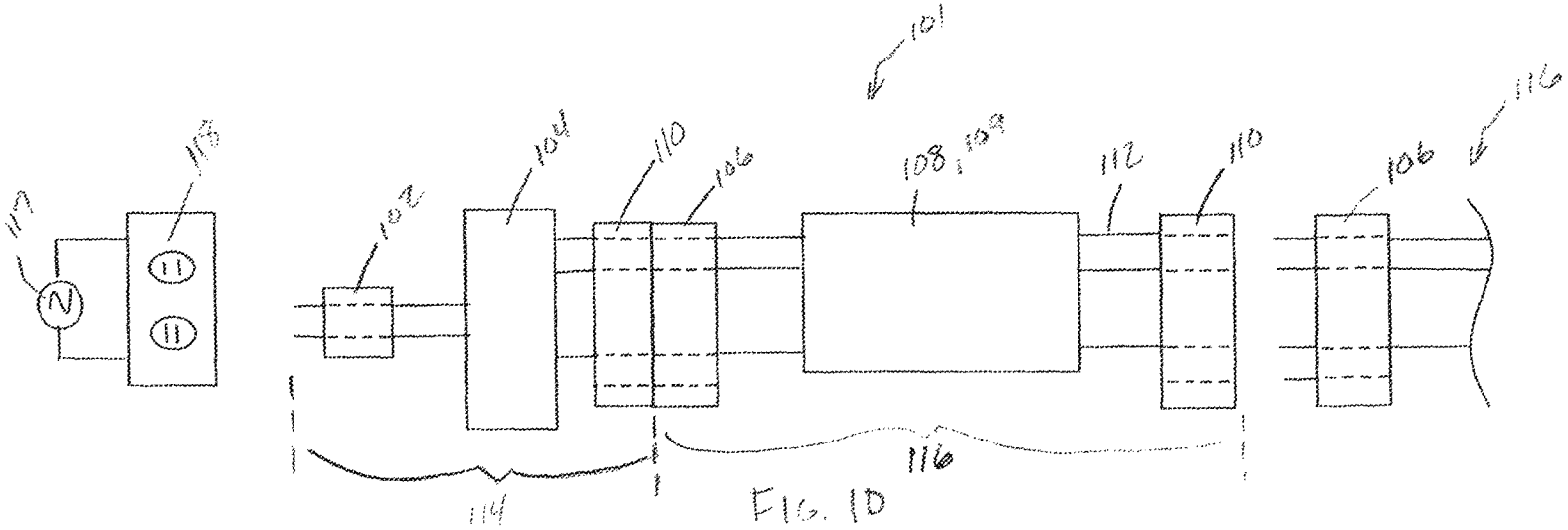
FIG. 1D illustrates an embodiment of a three terminal light string having an intermediate plug and receptacle according to an embodiment of the disclosure.
Figure 1E:
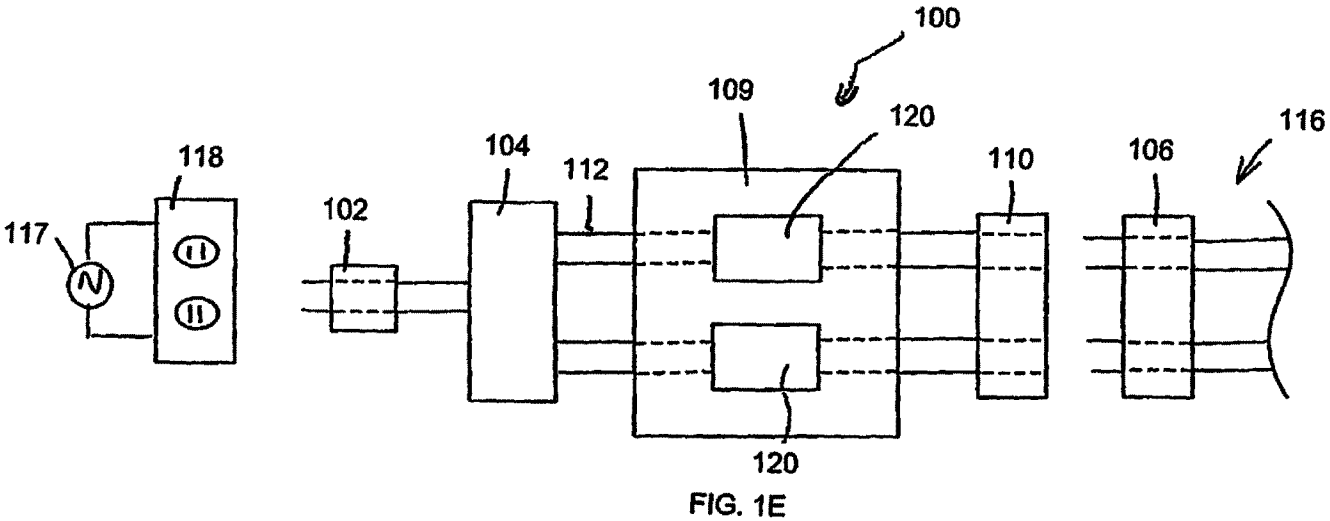
FIG. 1E illustrates an embodiment of a four terminal light string according to an embodiment of the disclosure.

Referring to FIGS. 1A, 1C, and 1E, light strings 100 are depicted according to embodiments of the disclosure. The light strings 100 may include a standard two blade plug 102, a controller 104, a light array 108, 109, a receptacle assembly 110 where the receptacle can further comprise two- to four-female electrical conductors, and wiring 112. Standard plug 102 can be a two blade plug 102 where the two blades are primary power terminals and connect to an AC power source 117 through a standard wall outlet 118.

Figure 1F:
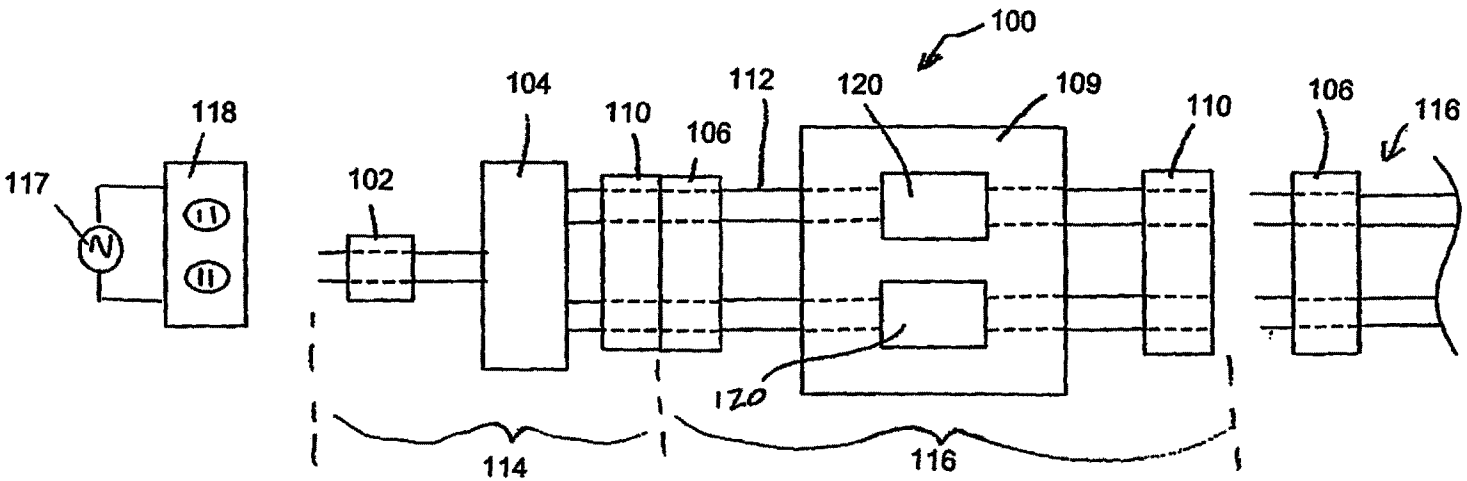
FIG. 1F illustrates an embodiment of a four terminal light string having an intermediate plug and receptacle according to an embodiment of the disclosure.

Referring to FIGS. 1B, 1D, and 1F, light strings 101 are depicted according to embodiments of the disclosure. The light strings 101 may include two subassemblies, a controller subassembly 114 and a light string subassembly 116. In an embodiment, the controller subassembly 114 can comprise a standard two blade plug 102, a controller 104, a receptacle assembly 110 where the receptacle assembly 110 can further comprise two- to four-female electrical conductors, and wiring 112. In another embodiment, the controller subassembly can be provided with a plug assembly 106 where plug assembly 106 can further comprise two- to four-conductors, a controller 104, a receptacle assembly 110 where the receptacle assembly 110 can further comprise two- to four-female electrical conductors, and wiring 112. The light string subassembly 116 can comprise a plug assembly 106 where plug assembly 106 can further comprise two- to four-conductors, a light array 108, 109, a receptacle assembly 110 where receptacle assembly 110 can further comprise two- to four-female electrical conductors, and wiring 112. Connection of subassemblies 114, 116 is made by mating the controller subassembly 114 receptacle assembly 110 and the light string subassembly 116 plug assembly 106. Standard plug 102 can be a two blade plug 102 where the two blades are primary power terminals and connect to an AC power source 117 through a standard wall outlet 118.

A benefit of providing light string 100 comprised of two subassemblies 114, 116 is that the controller subassembly 114 can be manufactured separately from the light string subassembly 116. Another benefit is that the consumer need purchase only one controller subassembly 114 to control a plurality of light string assemblies 116 that are connected in series. In one embodiment, receptacle assembly 110 and plug assembly 106 can be permanently mated to prevent separation by the consumer. In another embodiment, receptacle assembly 110 and plug assembly 106 can be mated to allow separation by the consumer.

As is depicted further in FIGS. 1A through 1F, a subsequent light string subassembly 116 can be mated and connected in series to the receptacle assembly 110 at the end of the light string 100, 101 to increase the length of the decorative light string. It is apparent that the user can continue to serially connect subsequent light string subassemblies 116 to previous light string subassemblies 116 to further increase the overall length of the light string. In some embodiments, the light strings 100, 101 include a controller 104. Controller 104 provides operational data to and controls the light arrays 108, 109 of light strings 100, 101, as well as the light arrays 108, 109 of subsequent light string subassemblies 116. Controller 104 can comprise a transformer to condition and convert AC electric power from the source 117 to a low voltage DC electric power to be output to light arrays 108, 109. In addition, controller 104 injects operational data over the outputted DC power to provide a modulated signal from controller 104 to light array 108, 109.

Figure 2A:
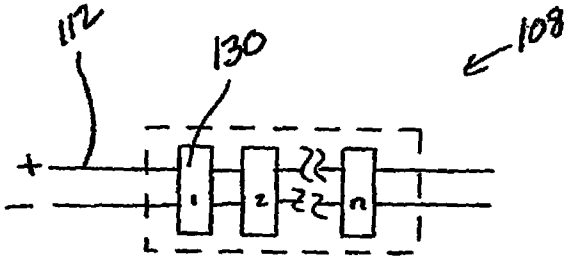
FIG. 2A illustrates an embodiment of a light array of a light string, the light array having two conductor LEDs according to an embodiment of the disclosure.
Figure 2B:
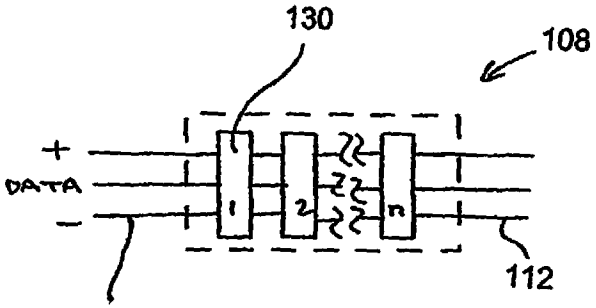
FIG. 2B illustrates an embodiment of a light array of a light string, the light array having three conductor LEDs according to an embodiment of the disclosure.

Referring to FIGS. 2A and 2B, light arrays 108, 109 including a plurality of light emitting diodes (LEDs) 130 are depicted according to embodiments of the disclosure. The LEDs 130 are wired in parallel using a plurality of wires 112. FIG. 2A depicts a two wire configuration and FIG. 2B depicts a three wire configuration, but it is contemplated that more wires can be used. In the embodiment of FIG. 2A, it is contemplated that one wire supplies modulated positive DC and one wire supplies modulated negative DC. In the embodiment of FIG. 2B, it is contemplated that one wire supplies DC+, one wire supplies DC−, and one wire provides data. It is understood, to those with skill in the art, that various combinations of DC power, modulated DC power, and data can be provided to light array 108, 109 and the embodiments discussed above are examples and are not limiting.

Figure 3B:
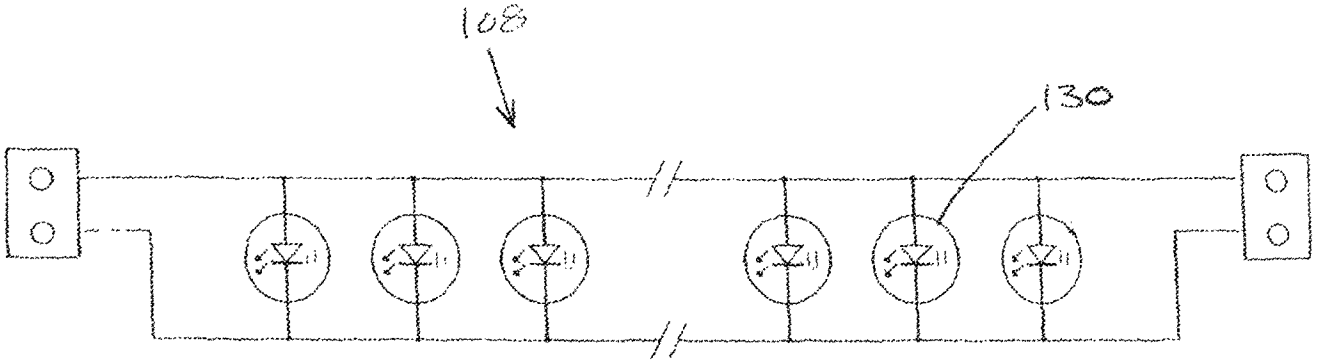
FIG. 3B illustrates an embodiment of a light array, the light array comprised of the LEDs of FIG. 3A according to an embodiment of the disclosure.
Figure 3A:
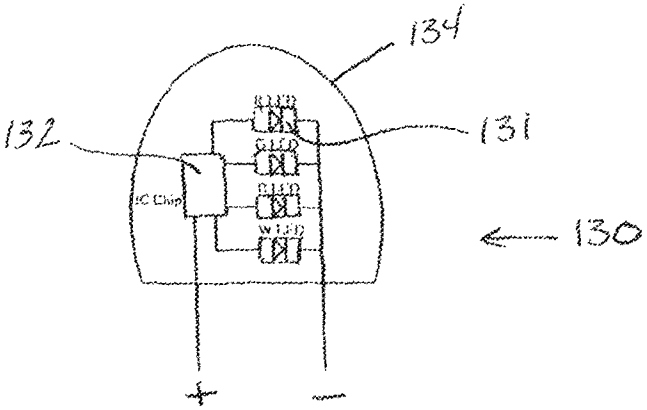
FIG. 3A illustrates an embodiment of a two conductor LED, the LED having an IC and W+RGB LEDs according to an embodiment of the disclosure.

Referring to FIG. 3A, a two wire LED 130 is depicted according to an embodiment of the disclosure. In the depicted embodiment, the LED 130 includes an integrated circuit or driver chip (IC) 132, having an operating range of $1.8V_{DC}$ to $5.0V_{DC}$, within the LED housing 134. In the embodiment shown, modulated DC+ is supplied to IC 132. Individual LEDs 131, which can each be of a different illuminated color, generally white, red, green, or blue, are provided within LED housing 134 and are connected individually to the IC 132. In the embodiment shown, four LEDs 131 are provided, having one each of white, red, green, and blue. In other embodiments, any number of LEDs 131 can be provided and can be any combination of colors. In some embodiments, the LEDs 131 have an operating range of $2.1V_{DC}$ to $5.0V_{DC}$. FIG. 3B depicts an embodiment of light array 108, 109 comprised of LEDs 130 wired in parallel. Each of the LEDs 130 within the light array 108, 109 is provided with a unique address. A code, generated by the controller 104, containing general command and operational data and an address is provided to IC 132 within the LED 130 thus controlling the lighting of each individual LED 131. In another embodiment (not shown), LED 130 can be provided with three wire leads. Two leads are connected to modulated DC and are control lines for configuration, with the third lead connected to a common ground.

Figure 4A:
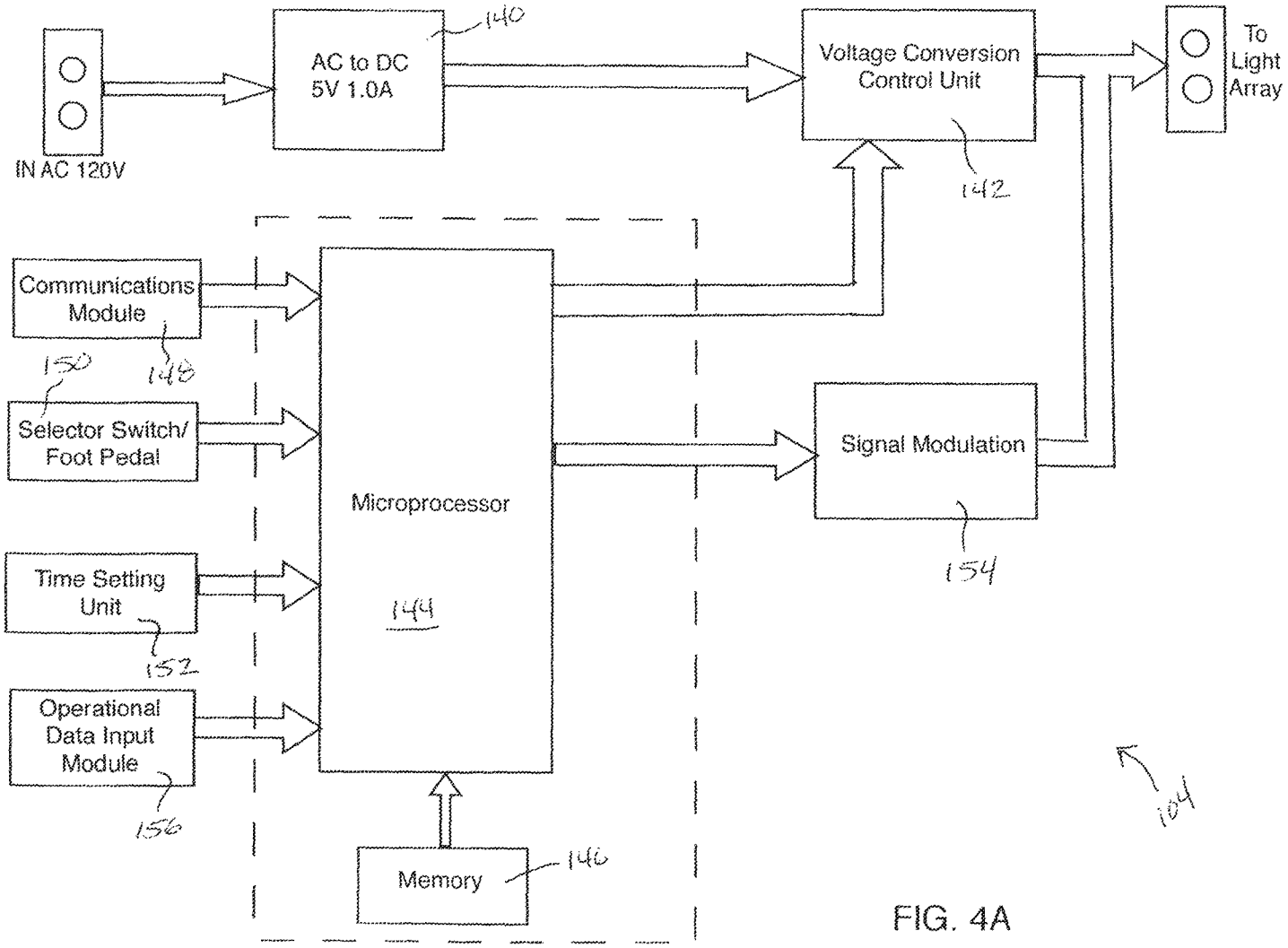
FIG. 4A depicts an embodiment of a controller as supplied with the light string, where the controller outputs a single modulated DC signal according to an embodiment of the disclosure.
Figure 4B:
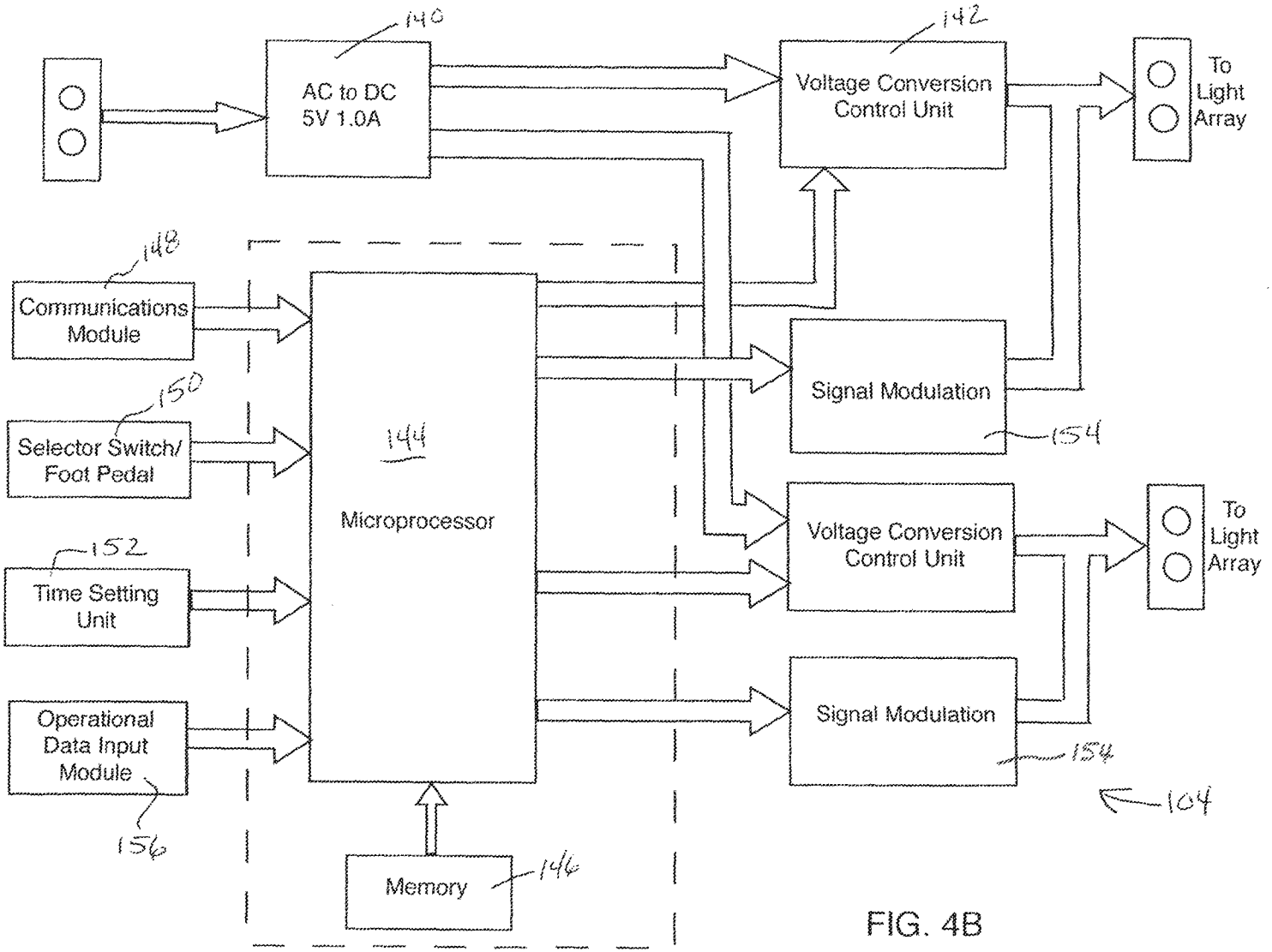
FIG. 4B depicts an embodiment of a controller as supplied with the light string, where the controller outputs a dual modulated DC signal according to an embodiment of the disclosure.

Referring to FIGS. 4A and 4B, a controller 104 is depicted according to an embodiment of the disclosure. In the depicted embodiment, the controller 104 includes a transformer 140, one or more voltage conversion control units 142, a microprocessor 144, a memory 146, a communications module 148, a selector switch 150, a time setting unit 152, one or more signal modulation units 154, and an optional operational data input module 156. In an embodiment, communications module 148 can be a receiver for Bluetooth, WiFi, and/or RF communications. In one embodiment, selector switch 150 can be a toggle switch or dial. In another embodiment, selector switch 150 can be a foot pedal, such as a foot actuated selector switch intended to be placed on the ground and actuated with a foot. Within controller 104, AC source power 117 is provided to transformer 140 which conditions and converts AC power to 5.0V DC power. The DC power, as well as operational instructions from the microprocessor 144, is fed to a voltage conversion control unit 142. The voltage conversion control unit 142 then outputs a plurality of target output voltages in the range of 2.1V to 5.0V for driving the light array 108, 109. However, other voltages are contemplated so long as the output voltages are within the operational parameters of LEDs 130.

Microprocessor 144 interfaces with a plurality of modules or peripherals to receive operating data. Examples of modules or peripherals include, but are not limited to, the communications module 148, the selector switch 150, and/or a time setting unit 152. The consumer inputs operational parameters to microprocessor 144 via these modules or peripherals to customize the operation of light string 100, 101, 116. Microprocessor 144 processes the data received and outputs instructions to a signal modulation unit 154 varying one or more properties of the carrier signal with a modulating signal that contains information to be transmitted over the DC power feed to light array 108, 109. Thus, controller 104 outputs light array operational data, programmed by the consumer, injected over the exiting DC power lines to provide a modulated signal from controller 104 to light array 108, 109.

In the embodiments of FIGS. 1A and 1B, AC source power 117 is fed to standard plug 102 with plug output being fed into controller 104, as depicted in the embodiment of FIG. 4A. This embodiment of controller 104 provides a single modulated DC output which is fed, via two wires, to light array 108. In the embodiments of FIGS. 1E and 1F, AC source power 117 is fed to standard plug 102 with plug output being fed into controller 104, as depicted in the embodiment of FIG. 4B. This controller 104 embodiment then provides two separate modulated DC outputs, two wires per output, one output each to the two subarrays 120 within the light array 109. In the embodiments of FIGS. 1C and 1D, AC source power 117 is fed to standard plug 102 with plug output being fed into controller 104, not shown. This controller 104 embodiment then provides a modulated DC output over three wires, where one wire is common, so that two separate subarrays 120 within the light array 109 can be independently controlled. In another embodiment, a data signal is provided on one wire with DC power provided on the other two wires to control light array 108. It is contemplated that any number of separate modulated DC outputs could be provided and is wholly dependent on the number of voltage conversion control units 142 and signal modulation units 154 provided. Each DC output can be provided to subarrays 120 within each light array 109 to provide differing operational parameters to each subarray 120.

DC power output from the controller 104 to the light array 108, 109 is continuous or always "on", at a voltage range of $1.8V_{DC}$ to $5.0V_{DC}$. Providing a continuous voltage of between $1.8V_{DC}$ to $2.0V_{DC}$ insures that the IC chip 132 within the LED 130 is always on and alert, thus reducing timing errors and lag. Increasing the voltage to the IC chip 132 to between $2.1V_{DC}$ to $5.0V_{DC}$ will keep the IC chip 132 "on" and, at the same time, allow for the individual LEDs 131 to illuminate as directed by the operational data. Thus, in some embodiments, voltages, varying between $1.8V_{DC}$ to $5.0V_{DC}$, can be fed continuously to the IC 132 within the LED 130 to maintain the IC 132 in a steady on state and to toggle the LEDs 131 between an on state and an off state.

Not only is LED 130 controlled by varying the voltage supplied to LED 130, but light array operational data is provided from the controller 104 to LED 130 to control lighting aspects of the light array 108, 109. Each IC 132 within each LED 130 has its own 3-digit address, where the address can be included at the end of the operational data. In other embodiments, the address can be more than 3 digits. Operational data is the general command data sent to each LED 130 and provides instruction to each individually addressed IC 132. General command data can include the power level to be provided to the LED 131, the intensity or brightness of the LED 131, which LEDs 131 to illuminate, the duration of illumination of the LED 131, and the timing of a flashing LED 131. In some embodiments, pulse width modulation (PWM) controls the dimming and brightness of the LEDs 131.

Figure 5A:
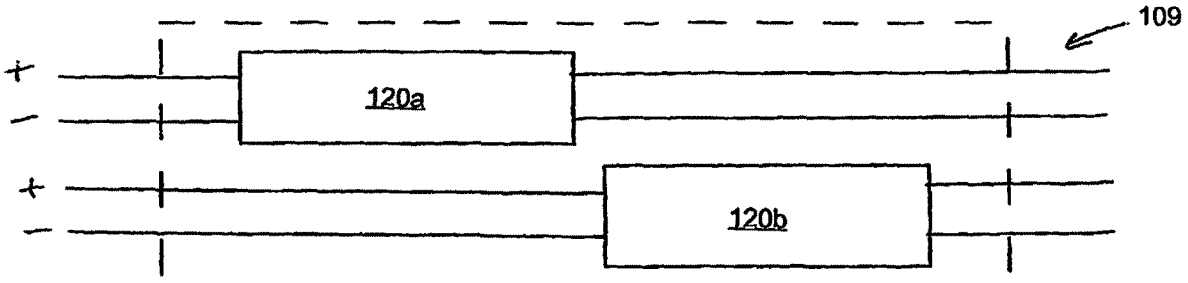
FIG. 5A illustrates an embodiment of a light array, the light array comprised of two subarrays offset from each other according to an embodiment of the disclosure.
Figure 5B:
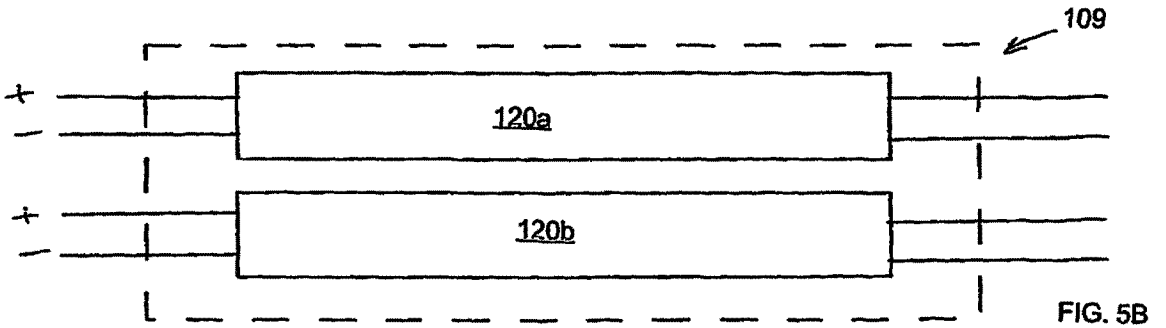
FIG. 5B illustrates an embodiment of a light array, the light array comprised of two subarrays parallel to each other according to an embodiment of the disclosure.
Figure 5C:
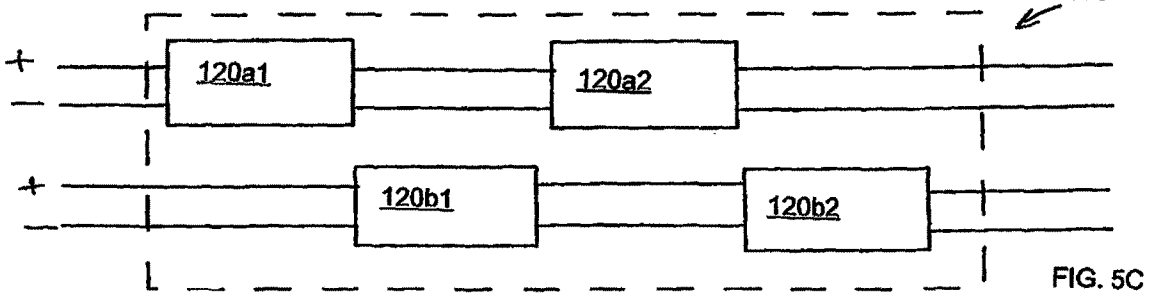
FIG. 5C illustrates an embodiment of a light array, the light array comprised of a plurality of subarrays offset from each other according to an embodiment of the disclosure.
Figure 5D:
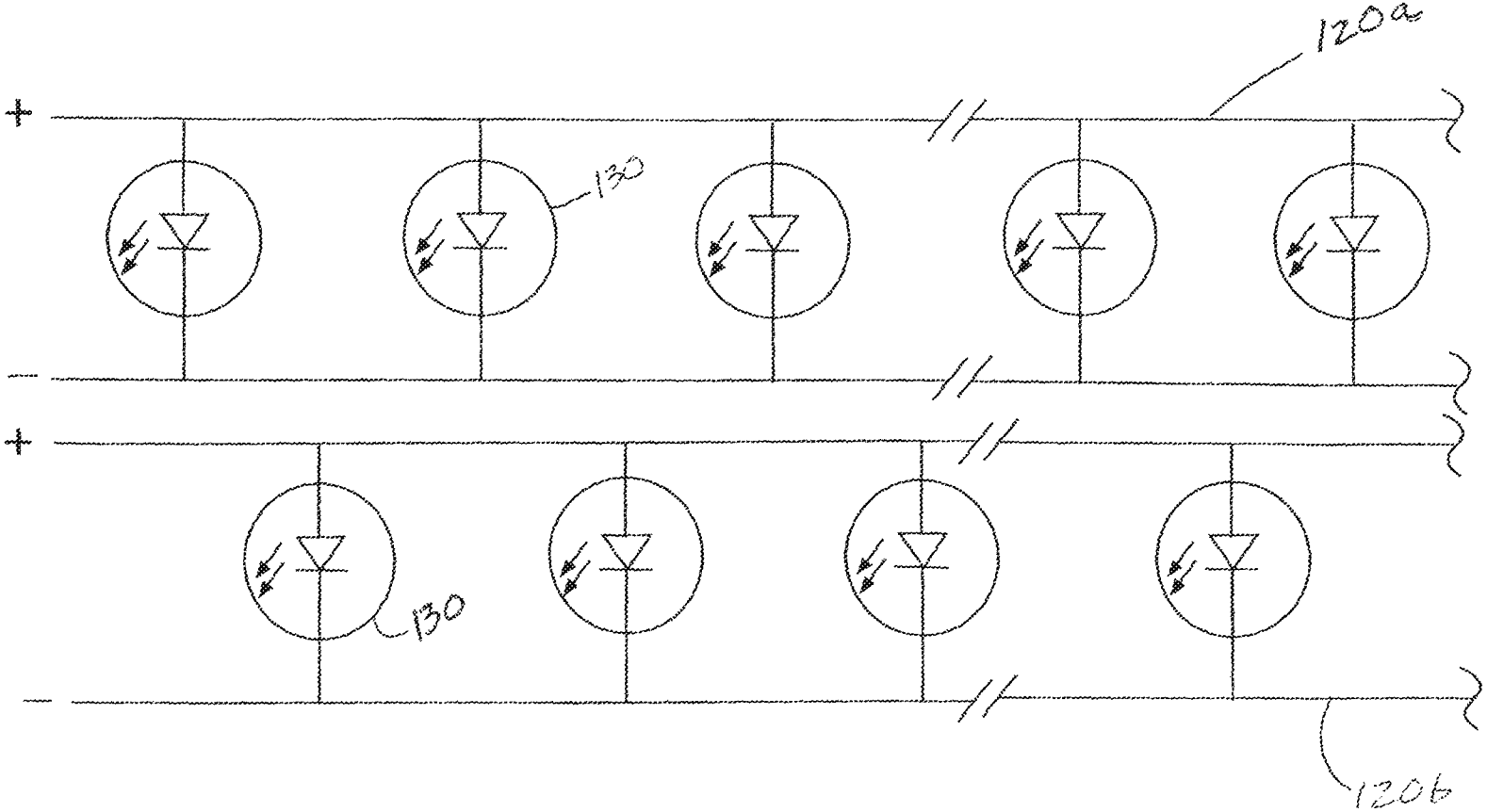
FIG. 5D illustrates an embodiment of a light array, the light array comprised of two subarrays parallel to each other wherein the individual LEDs of the first subarray are alternated with the individual LEDs of the second subarray according to an embodiment of the disclosure.

Referring to FIGS. 5A through 5C, light arrays 109 having various configurations of subarrays 120 are depicted according to embodiments of the disclosure. Each subarray 120 may be configured similarly to the light array 108 of FIG. 3B. Light array 109 is provided with a four wire input, two wires to each subarray 120. As discussed above, the controller 104 of FIG. 4B would provide two separate and independent modulated outputs, one to each of the subarrays 120. FIG. 5A depicts a light array 109 having subarrays 120*a*, 120*b* that are configured to be offset from one another. FIG. 5B depicts light array 109 comprised of subarrays 120*a*, 120*b* that are configured to be adjacent to each other. In one embodiment, the LEDs 130 of subarray 120*a* are disposed so that the LEDs 130 alternate with the LEDs 130 of subarray 120*b*, as illustrated in FIG. 5*d*. It is contemplated that the LEDs 130 can be disposed so that various patterns can be provided. For example, a 2-1 pattern, a 3-2 pattern, etc. It is apparent that an infinite number of patterns could be provided and that the concept of adjacent subarrays 120*a*, 120*b* provides a multitude of configurations so that the examples shown are not limiting. In FIG. 5C, subarrays 120*a*1, 120*a*2, 120*b*1, 120*b*2 may be disposed in an alternating configuration. And, as with FIG. 5B, it is contemplated that subarrays 120 can be disposed in varying patterns and configurations and the example above is not limiting.

The DC power overlaid with operational data not only operates light array 108, 109 but is output from light array 108, 109 to the receptacle assembly 110. Receptacle assembly 110 mates with plug assembly 106 of a subsequent light string 116 thus providing operational data to the light array 108, 109 of this subsequent light string 116. Light strings 116 can thus be connected serially so that each subsequent light string 116 operates in accordance with the operational data of the preceding light string 100, 101.

In an embodiment, a controller 104 can be provided prior to light string 116 so that light string 116 can be individually programmed to operate differently of any other light string 100, 101, 116. However, light string 116 can also be controlled, at the same time, by light string 100, 101 controller 104, so that light string 116 is synchronized with light string 100, 101, 116.

Referring to FIGS. 6, 6A, and 6B, a male electrical terminal 160 is depicted in an embodiment of the disclosure. As discussed above, a plug assembly 106 having from two- to four-conductors can be used as a connector for a light string 100, 101, 116. Male electrical terminal 160 is manufactured of a conductive metal and comprises an insulation crimp 162, a conductor crimp 164, a catch plate 166, a male barrel 168, and a semi-spherical end cap 170. Male barrel 168 can be formed to provide a hollow cylinder 174 where the semi-spherical end cap 170 is closed and can be hemisphere shaped. In an embodiment, hollow cylinder 174 can be formed so that a slit 176 is provided longitudinally. In an embodiment, male barrel 168 outside surface can be provided with an indentation 172 that can be generally semi-spherical in shape, where the indentation 172 is disposed opposite the slit 176. In another embodiment, male barrel 168 outside surface can be provided with a projection (not depicted) that can be generally semi-spherical in shape, where the projection is disposed opposite the slit 176. In another embodiment, male barrel 168 surface is without indentations or projections. The semi-spherical end cap 170 of the male barrel 168 may also define a plurality of slits 178. In some embodiments, the longitudinal slit 176 may be a continuation of one of the plurality of slits 178.

Figure 7:
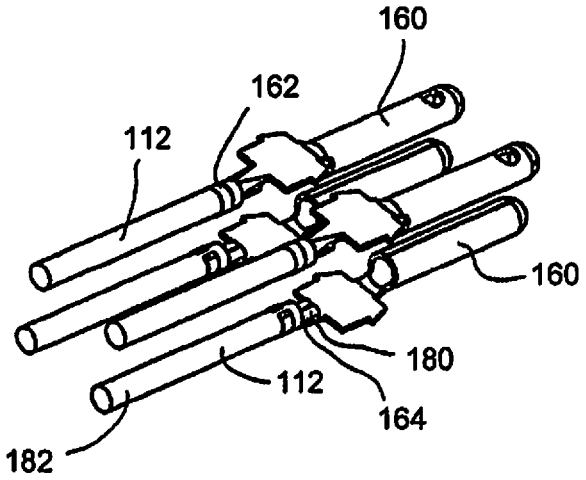
FIG. 7 illustrates an embodiment of male electrical terminals according to an embodiment of the disclosure.

Referring to FIG. 7, the wiring 112 fixedly attached to male electrical terminals 160 is depicted according to an embodiment of the disclosure. The layout of the male electrical terminals 160 is amenable to being disposed in a four-conductor plug assembly 106. Wiring 112 is provided so that a portion of the conductor 180 extends beyond the insulation 182. Conductor 180 is positioned within the conductor crimp 164 and conductor crimp 164 is crimped around conductor 180 to fixedly engage conductor 180 to male electrical terminal 160 thus providing an electrical pathway. Insulation 182 is positioned within insulation crimp 162 and insulation crimp 162 is crimped around insulation 182 to fixedly engage the wiring 112 to male electrical terminal 160.

Figure 8B:
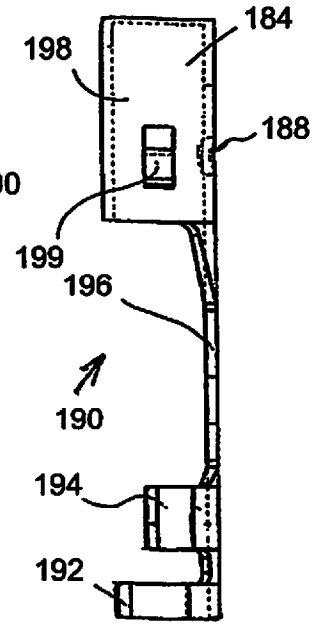
FIG. 8B illustrates a side view of an embodiment of a female electrical terminal according to an embodiment of the disclosure.
Figure 8A:
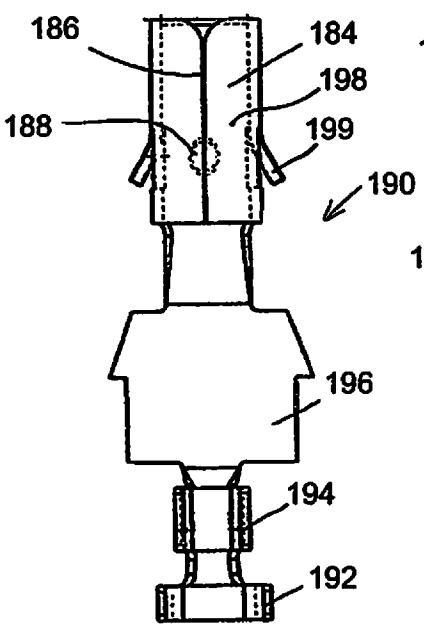
FIG. 8A illustrates a top view of an embodiment of a female electrical terminal according to an embodiment of the disclosure.
Figure 8:
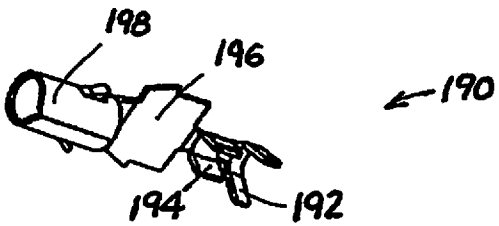
FIG. 8 is a perspective view the female electrical terminal of FIG. 6.
Figures 10A, 10B, 10C, 10D, 10E, 10F:
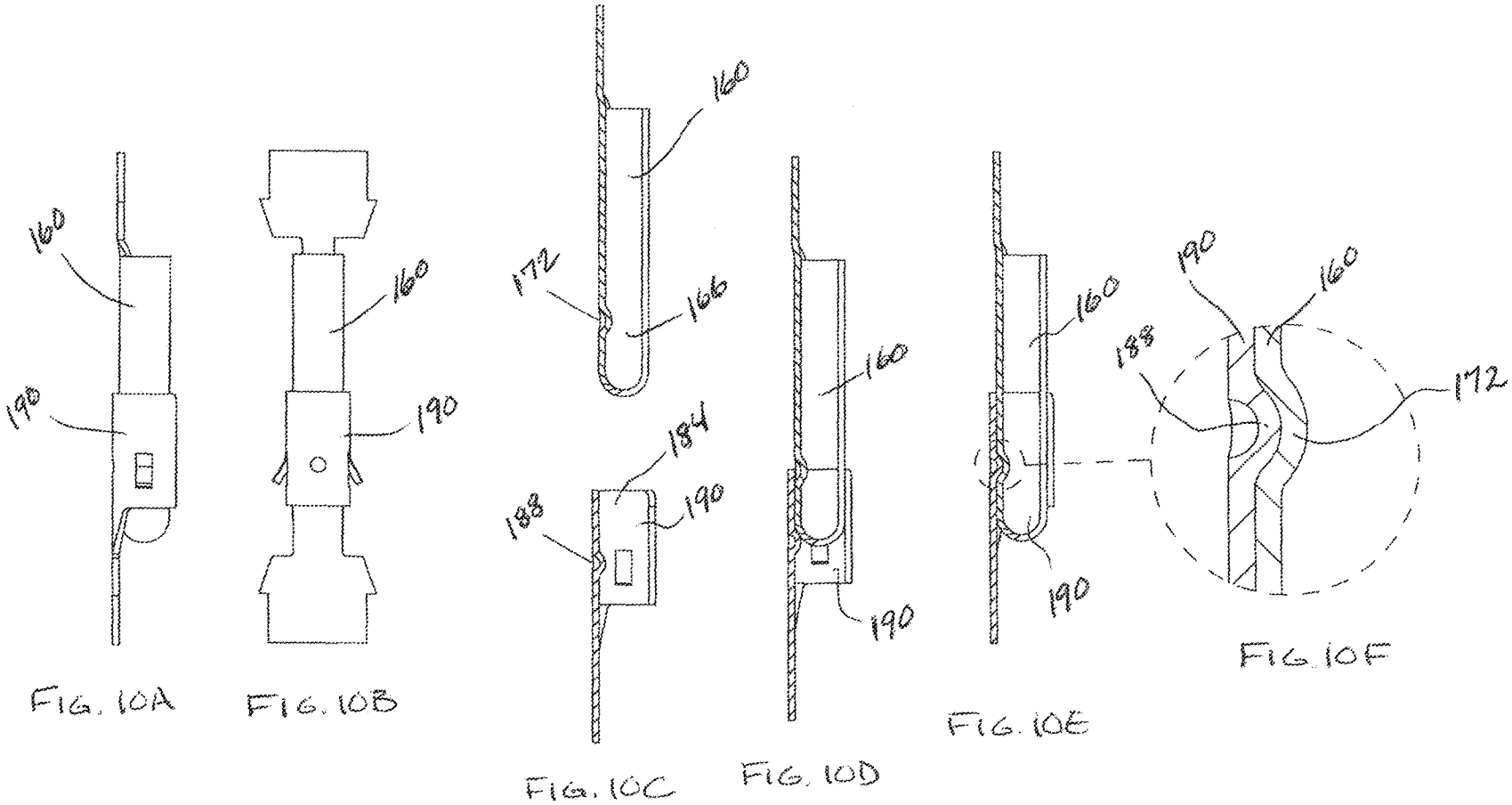
FIG. 10A illustrates a side view of an embodiment of a male electrical terminal inserted in a female electrical terminal according to an embodiment of the disclosure.
FIG. 10B illustrates a top view of an embodiment of a male electrical terminal inserted in a female electrical terminal according to an embodiment of the disclosure.
FIGS. 10C, 10D, and 10E illustrate the progression of the insertion of a male electrical terminal into a female electrical terminal according to an embodiment of the disclosure.
FIG. 10F illustrates a detailed view of the male electrical terminal indentation matingly engaged with the female electrical terminal projection when the male electrical terminal and female electrical terminal are correctly mated according to an embodiment of the disclosure.

Referring to FIGS. 8, 8A, and 8B, a female electrical terminal 190 is depicted in an embodiment of the disclosure. As discussed above, a receptacle assembly 110 having from two to four female electrical terminals can be used as a connector for a light string 100, 101, 116. Female electrical terminal 190 is manufactured of a conductive metal and comprises an insulation crimp 192, a conductor crimp 194, a catch plate 196, and a female barrel 198. Female barrel 198 can be formed to provide a hollow cylinder 184 where both ends are open. In an embodiment, hollow cylinder 184 can be formed so that a slit 186 is provided longitudinally. Female barrel 198 can have tension wings 199 punch pressed on three sides from the female barrel 198 so that the tension wings 199 remain attached, on one side, to the female barrel 198. In an embodiment, female barrel 198 inside surface can be provided with a protrusion 188 that can be generally spherical in shape, where the protrusion 188 is disposed opposite the slit 186. In another embodiment (not shown), female barrel 198 inside surface can be provided with an indentation that can be generally spherical in shape, where the indentation is disposed opposite the slit 186. In another embodiment, the surface of the female barrel 190 is without indentations or protrusions.

Functionally, the catch plate 166, 196 may be disposed in a catch plate slot (discussed below) to secure the electrical terminal 160, 190 within a body or housing at a fixed orientation. The semi-spherical indentation 172 and protrusion 188 may be configured to cooperate to better secure the male and female electrical terminals 160 and 190 to each other (discussed below attendant to FIGS. 10A through 10F). Alternatively or in addition, the slits 178 and 179 of the male electrical terminal 160 enable the male barrel 168 to fold radially inward when inserted into a female barrel 198. As such, the outer diameter of the male barrel 168 can be sized for an interference fit with the inner diameter of the female barrel 198; because one or both of the slit 186 of the female barrel 198 and the slits 176 and 178 of the male barrel, the male and female barrels 168, 198 elastically deform radially, providing a connection that is, in effect, spring loaded in the radial direction about the circumference of the male and female barrels 168, 198.

Figure 9:
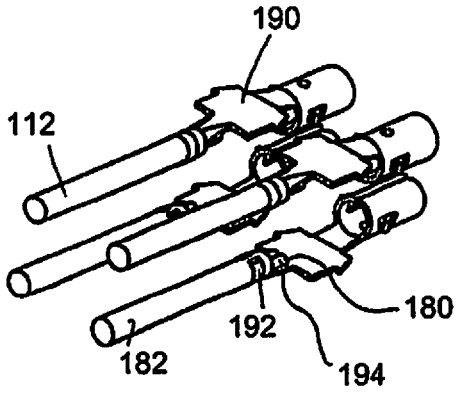
FIG. 9 illustrates an embodiment of female electrical terminals according to an embodiment of the disclosure.

Referring to FIG. 9, the wiring 112 fixedly attached to female electrical terminal 190 is depicted according to an embodiment of the disclosure. The layout of the female electrical terminals 190 is amenable to being disposed in a four-conductor receptacle assembly 110. Wiring 112 is provided so that a portion of the conductor 180 extends beyond the insulation 182. Conductor 180 is positioned within the conductor crimp 194 and conductor crimp 194 is crimped around conductor 180 to fixedly engage conductor 180 to female electrical terminal 190 thus providing an electrical pathway. Insulation 182 is positioned within insulation crimp 192 and insulation crimp 192 is crimped around insulation 182 to fixedly engage the wiring 112 to female electrical terminal 190.

Referring to FIGS. 10A through 10F, the mating of the male electrical terminal 160 to the female electrical terminal 190 is depicted according to an embodiment of the disclosure. The male electrical terminal 160 is provided with an indentation 172 and female electrical terminal 190 is provided with a protrusion 188, where the indentation 172 and protrusion 188 have shapes that are mutually complementary and are arranged for mutual engagement. As shown, male electrical terminal 160 is a male connector and female electrical terminal 190 is a female connector. The male barrel 168 of male electrical terminal 160 is sized and shaped so that male barrel 168 can be snugly inserted into the female electrical terminal 190 hollow cylinder 184 to ensure a reliable physical and electrical connection. As male barrel 168 progresses through hollow cylinder 184, depicted in FIG. 10D, semi-spherical end cap 170 slides over protrusion 188 so that male barrel 168 travels over protrusion 188 until protrusion 188 is aligned with and matingly engages with indentation 172 locking the male barrel 168 within hollow cylinder 184. In an embodiment, male electrical terminal 160 and female electrical terminal 190 can be separated by application of a pull force of three pounds-force (lbf) to 15 lbf inclusive. Herein, a range that is said to be "inclusive" includes the end point values of the range as well as all values between the endpoint values. It is contemplated that various configurations of indentations and protrusions meet the spirit and scope of the disclosure and the embodiment as described is not limiting.

Figure 11A:
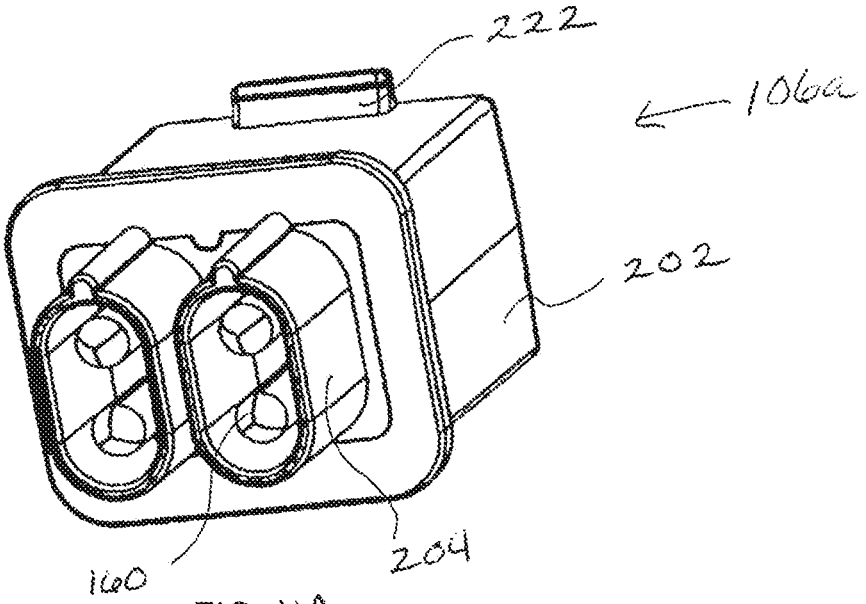
FIG. 11A depicts the front and top perspective view of an embodiment of a four-conductor plug assembly as provided on a light string according to an embodiment of the disclosure.
Figure 11B:
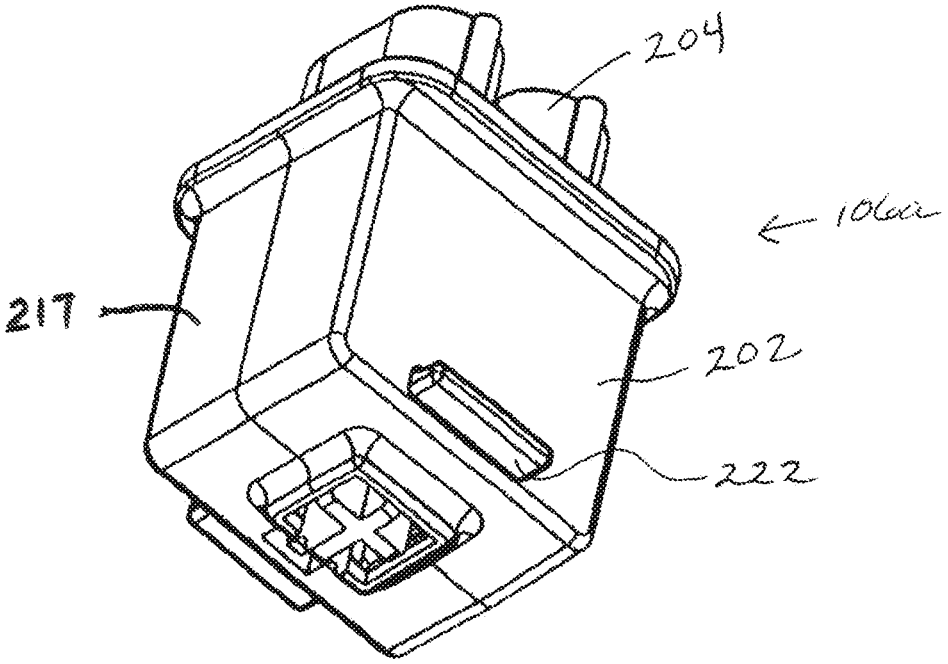
FIG. 11B depicts the bottom and rear perspective view of an embodiment of a four-conductor plug assembly as provided on a light string according to an embodiment of the disclosure.

As discussed above, plug assembly 106 can be comprised of two to four male electrical terminals 160 where the male electrical terminals 160 are combinatorial power and data terminals. In one embodiment of a four-conductor plug assembly 106*a*, as depicted in FIGS. 11A and 11B, plug assembly 106*a* is comprised of a plug housing 202, a plug insert 204, and a plurality of terminal male electrical terminals 160.

Figure 12A:
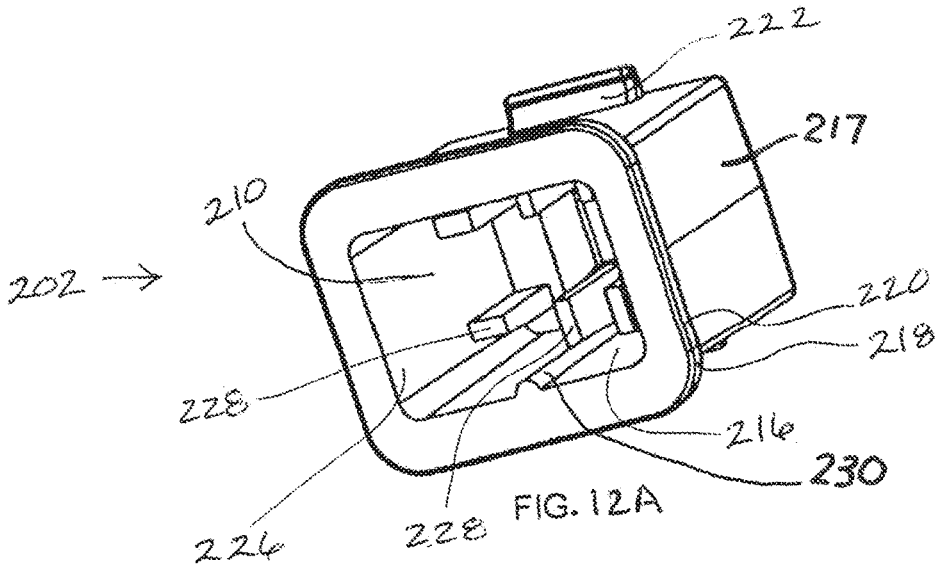
FIG. 12A depicts a perspective view of an embodiment of a plug assembly housing provided for a four-conductor plug assembly according to an embodiment of the disclosure.
Figure 12B:
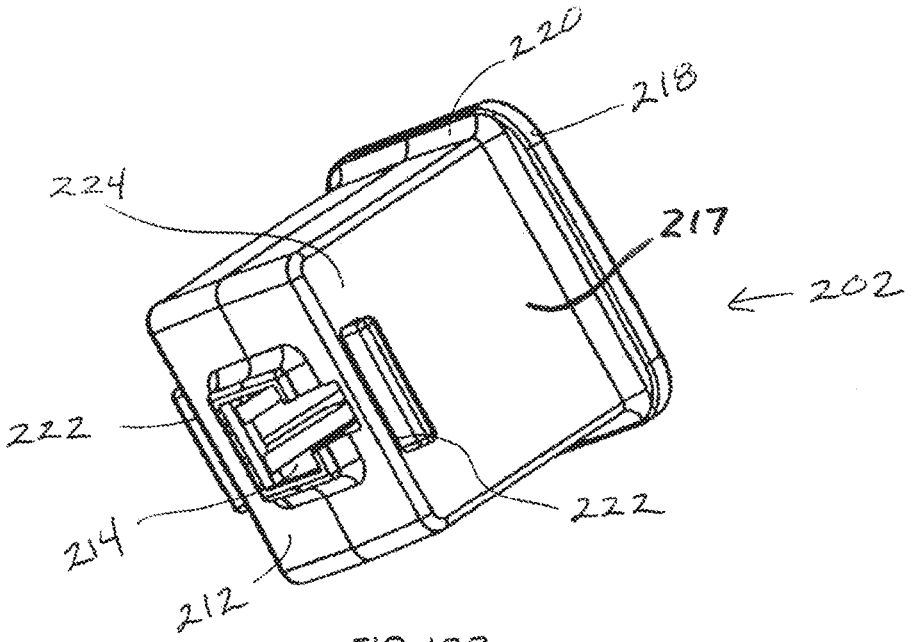
FIG. 12B depicts a perspective view of an embodiment of a plug housing provided for a four-conductor plug assembly according to an embodiment of the disclosure.

Referring to FIGS. 12A and 12B, a plug housing 202 is depicted according to an embodiment of the disclosure. The plug housing 202 includes an open end 210, a closed end 212 having a feedthrough aperture 214, and a plug housing cavity 216. In the depicted embodiment, the plug housing 202 is generally a hollow cuboid defined by a plurality of side walls 217; however, other geometries are contemplated, such as a generally hollow cylinder, in which there is a single cylindrical side wall.

In an embodiment, open end 210 can be flared at the edges so that edges 218 extend beyond the walls of the rectangular cube shape to provide a flange 220. Open end 210 is formed to correspond to the shape of the front wall 240 of the plug insert 204 (see FIGS. 13A). In some embodiments, a spline 230 can be formed integral with the inner surface 226 of the plug housing 202. Plug housing 202 is further provided with a plurality of gripping protrusions 222 extending from the plug housing 202 outer surface 224 nearer the closed end 212 of plug housing 202, where gripping protrusions 222 provide gripping mechanisms for the user. Plug housing 202 can be a single formed piece of material or a plurality of formed pieces molded together and can be manufactured of a plastic or plastic composite. The inner surface 226 of the plug housing 202 can be provided with a plurality of projections or plug spacers 228 for registration and support of the plug insert 204.

Figure 13A:
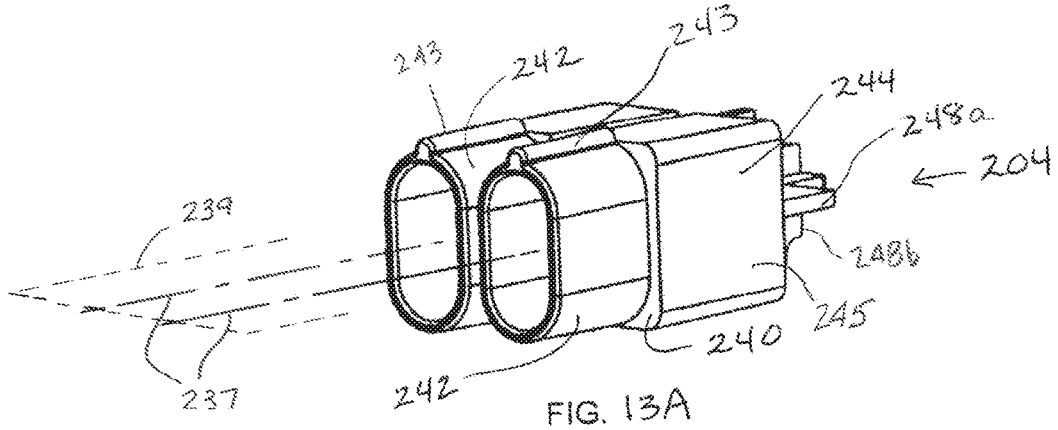
FIG. 13A depicts a perspective view of the side and front of an embodiment of a plug insert provided as part of a four-conductor plug assembly according to an embodiment of the disclosure.
Figure 13B:
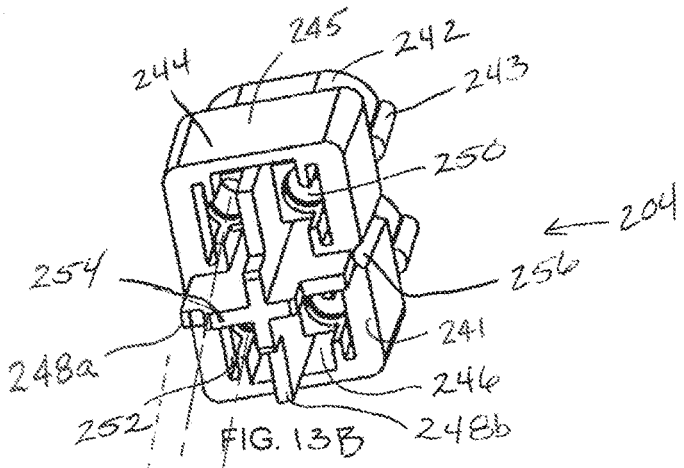
FIG. 13B depicts the rear view of an embodiment of a plug insert provided as part of a four-conductor plug assembly according to an embodiment of the disclosure.
Figure 14:
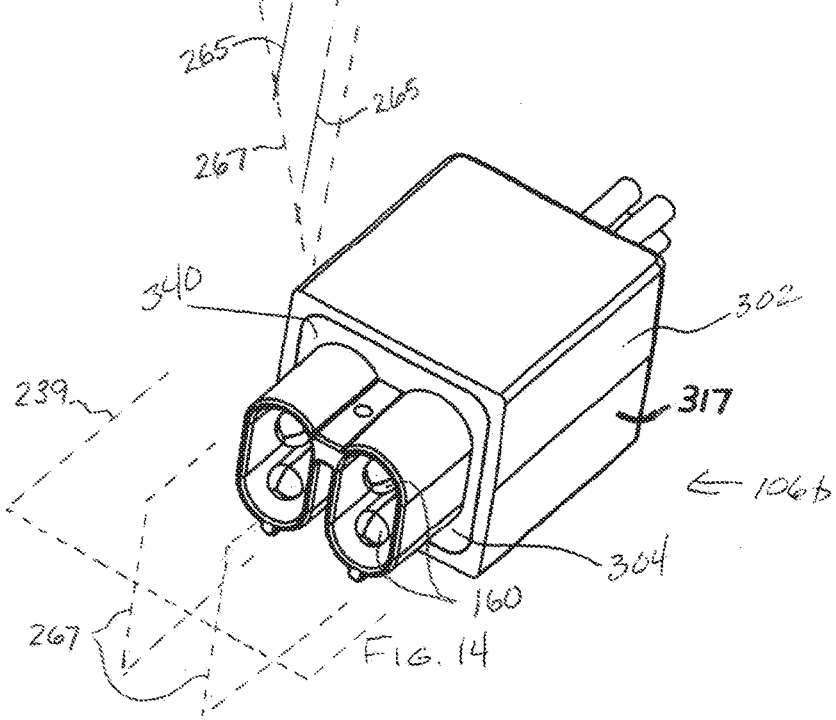
FIG. 14 depicts the front and top perspective view of another embodiment of a four-conductor plug assembly as provided on a light string according to an embodiment of the disclosure.
Figure 15A:
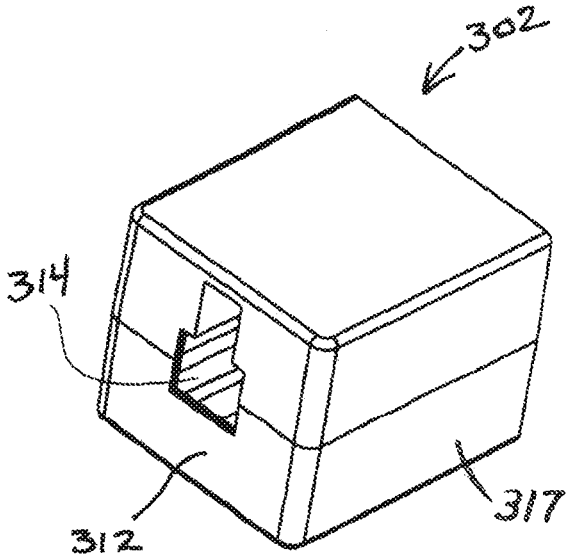
FIG. 15A depicts a rear perspective view of another embodiment of a plug housing provided for a four-conductor plug assembly according to an embodiment of the disclosure.
Figure 15B:
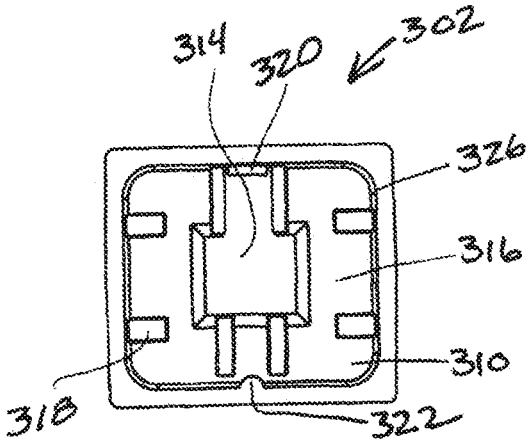
FIG. 15B depicts a front perspective view of another embodiment of a plug housing provided for a four-conductor plug assembly according to an embodiment of the disclosure.
Figure 16A:
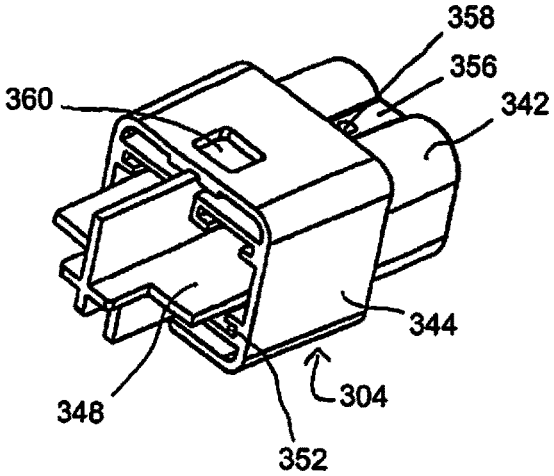
FIG. 16A depicts a perspective view of the side and rear of an embodiment of a plug insert provided as part of a four-conductor plug assembly according to an embodiment of the disclosure.
Figure 16B:
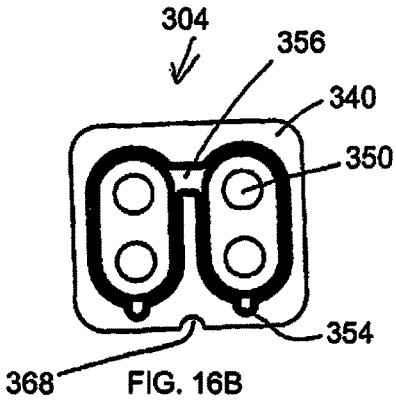
FIG. 16B depicts the front view of an embodiment of a plug insert showing the tubular projections provided as part of a four-conductor plug assembly according to an embodiment of the disclosure.
Figure 16C:
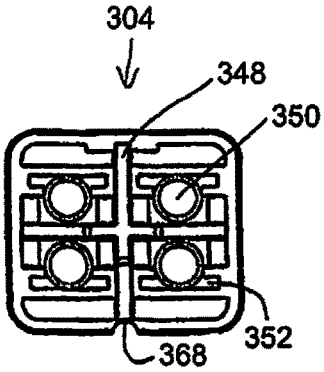
FIG. 16C depicts the rear view of an embodiment of a plug insert showing the terminal apertures and plug partition walls provided as part of a four-conductor plug assembly according to an embodiment of the disclosure.
Figure 16D:
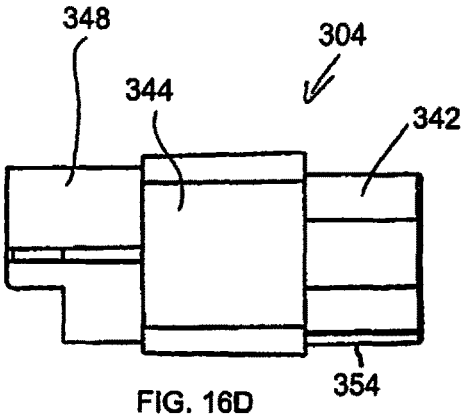
FIG. 16D depicts the side view of an embodiment of a plug insert showing the tubular projections, plug partition walls and body provided as part of a four-conductor plug assembly according to an embodiment of the disclosure.

Referring to FIGS. 13A and 13B, the plug insert 204 is depicted according to an embodiment of the disclosure. The plug insert 204 includes a plug body 244 having a front wall 240 and a rearward face 241 separated by an outer peripheral surface 245, the plug body 244 defining a rearward cavity 246. The front wall 240 defines two pair of terminal apertures 250, each aperture 250 defining and being concentric about a terminal aperture axis 265 that is perpendicular to the front wall 240. Tubular projections 242 extend forward of the front wall 240, each surrounding a respective pair of the terminal apertures 250. The terminal aperture axes 265 of a given pair 250 are parallel and define a respective plane 267 (only one plane 267 is depicted in FIG. 13B). The tubular projections 242 each define and are centered about a respective tubular projection axis 237 that is perpendicular to the front wall 240. The tubular projection axes 230 define a plane 239 that may be substantially orthogonal to the planes 267 (FIG. 14).

In some embodiments, the splines 243 of the tubular projections 232 and the grooves 441 of the receptacle insert are disposed on one side of the plane 239 (FIGS. 13A and 14) when the plug assembly 106*a* and the receptacle assembly 110*a* are securely coupled. Such an arrangement provides a keyed connection, wherein the plug and receptacle assemblies 106*a* and 110*a* cannot be connected in any other orientation.

The tubular projections depicted herein present a cross-section that is of a "race track" profile (i.e., semi-circular ends separated by parallel straight lengths). More generally, the cross-sections of the tubular projections presented herein are "oblong," which includes the race track profile, as well as substantially rectangular profiles, with substantially square or rounded corners. The tubular projections are not limited to the race track or the oblong cross-sectional profiles. Other profiles are contemplated, including but not limited to circular, polygonal, oval, and elliptical profiles.

In some embodiments, plug partition walls 248*a* and 248*b* extend rearward from the rearward cavity 246. The plug body 244 may further define catch plate slots 252 that extend rearwardly and are accessible from the rearward face 241. The plug body 244 of plug insert 204 can also be formed so that a groove 256 extends along the plug body 396 length, dimensioned to matingly engage with spline 230 of plug housing 202 upon insertion of plug insert 204 into plug housing 202.

Plug insert 204 can be manufactured of a plastic or plastic composite and, as discussed above, plug insert 204 front wall 240 is sized and shaped to correspond to the open end 210 of plug housing 202 so that when plug insert 204 is inserted into plug housing cavity 216, the front wall 240 fits snugly in open end 210 and sits essentially flush with the face of flange 220. In some embodiments, a groove 256 can be formed on the outside surface of plug body 244 traversing the plug body 244 from the front wall 240 to the rear of the plug body 244, the groove 256 corresponding to plug housing 202 spline 230 so that when plug insert 204 is inserted into plug housing 202, the spline 230 and groove 256 matingly engage. In an embodiment, each tubular projection 242 is formed so that a spline 243 is formed on the outside surface of the tubular projection 242 where the spline 243 cooperates with corresponding grooves on receptacle assembly 110 to ensure that plug 106*a* and receptacle assembly 110 are properly mated.

While the depicted embodiment presents the spline 230 as being formed on the inner surface 226 of the plug housing 202, and the groove 256 as being defined on the plug insert 204, those of skill in the relevant arts will recognize that this arrangement can be reversed to the same effect. That is, the spline may project outward from the plug insert 204 into a groove defined on an interior of the plug housing 202.

Terminal apertures 250 are sized to correspond to the circumference of male barrel 168 so that when male electrical terminal 160 is inserted into plug insert 204, male barrel 168 is surrounded by and firmly held by terminal aperture 250. Catch plate slots 252 are sized to accept catch plate 166, the catch plate 166 locking into place when inserted into the slot 252. It is noted that prior to insertion of male electrical terminal 160, wiring 112 is fixedly attached to male electrical terminal 160.

Within the rearward cavity 246 of plug insert 204, plug partition walls 248*a* and 248*b* are formed to create a physical barrier between each of the inserted male electrical terminals 160. The walls 248 extend perpendicular from the back of the front face 240 and from the sides of the plug body 244 to generally form a cross-shaped cross section. The plug partition walls 248*a* and 248*b* can be of various heights and configurations.

The plug spacers 228 of the plug housing 202 are dimensioned to provide separation between the plug body 244 of the plug insert 204 and the closed end 212 of plug housing 202 when the plug insert 204 is registered against the plug spacers 228. Also, the plug spacers 228 may be dimensioned so that when the plug insert 204 is registered against the plug spacers 228, the front face 240 of the plug insert 204 is essentially flush with the open end 210 of the plug housing 202.

In assembling plug assembly 106*a*, four male electrical terminals 160, with attached wires 112, are disposed within terminal apertures 250 so that catch plates 166 are fully inserted and locked in the catch plate slots 252. Male barrels 168 of electrical terminals 160 extend beyond the front face 240 and are disposed within the tubular projection 242 so that the tubular projection 242 shroud the barrels 168. This assembly, wire end first, is inserted in plug housing 202 cavity 216 open end 210 so that top portion 248 of plug partition walls 248*a* and 248*b* extend into the feedthrough aperture 214 of the plug housing 202 providing the plug assembly of FIGS. 11A and 11B (figures do not illustrate wiring).

Plug partition walls 248*a* and 248*b* provide the additional benefit of isolating electrically conductive components from each other to prevent arcing across air gaps. When plug insert 204 is disposed within plug housing 202, the top portion 254 of plug partition walls 248*a* and 248*b* corresponds to and registers within the feedthrough aperture 214 of the plug housing 202. When assembled, top portion 254 is disposed in aperture 214 such that aperture 214 imparts squeezing pressure on top portion 254 thereby compressing top portion 254 and correspondingly squeezing the wiring 112 that is fixedly attached to male electrical terminals 160. The compression of the wires 112 by the top portion 254 provides the benefit of further securing the wiring to the plug assembly 106*a* and provides a securing force that enables the wiring to comply with the UL flex test.

Configuring the plug assembly 106*a* as a 3-conductor plug is also contemplated. Such configuration is attainable by merely leaving one of the terminal apertures 250 of the plug insert 204 unoccupied, i.e., without a male electrical terminal 160. The corresponding, opposing terminal bore 450 of the receptacle assembly 110*a* may also remain unoccupied.

Referring to FIGS. 14 through 17, a plug assembly 106*b* for four electrical conductors is depicted according to an embodiment of the disclosure. The four conductor plug assembly 106*b* includes a plug insert 304, a plug housing 302, an plug insert 304, and a plurality of terminal male electrical terminals 160. The plug housing 302 is generally a hollow cuboid having an open end 310, a closed end 312 defining a feedthrough aperture 314 that accesses an inner cavity 316, and a plurality of projections or plug spacers 318. In the depicted embodiment, the plug housing 302 is generally a hollow cuboid defined by a plurality of side walls 317; however, other geometries are contemplated, such as a generally hollow cylinder, in which there is a single cylindrical side wall.

In some embodiments, the open end 310 is formed to correspond to the shape of the front wall 340 of the plug insert 304. In some embodiments, a spline 322 is formed on the inner surface 326 of plug housing 302. Plug housing 302 can be a single formed piece of material or a plurality of formed pieces molded together and can be manufactured of a plastic or plastic composite. The plurality of plug spacers 318 may extend from the inner surface 326 of the plug housing 302 for registration and support of the plug insert 304. The inner surface 326 of the plug housing 302 may include a projection or detent 320 that extends into the inner cavity 316 of the plug housing 302, the detent 320 configured to mate or snappingly engage with an aperture or recess 360 provided in the plug insert 304.

While the depicted embodiment presents the detent 320 as extending into the inner cavity 316 of the plug housing 302, and the recess 360 as being defined on the plug insert 304, those of skill in the relevant arts will recognize that this arrangement can be reversed to the same effect. That is, the detent may project outward from the plug insert 304 into a recess defined on an interior of the plug housing 302.

Plug insert 304 comprises a plug body 344, a front face 340, tubular projections 342 that extend beyond front face 340, plug partition walls 348, terminal apertures 350, recess 360, retaining bridge 356, receiver aperture 358, and catch plate slots 352. Plug insert 304 can be manufactured of a plastic or plastic composite and, as discussed above, plug insert 304 front wall 340 is sized and shaped to correspond to the open end 310 of plug housing 302 so that when plug insert 304 is inserted into the inner cavity 316 of plug housing 302, the front wall 340 fits snugly in open end 310. In some embodiments, a groove 368 is formed along the length of the plug body 344 from the front face 340 to the rear of the plug body 344. Groove 368 is dimensioned so that when plug insert 304 is inserted into plug housing 302, spline 322 matingly engages with groove 368 thus ensuring that plug insert 304 is fitted into plug housing 302 with the correct orientation. In an embodiment, tubular projection 342 is formed so that a spline 354 is formed on the outside surface of the cylinder 342 where the spline 354 cooperates with corresponding grooves on receptacle assembly 110 to ensure that plug 106*b* and receptacle assembly 110 are properly mated.

Figure 17:
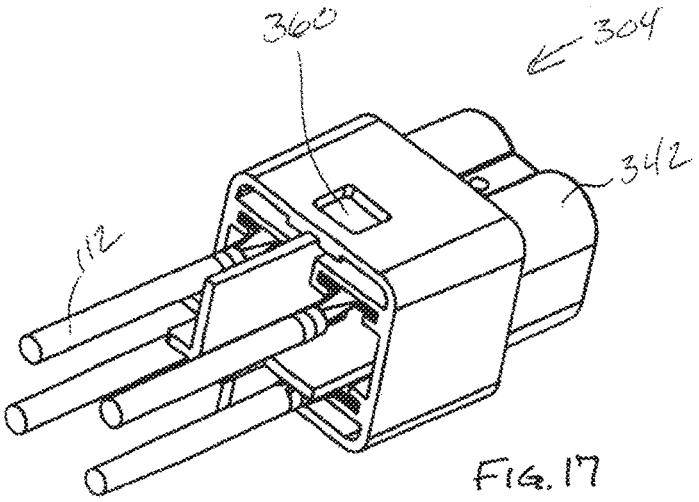
FIG. 17 depicts the rear and top perspective view of another embodiment of a plug insert for a four-conductor plug assembly according to an embodiment of the disclosure.

Terminal apertures 350 are sized to correspond to the circumference of male barrel 168 so that when male electrical terminal 160 is inserted into plug insert 304, male barrel 168 is surrounded by and firmly held by terminal aperture 350. Catch plate slots 352 are sized to accept catch plate 166, the catch plate 166 locking into place when inserted into the slot 352, as illustrated in FIG. 17. Prior to insertion of male electrical terminal 160, wiring 112 may be fixedly attached to male electrical terminal 160.

In assembling plug assembly 302, four male electrical terminals 160, with attached wires 112, are disposed within terminal apertures 350 so that catch plates 166 are fully inserted and locked in the catch plate slots 352. Male barrels 168 of electrical terminals 160 extend beyond the front face 340 and are disposed within the tubular projections 342 so that the tubular projection 342 shroud the barrels 168. This assembly, wire end first, is inserted in plug housing 302 cavity 316 open end 310 so that plug partition walls 348 extend into the feedthrough aperture 314 of the plug housing 302. The plug partition walls 348 of plug insert 304 are formed to create a physical barrier between each of the inserted male electrical terminals 160. The plug partition walls 348 extend perpendicular from the back of the front face 340, and from the sides of the plug body 344 to generally form a cross-shaped cross section. The plug partition walls 348 can be of various heights and configurations, and may extend beyond the rear of the plug body 344. Plug partition walls 348 create partitions providing the additional benefit of isolating electrically conductive components from each other to prevent arcing across air gaps.

The plug spacers 318 of the plug housing 302 are dimensioned to provide separation between the plug body 344 of the plug insert 304 and the closed end 312 of plug housing 302 when the plug insert 304 is registered against the plug spacers 318. Also, the plug spacers 318 may be dimensioned so that when the plug insert 304 is registered against the plug spacers 318, the front wall 340 of the plug insert 304 is essentially flush with the open end 310 of the plug housing 302.

When plug insert 304 is disposed within plug housing 302, the top portion 354 of plug partition walls 348 corresponds to and registers within the feedthrough aperture 314 of the plug housing 302. When plug insert 304 is properly seated within plug housing 302, detent 320 is mated with (i.e., snaps into) recess 360 so that plug housing 302 and plug insert 304 are locked together. When assembled, plug partition walls 348 are disposed in aperture 314 such that aperture 314 imparts squeezing pressure on plug partition walls 348 thereby compressing the plug partition walls 348 and correspondingly squeezing the wiring 112 that is fixedly attached to male electrical terminals 160. The compression of the wires 112 by the top portion 354 provides the benefit of further securing the wiring to the plug assembly 106*b* and provides a securing force that enables the wiring to comply with the UL flex test.

Figure 18:
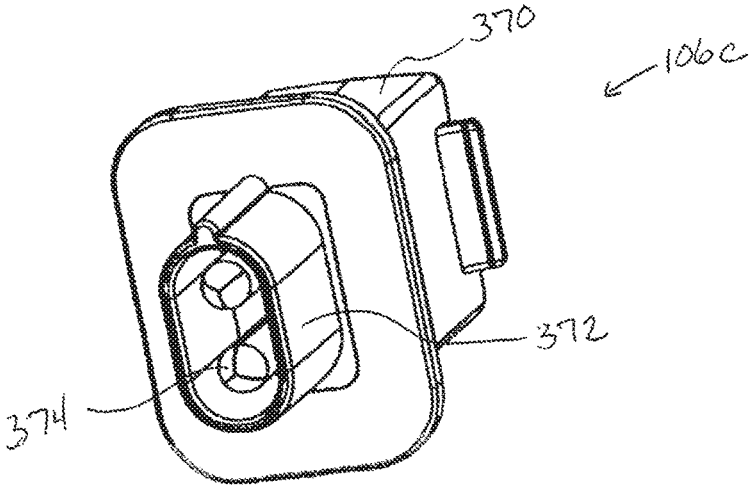
FIG. 18 depicts the front and top perspective view of an embodiment of a two-conductor plug assembly as provided on a light string according to an embodiment of the disclosure.

Referring to FIG. 18, a plug assembly 106*c* for two conductors is depicted according to an embodiment of the disclosure. The two-conductor plug assembly 106*c* may be used as a connector for a light string 100, 101, 116. Plug 106*c* is comprised of a plug housing 370, a plug insert 372, and a plurality of male electrical terminals 374 with fixedly attached wiring 112. The two-conductor plug assembly 106*c*, as shown, corresponds most closely to the embodiment of the four-conductor plug assembly 106*a*, as shown in FIG. 11A. However, a two-conductor plug assembly that corresponds with the design aspects of the four-conductor plug assembly 106*b* as disclosed above is also contemplated.

Figure 19A:
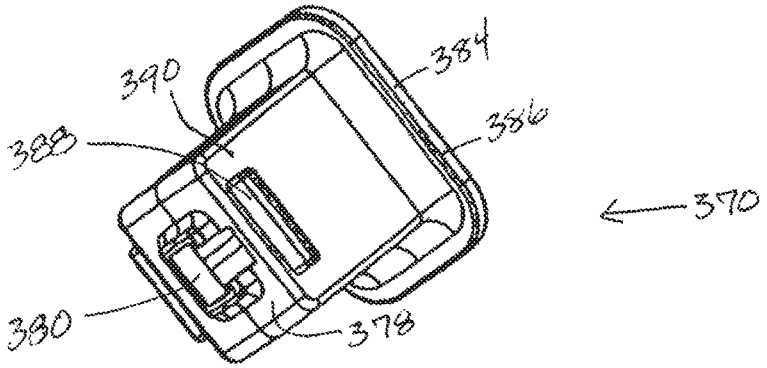
FIG. 19A depicts a rear and top perspective view of an embodiment of a plug housing provided for a two-conductor plug assembly according to an embodiment of the disclosure.
Figure 19B:
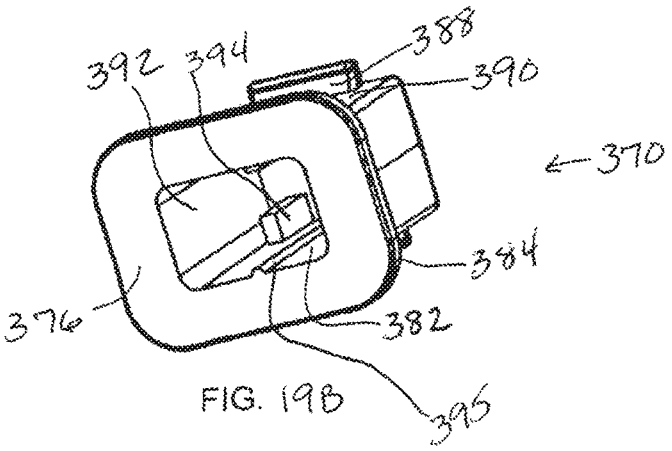
FIG. 19B depicts a front and side perspective view of an embodiment of a plug housing provided for a two-conductor plug assembly according to an embodiment of the disclosure.

Referring to FIGS. 19A and 19B, the plug housing 370 is depicted according to an embodiment of the disclosure. In the depicted embodiment, the plug housing 370 is a hollow cuboid having an open end 376, a closed end 378 having a feedthrough aperture 380, and an inner cavity 382. In an embodiment, open end 376 can be flared at the edges so that edges 384 extend beyond the walls of the rectangular cube shape to provide a flange 386. Open end 376 is formed to correspond to the shape of the front wall 397 of the plug insert 372 (see FIG. 20A). In some embodiments, the inner surface 392 of plug housing 370 is formed to provide a spline 395 longitudinally from the front wall 397 towards the closed end 378. Plug housing 370 is further provided with a plurality of protrusions 388 extending from the plug housing 370 outer surface 390 nearer the closed end 378 of plug housing 370. Plug housing 370 can be a single formed piece of material or a plurality of formed pieces molded together and can be manufactured of a plastic or plastic composite. The inner surface 392 of the plug housing 370 can be provided with projections 394 shaped and sized to allow for the support of the plug insert 372.

Figure 20A:
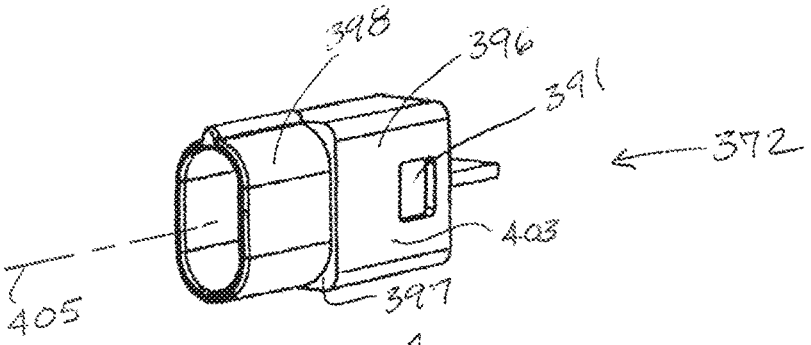
FIG. 20A depicts a perspective view of the top and front of an embodiment of a plug insert provided as part of a two-conductor plug assembly according to an embodiment of the disclosure.
Figure 20B:
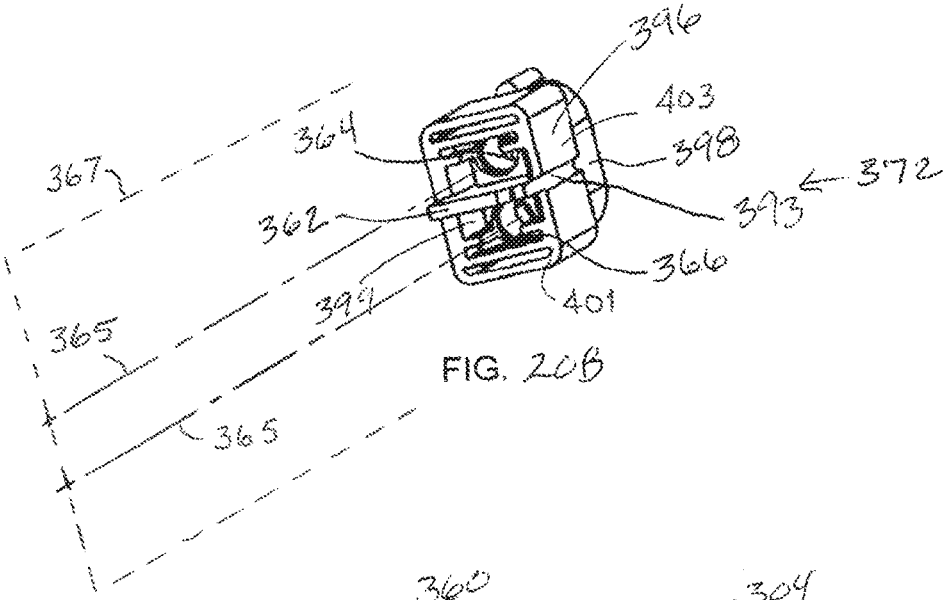
FIG. 20B depicts the rear and bottom view of an embodiment of a plug insert provided as part of a two-conductor plug assembly according to an embodiment of the disclosure.

Referring to FIGS. 20A and 20B, the plug insert 372 is depicted according to an embodiment of the disclosure. The plug insert 372 includes a plug body 396 having a front wall 397 and a rearward face 401 separated by an outer peripheral surface 403, the plug body 396 defining a rearward cavity 399. The front wall defines a pair of terminal apertures 364, each aperture 364 defining and being concentric about a terminal aperture axis 365 that is perpendicular to the front wall 397. The terminal aperture axes 365 are parallel and define a plane 367. A tubular projection 398 extends forward of the front wall 397 and surrounds the terminal apertures 364, the tubular projection 398 defining and being centered about a tubular projection axis 405 that is perpendicular to the front wall 397.

In some embodiments, a plug partition wall 362 extends rearward from the rearward cavity 399. The plug body 396 may further define catch plate slots 366 that extend rearwardly and are accessible from the rearward face 401. The plug body 396 of plug insert 372 can also be formed so that a groove 393 is provided along the plug body 396 length, dimensioned to matingly engage with spline 395 of plug housing 370 upon insertion of plug insert 372 into plug housing 370.

In some embodiments, plug insert 372 can be formed so that an aperture 391 is formed within plug body 396, where aperture 391 matingly engages with a corresponding protrusion within plug housing 370 to lock plug insert 372 within plug housing 370. Plug insert 372 can be manufactured of a plastic or plastic composite and, as discussed above, front wall 397 of plug insert 372 is sized and shaped to correspond to the open end 376 of plug housing 370.

As described above in relation to four-conductor plug assemblies 106*a*, 106*b*, the plug insert 372 of two-conductor plug assembly 106*c* is configured to accept male electrical terminals 160, with attached wires 112. Male barrels 168 are disposed within terminal apertures 364 so that catch plates 166 are fully inserted and locked in the catch plate slots 366. A plug partition wall 362 is formed to create a physical barrier between each of the inserted male electrical terminals 160 providing the benefit of isolating electrically conductive components from each other to prevent arcing across air gaps.

In assembling plug 106*c*, plug insert 372, wire end first, is inserted into plug housing 370 so that plug partition wall 362 is disposed in aperture 380 such that squeezing pressure is imparted on wall 362 and wiring 112 thus providing the benefit of further securing the wiring to the plug assembly 106*c* and providing a securing force that enables the wiring to comply with the UL flex test.

Receptacle assemblies 110 are disclosed that are configured to matingly engage with plug assembly 106. Receptacle assembly 110 is disposed on one end of a light string 100, 101, 116, opposite the end on which the plug assembly 106 is disposed.

Referring to FIGS. 21A through 23C, a four-conductor receptacle assembly 110*a* is depicted according to an embodiment of the disclosure. The receptacle assembly 110*a* includes a receptacle housing 402, a receptacle insert 404, and a plurality of female electrical terminals 190, and is configured to correspond with the four-conductor plug assembly 106*a* as described above. As illustrated in FIGS. 22A and 22B, receptacle housing 402 is generally a hollow cuboid having an open end 410, a closed end 412 having a feedthrough aperture 414, and a receptacle housing cavity 416. In an embodiment, open end 410 can be flared at the edges so that edges 418 extend beyond the walls of the rectangular cube shape to provide a housing flange 420, dimensioned to correspond with the housing flange 220 of the plug assembly 106*a*. Open end 410 is formed to correspond to the shape of the front face 440 of the receptacle insert 404 (see FIGS. 23A). In some embodiments, receptacle housing 402 inner surface 426 is formed so that a spline 408 is disposed from the open end 410 to the closed end 412. Receptacle housing 402 may be further provided with a plurality of protrusions 422 extending from the outer surface 424 of receptacle housing 402 nearer the closed end 412 of receptacle housing 402. Protrusions 422 provide the user of the receptacle assembly 110*a* a gripping and pulling/pushing mechanism when attaching or detaching the plug 106*a* and receptacle assembly 110*a*. Receptacle housing 402 can be a single formed piece of material or a plurality of formed pieces molded together and can be manufactured of a plastic or plastic composite. The inner surface 426 of the receptacle housing 402 can be provided with projections or receptacle spacers 428 shaped and sized to provide registration and support of the receptacle insert 404.

Figure 31:
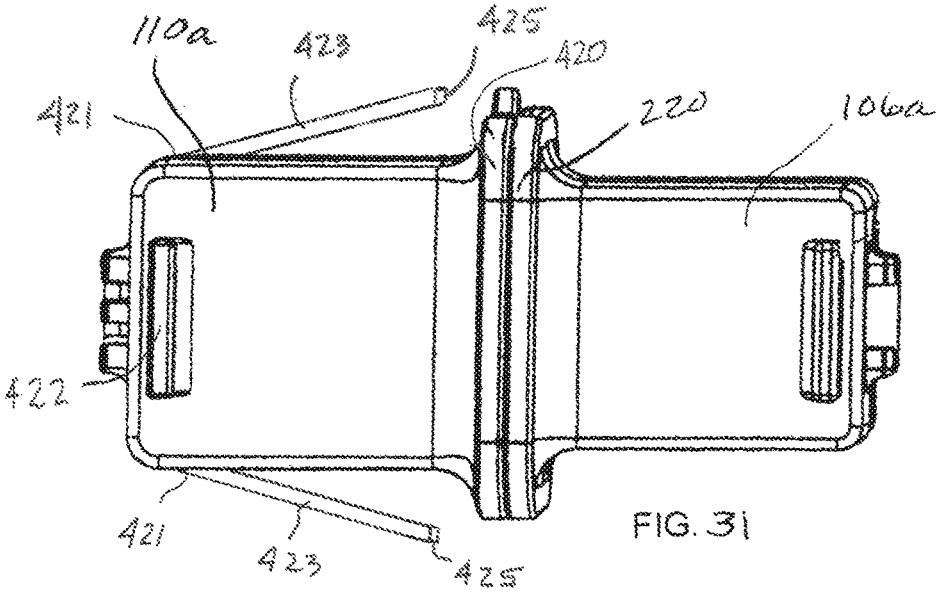
FIG. 31 depicts an embodiment of a plug and a receptacle when mated according to an embodiment of the disclosure.

The receptacle housing 402 is also depicted as having a pair of locking wings 423, disposed on opposing sides of the receptacle housing 402 (also depicted at FIG. 31). Each locking wing 423 includes a fixed end 421 proximate the closed end 412, and a free end 425 proximate the open end 410. In some embodiments, the locking wings 423 angle away from the receptacle housing 402 from the fixed end 421 to the free end 425, so that the free end 425 extends radially beyond the housing flange 420.

Functionally, the locking wings 423 provide clip in mechanism, so that the receptacle housing 402 may be secured within a mounting aperture (not depicted), for example, a mounting aperture defined on the trunk of a decorative tree. The mounting aperture may be oversized relative to the dimensions defined by the side wall(s), but undersized relative to the maximum dimension defined between locking wings 423. When the receptacle housing 402 is inserted into the mounting aperture, the locking wings 423 retract inwards, toward the receptacle housing 402, until the locking wings 423 pass through the mounting aperture, at which point the wings 704 snap outward, away from the receptacle housing 402, thus securing the receptacle housing 402 within the mounting aperture. The mounting aperture may be undersized relative to the radial periphery of the housing flange 420, to cover the mounting aperture. Alternatively or in addition, locking wings are contemplated that extend from other housing assemblies depicted herein (e.g., plug housing 202, plug housing 302, or plug housing 370).

Receptacle insert 404 (FIGS. 23A-23C) includes a receptacle body 444 having a forward face 440 and a rearward face 439 separated by an outer peripheral surface 453. The receptacle body 444 includes an internal bulkhead 443 that separates at least one forward cavity 445 from a rearward cavity 446. Rodular projections 442 extend forward of the internal bulkhead 443 into a respective forward cavity 445, each rodular projection 442 being centered about a first rodular projection axis 437 and defining a pair of terminal bores 450 that extend through the internal bulkhead 443. Each of the terminal bores 450 are concentric about a respective terminal bore axis 447 that is perpendicular to the internal bulkhead 443. Each rodular projection 442 includes an outer surface 451 that cooperates with an inner surface 455 of the respective forward cavity 445 to define an annular gap 457. In the depicted embodiment, the rodular projections 442 are recessed relative to the forward face 440. The terminal bore axes 447 of the terminal bores 450 are parallel to each other, defining a plane 449. Receptacle partition walls 448*a* and 448*b* extend from the internal bulkhead 443 and rearward of the rearward cavity 446. Catch plate slots 452 are also defined rearward of the internal bulkhead 443.

In some embodiments, a groove 454 is defined on the outer peripheral surface 453 of the receptacle body 444 where groove 454 is configured to cooperate with the spline 408 of the receptacle housing 402 such that receptacle housing 402 and receptacle insert 404 can only be assembled in one orientation. Receptacle insert 404 can be manufactured of a plastic or plastic composite and, as discussed above, the forward face 440 of the receptacle insert 404 may be sized and shaped to correspond to the open end 410 of receptacle housing 402.

Female electrical terminal apertures 450 are sized to accept female barrels 198 (FIG. 23C), where the female electrical terminals 190 are provided with attached wiring 112. Tension wings 199 press against walls of female electrical terminal apertures 450 providing additional holding force to assist in firmly retaining female electrical terminals 190 within apertures 450. Catch plate slots 452 are sized to accept catch plate 196, the catch plate 196 locking into place when inserted into the slot 452.

Within the rearward cavity 446 of the receptacle insert 404, receptacle partition walls 448*a* and 448*b* are formed to create a physical barrier between each of the inserted female electrical terminals 190. The receptacle partition walls 448*a* and 448*b* extend perpendicular from the back of the forward face 440 and from the sides of the receptacle body 444 to generally form a cross-shaped ("+") cross section. The receptacle partition walls 448*a* and 448*b* can be of various heights and configurations. Receptacle partition walls 448*a* and 448*b* create partitions providing the additional benefit of isolating electrically conductive components from each other to prevent arcing across air gaps. When receptacle insert 404 is disposed within receptacle housing 402, the top of receptacle partition walls 448*a* and 448*b* correspond to and registers within the feedthrough aperture 414 of the receptacle housing 402.

Figure 21A:
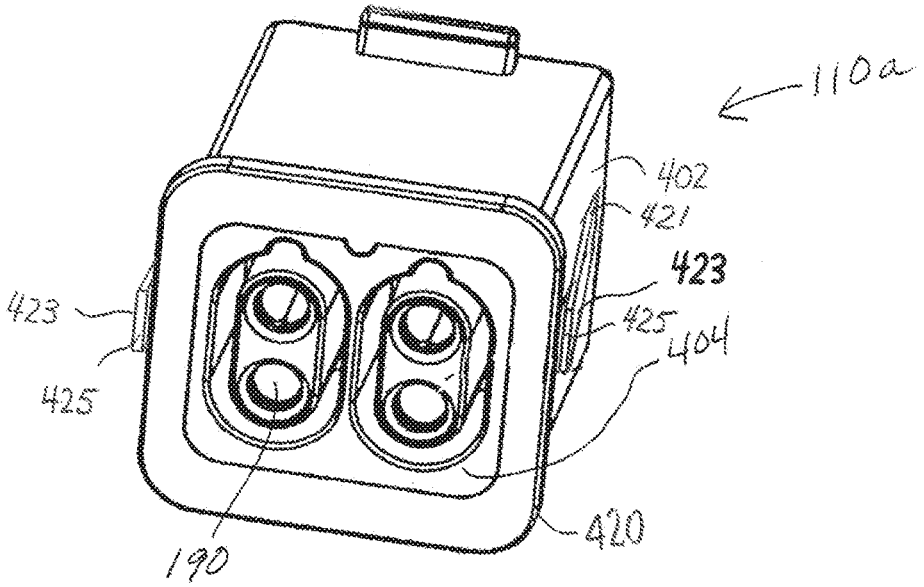
FIG. 21A depicts a perspective view of the top and front an embodiment of a four-conductor receptacle according to an embodiment of the disclosure.
Figure 21B:
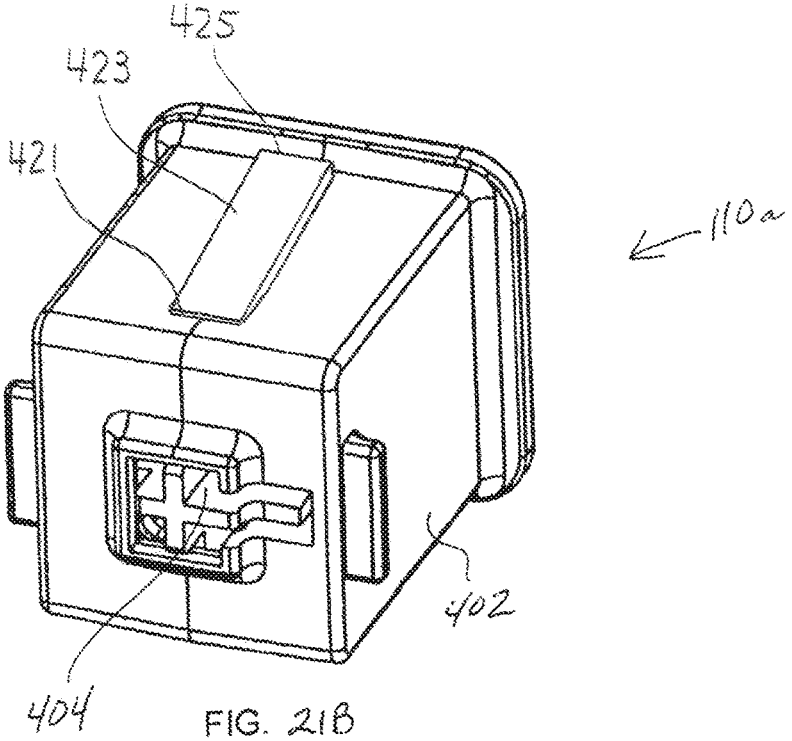
FIG. 21B depicts a perspective view of the rear and side of an embodiment of a four-conductor according to an embodiment of the disclosure.
Figure 22A:
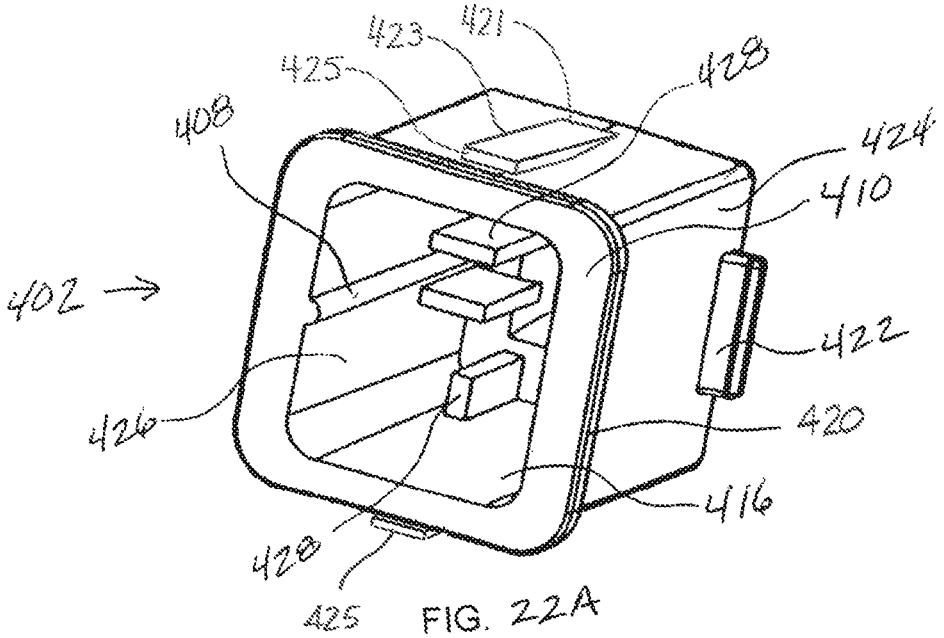
FIG. 22A depicts a perspective view of the top and front of an embodiment of a four-conductor housing according to an embodiment of the disclosure.
Figure 22B:
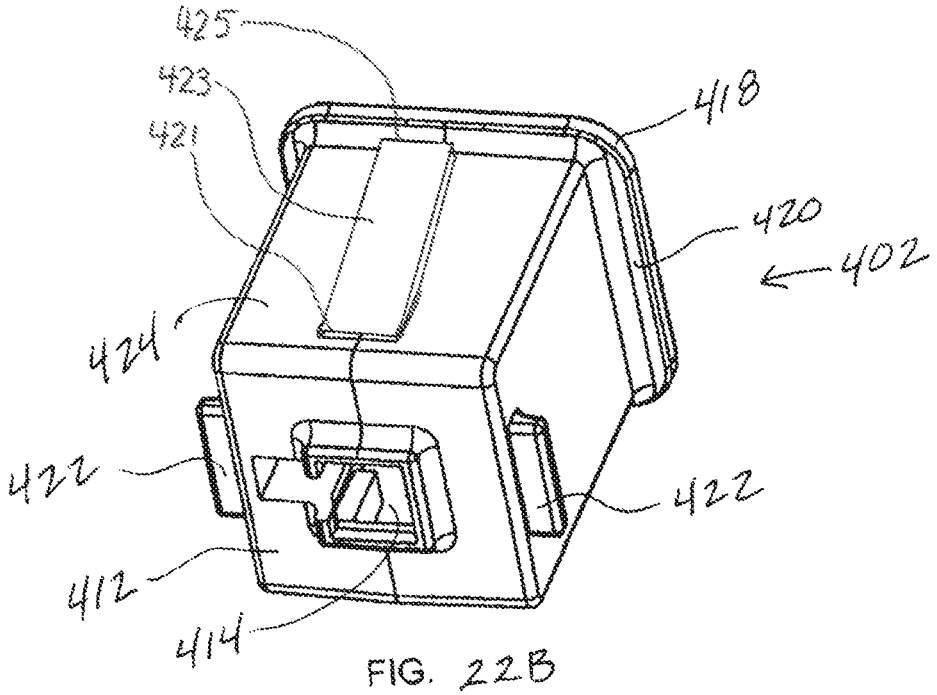
FIG. 22B depicts a perspective view of the side and rear of an embodiment of a four-conductor housing according to an embodiment of the disclosure.

In assembling receptacle assembly 110*a*, four female electrical terminals 190, with attached wires 112, are disposed within female electrical terminal apertures 450 so that catch plates 196 are fully inserted and locked in the catch plate slots 452. This assembly, wire end first, is inserted in receptacle housing cavity 416 open end 410 so that receptacle partition walls 448*a* and 448*b* extend into the feedthrough aperture 414 of the receptacle housing 402 to provide the receptacle assembly 110*a* as shown in the embodiment of FIGS. 21A and 21B (figures do not illustrate wiring).

The receptacle spacers 428 of the receptacle housing 402 are dimensioned to provide separation between the receptacle body 444 of the receptacle insert 404 and the closed end 412 of receptacle housing 402 when the receptacle insert 404 is registered against the receptacle spacers 428. Also, the receptacle spacers 428 may be dimensioned so that when the receptacle insert 404 is registered against the receptacle spacers 428, the front face 440 of the receptacle insert 404 is essentially flush with the open end 410 of the receptacle housing 402.

Configuring the receptacle assembly 110*a* as a 3-conductor receptacle is also contemplated. Such configuration is attainable by merely leaving one of the terminal bores 450 of the receptacle insert 404 unoccupied, i.e., without a female electrical terminal 190. The corresponding, opposing terminal aperture 250 of the plug assembly 106*a* may also remain unoccupied.

Referring to FIGS. 24 through 27, a four-conductor receptacle assembly 110*b* is depicted according to an embodiment of the disclosure. The receptacle assembly 110*b* includes a receptacle housing 502, a receptacle insert 504, and a plurality of female electrical terminals 190, and is configured to correspond with the four-conductor plug assembly 106*b* as described above. As illustrated in FIGS. 25A and 25B, receptacle housing 502 may be configured as a hollow cuboid having an open end 510, a closed end 512 having a feedthrough aperture 514, and a receptacle housing cavity 516. Receptacle housing 502 is further provided with a terminal aperture 530. Open end 510 is formed to correspond to the shape of the front wall 540 of the receptacle insert 504. In some embodiments, receptacle housing 502 inner surface 526 is formed so that a spline 508 is disposed from the open end 510 to the closed end 512. The inner surface 526 of the receptacle housing 502 can be provided with projections or receptacle spacers 528 shaped and sized to allow for the support of the receptacle insert 504. The inner surface 526 of the receptacle housing 502 can further be provided with a detent 532 or projection. Receptacle housing 502 can be a single formed piece of material or a plurality of formed pieces molded together and can be manufactured of a plastic or plastic composite.

Receptacle insert 504 (FIGS. 26A-26D) includes a receptacle body 544 having a forward face 540 and a rearward face 541 separated by an outer peripheral surface 553. The receptacle body 544 includes an internal bulkhead 543 that separates at least one forward cavity 545 from a rearward cavity 546. Rodular projections 542 extend forward of the internal bulkhead 543 into the at least one forward cavity 545, each rodular projection 542 being centered about a respective rodular projection axis 537 and defining a pair of terminal bores 550 that extend through the internal bulkhead 543, each of the terminal bores 550 being concentric about a respective terminal bore axis 547 that is perpendicular to the internal bulkhead 543. Each rodular projection 542 includes an outer surface 551 that cooperates with an inner surface 555 of the respective forward cavity 545 to define an annular gap 557. The rodular projections 542 may be recessed relative to the forward face 540. The terminal bore axes 547 of the terminal bores 550 are parallel to each other, defining a plane 549. Receptacle partition walls 548*a* and 548*b* extend from the internal bulkhead 543 and rearward of the rearward cavity 546. Catch plate slots 552 are also defined rearward of the internal bulkhead 543.

The female electrical terminals 190 are inserted into the receptacle insert 504 (FIG. 27). Female electrical terminal apertures 550 are sized to accept female barrels 198, where the female electrical terminals 190 are provided with attached wiring 112. Tension wings 199 press against walls of female electrical terminal apertures 550 providing additional holding force to assist in firmly retaining female electrical terminals 190 within apertures 550. Catch plate slots 552 are sized to accept catch plate 196, the catch plate 196 locking into place when inserted into the slot 552.

Within the rearward cavity 546 of receptacle insert 504, receptacle partition walls 548*a* and 548*b* are formed to create a physical barrier between each of the inserted female electrical terminals 190. The walls 548 extend perpendicular from the back of the forward face 540 and from the sides of the receptacle body 544 to generally form a cross-shaped cross section. The receptacle partition walls 548*a* and 548*b* can be of various heights and configurations. Receptacle partition walls 548*a* and 548*b* create partitions providing the additional benefit of isolating electrically conductive components from each other to prevent arcing across air gaps. When receptacle insert 504 is disposed within receptacle housing 502, the top of receptacle partition walls 548*a* and 548*b* correspond to and registers within the feedthrough aperture 514 of the receptacle housing 502.

Figure 24:
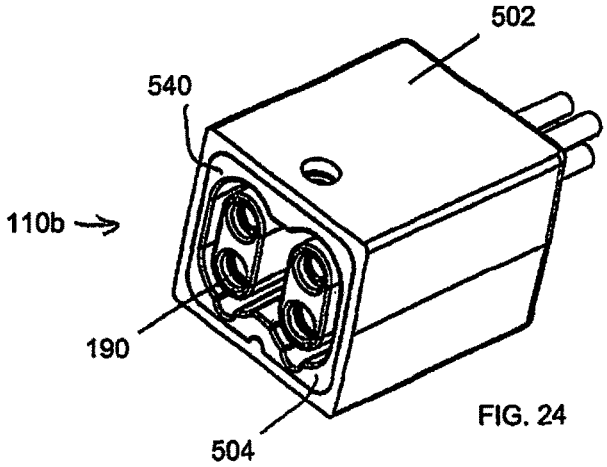
FIG. 24 depicts another embodiment of a four-conductor receptacle as provided on a light string according to an embodiment of the disclosure.
Figure 25A:
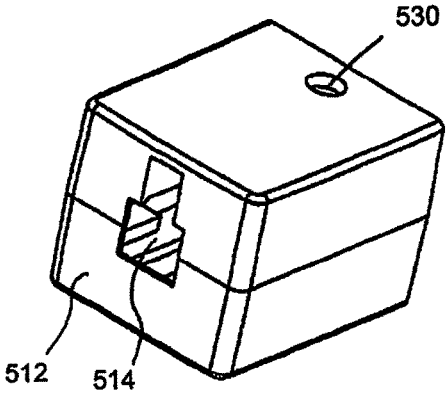
FIG. 25A depicts a rear perspective view of another embodiment of a four-conductor receptacle housing according to an embodiment of the disclosure.
Figure 25B:
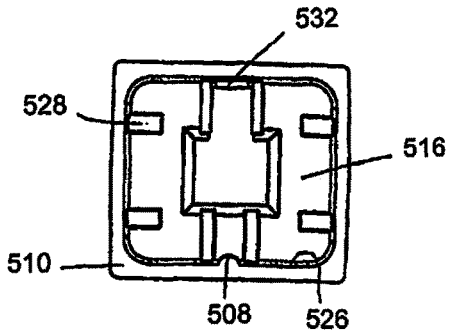
FIG. 25B depicts a front perspective view of another embodiment of a four-conductor receptacle housing according to an embodiment of the disclosure.
Figure 26A:
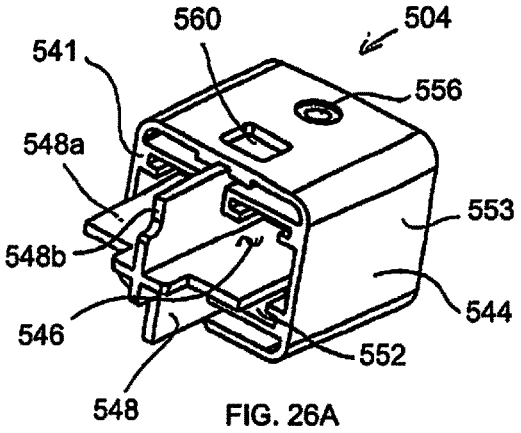
FIG. 26A depicts a perspective view of the top, side and rear of another embodiment of a receptacle insert provided as part of a four-conductor receptacle according to an embodiment of the disclosure.
Figure 26B:
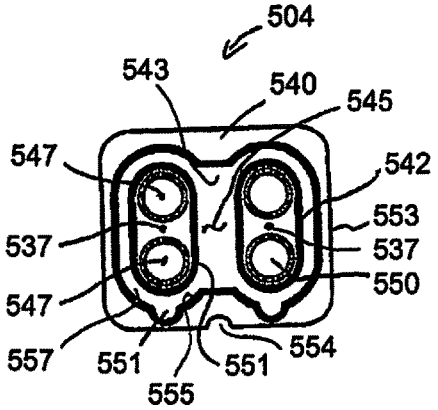
FIG. 26B depicts the front view of another embodiment of a receptacle insert showing tubular projections provided as part of a four-conductor receptacle according to an embodiment of the disclosure.
Figure 26C:
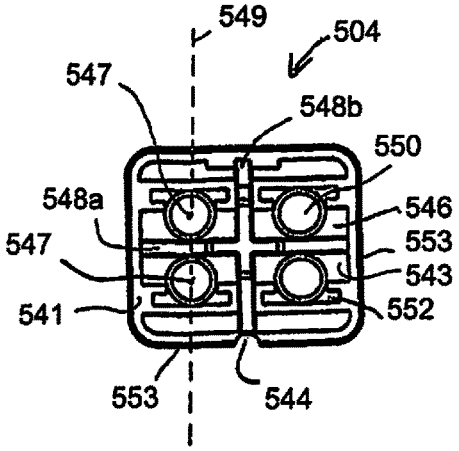
FIG. 26C depicts the rear view of another embodiment of a receptacle insert showing terminal bores and receptacle partition walls provided as part of a four-conductor receptacle according to an embodiment of the disclosure.
Figure 26D:
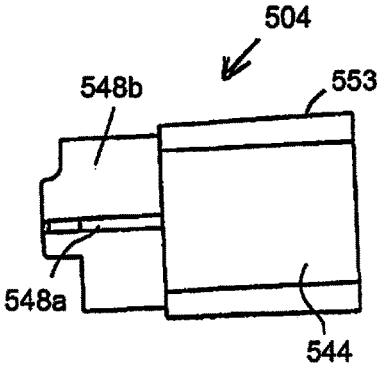
FIG. 26D depicts the side view of another embodiment of a receptacle insert showing the receptacle partition walls and body provided as part of a four-conductor receptacle according to an embodiment of the disclosure.
Figure 28:
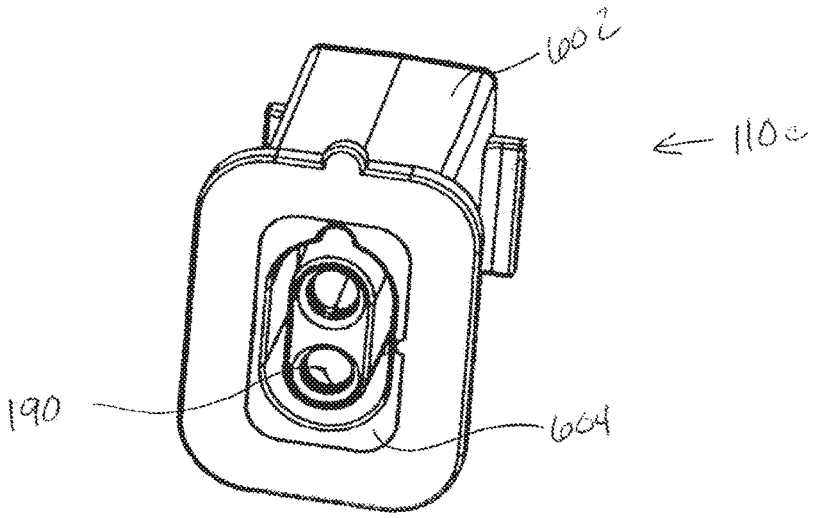
FIG. 28 depicts a perspective view of the side and front an embodiment of a two-conductor receptacle according to an embodiment of the disclosure.
Figure 29A:
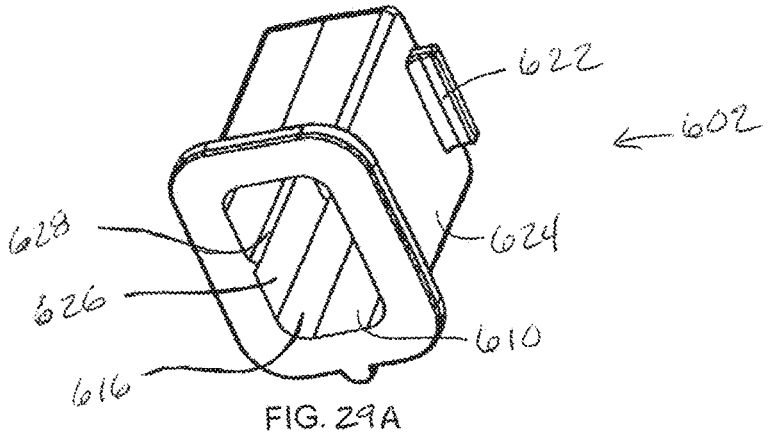
FIG. 29A depicts a perspective view of the top and front of an embodiment of a two-conductor receptacle housing according to an embodiment of the disclosure.
Figure 29B:
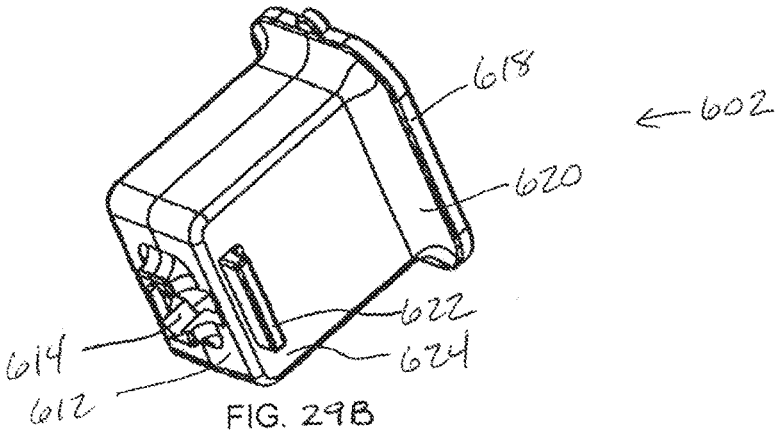
FIG. 29B depicts a perspective view of the side and rear of an embodiment of a two-conductor receptacle housing according to an embodiment of the disclosure.

In assembling receptacle assembly 110*b*, four female electrical terminals 190, with attached wires 112, are disposed within female electrical terminal apertures 550 so that catch plates 196 are fully inserted and locked in the catch plate slots 552. This assembly, wire end first, is inserted in receptacle housing 502 cavity 516 open end 510 so that receptacle partition walls 548*a* and 548*b* extend into the feedthrough aperture 514 of the receptacle housing 502 to provide the receptacle assembly 110*b* as shown in the embodiment of FIG. 24. Upon proper insertion, detent 532 matingly engages with locking recess 560 thus preventing separation of the receptacle insert 504 from the receptacle housing 502.

The receptacle spacers 528 of the receptacle housing 502 are dimensioned to provide separation between the receptacle body 544 of the receptacle insert 504 and the closed end 512 of receptacle housing 502 when the receptacle insert 504 is registered against the receptacle spacers 528. Also, the receptacle spacers 528 may be dimensioned so that when the receptacle insert 504 is registered against the receptacle spacers 528, the front face 540 of the receptacle insert 504 is essentially flush with the open end 510 of the receptacle housing 502.

Referring to FIGS. 28 through 30B, a two-conductor receptacle assembly 110*c* is depicted according to an embodiment of the disclosure. Receptacle assembly 110*c* is disposed on one end of a light string 100, 101, 116, opposite the end on which plug 106*c* is disposed, and includes a receptacle housing 602, a receptacle insert 604, and a plurality of female electrical terminals 190. The receptacle assembly 110*c* configured to correspond with the two-conductor plug assembly 106*c* as described above. The two-conductor receptacle assembly 110*c*, as shown, corresponds most closely to the embodiment of the four-conductor receptacle assembly 110*a*, as shown in FIG. 21A. However, a two-terminal receptacle that corresponds with the design aspects of the four-conductor receptacle assembly 110*b* as disclosed above is also contemplated.

In the depicted embodiment, the receptacle housing 602 (FIGS. 29A and 29B) is generally a hollow cuboid having an open end 610, a closed end 612 having a feedthrough aperture 614, and a receptacle housing cavity 616. In an embodiment, open end 610 can be flared at the edges so that edges 618 extend beyond the walls of the rectangular cube shape to provide a flange 620. Open end 610 is formed to correspond to the shape of the front face 640 of the receptacle insert 604. Receptacle housing 602 is further provided with a plurality of protrusions 622 extending from the receptacle housing 602 outer surface 624 nearer the closed end 612 of receptacle housing 602. These protrusions 622 provide the user of the receptacle assembly 110*c* a gripping and pulling/pushing mechanism when attaching or detaching the plug 106*c* and receptacle assembly 110*c*. The inner surface 626 of the receptacle housing 602 can be provided with a spline 628. Receptacle housing 602 can be a single formed piece of material or a plurality of formed pieces molded together and can be manufactured of a plastic or plastic composite.

Receptacle insert 604 (FIGS. 30A and 30B) includes a receptacle body 644 a forward face 640 and a rearward face 639 separated by an outer peripheral surface 653. The receptacle body 644 includes an internal bulkhead 643 that separates at least one forward cavity 645 from a rearward cavity 646. Rodular projections 642 extend forward of the internal bulkhead 643 into the at least one forward cavity 645, each rodular projection 642 being centered about a rodular projection axis 637 and defining a pair of terminal bores 650 that extend through the internal bulkhead 643, each of the terminal bores 650 being concentric about a respective terminal bore axis 647 that is perpendicular to the internal bulkhead 643. Each rodular projection 642 includes an outer surface 651 that cooperates with an inner surface 655 of the respective forward cavity 645 to define an annular gap 657. The rodular projections 642 may be recessed relative to the forward face 640. The terminal bore axes 647 of the terminal bores 650 are parallel to each other, defining a plane 649. Receptacle partition wall 648 extends from the internal bulkhead 643 and rearward of the rearward cavity 646. Catch plate slots 652 are also defined rearward of the internal bulkhead 643.

As described above in relation to four-conductor receptacles 110*a*, 110*b*, receptacle insert 604 of two-conductor receptacle assembly 110*c* is configured to accept female electrical terminals 190, with attached wires 112 (akin to the depiction of FIG. 23C). Female barrels 198 are disposed within female electrical terminal apertures 650 so that catch plates 166 are fully inserted and locked in the catch plate slots 652 and tension wings 199 are disposed against female electrical terminal aperture 650 walls to provide additional retaining forces. A receptacle partition wall 648 is formed to create a physical barrier between each of the inserted female electrical terminals 190 providing the benefit of isolating electrically conductive components from each other to prevent arcing across air gaps.

In assembling receptacle assembly 110*c*, receptacle insert 604, wire end first, is inserted into receptacle housing 602 so that receptacle partition wall 648 is disposed in aperture 614 such that squeezing pressure is imparted on wall 648 and wiring 112 thus providing the benefit of further securing the wiring to the receptacle assembly 110*c* and providing a securing force that enables the wiring to comply with the UL flex test. In some embodiments, receptacle housing 602 is provided with a detent (not depicted) on inner surface 626, where detent interacts with locking recess 660 of receptacle insert 604 so that when properly seated in receptacle housing 602, detent matingly engages with locking recess 660 preventing disassociation of receptacle insert 604 and receptacle housing 602.

Referring to FIG. 31, the coupling of plug assembly 106*a* with receptacle assembly 110*a* is depicted according to an embodiment of the disclosure (wiring 112 omitted). The tubular projections 242 of the plug assembly 106*a* are configured for insertion into the respective annular gaps 457 of the receptacle assembly 110*a*. The tubular projection 242 is configured to receive the rodular projection(s) 442 of the plug assembly 106*a*, and the pair of male electrical terminals 160 are configured for insertion into the pair of female electrical terminals 190 of the receptacle assembly 110*a*.

Engaging the plug 106*a* and receptacle assembly 110*a* in this manner allows the user to connect light strings 100, 101 116 end-to-end. Plug 106*a* and receptacle assembly 110*a* are configured so that the tubular projections 242 slidingly encompass the rodular projections, thereby resulting in simultaneous insertion of male electrical terminals 160 into female electrical terminals 190. Proper orientation of plug assembly 106*a* and receptacle assembly 110*a* is provided by matingly engaging spline 243 of tubular projection 242 with groove 441 of the forward face 440 of the receptacle insert 404. When engaged, male electrical terminals 160 are in direct contact with female electrical terminals 190 thereby making a reliable electrical connection between plug 106*a* and receptacle assembly 110*a*. In an embodiment, the flange 220 of plug 106*a* and the housing flange 420 of receptacle assembly 110*a* are configured to have the same outer edge profile so that the outer edges are even with each other. In another embodiment, plug 106*a* flange 220 and the housing flange 420 of the receptacle assembly 110*a* are configured to have the differing outer edge profiles so that the outer edges are offset.

While the depicted embodiment presents the spline 243 as being formed on the outer surface 651 of the rodular projection 642, and the groove 256 as being defined on the inner surface 655 of the forward cavity 645, those of skill in the relevant arts will recognize that this arrangement can be reversed to the same effect. That is, the spline may project inward from the inner surface 655 of the forward cavity 645 into a groove defined on an outer surface 651 of the rodular projection 642.

Also, it is apparent that the method of engagement for the two-conductor plug assembly 106*c* and the two-conductor receptacle assembly 110*c* would be similar or identical to that shown in FIG. 31 for the four-conductor plug assembly 106*a* and the four-conductor receptacle assembly 110*a*. It is also contemplated that the two-conductor plug assembly 106*c* may be configured for use with the four-conductor receptacle assembly 110*a*. That is, in some embodiments, two of the two-conductor plug assemblies 106*c* could be inserted side by side into the four-conductor receptacle assembly 110*a*, for example to provide branching of the respective light strings.

Figure 32:
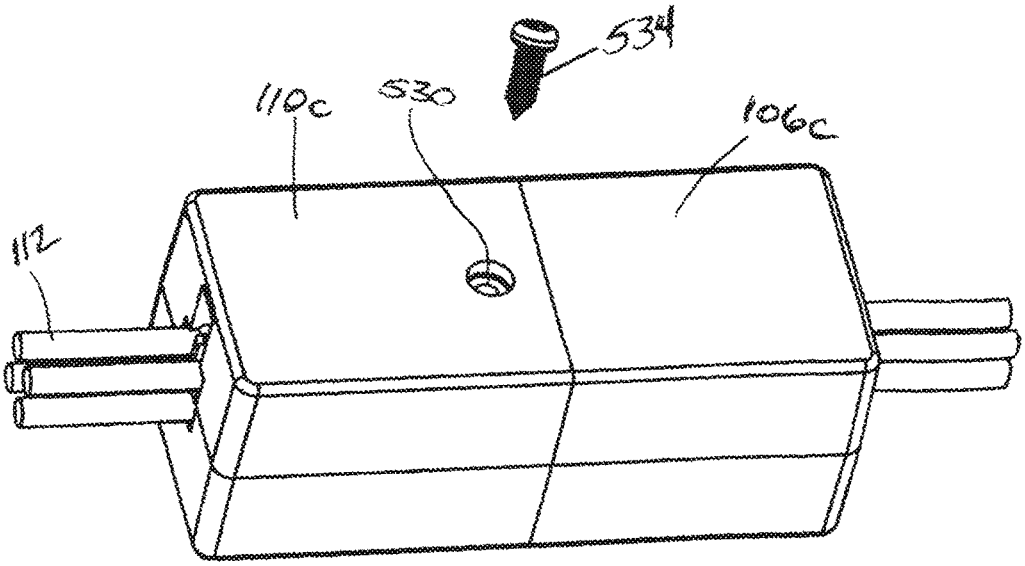
FIG. 32 depicts another embodiment of a plug and a receptacle mated together according to an embodiment of the disclosure.

Referring to FIG. 32, the coupling of plug assembly 106*c* with receptacle assembly 110*c* is depicted according to an embodiment of the disclosure. Engaging the plug 106*c* and receptacle assembly 110*c* in this manner allows the user to connect light strings 100, 101, 116 end-to-end. Plug 106*c* and receptacle assembly 110*c* are configured so that the tubular projections 342 slidingly encompass the rodular projections 542, thereby resulting in simultaneous insertion of male electrical terminals 160 into female electrical terminals 190. Proper orientation of plug assembly 106*c* and receptacle assembly 110*c* is provided by matingly engaging spline 354 of tubular projection 342 with groove 551 of receptacle insert 504 forward face 540. When properly seated, user can insert a fastener 534 into fastener aperture 530 and engage the fastener 534 with a tap hole 358 on retaining bridge 356 thereby locking plug 106*c* to receptacle assembly 110*c*. When engaged, male electrical terminals 160 are in direct contact with female electrical terminals 190 thereby making a reliable electrical connection between plug 106*c* and receptacle assembly 110*c*. In an embodiment, plug 106*c* and receptacle assembly 110*c* are configured to have the same outer edge profile so that the outer edges are even with each other.

Figure 33:
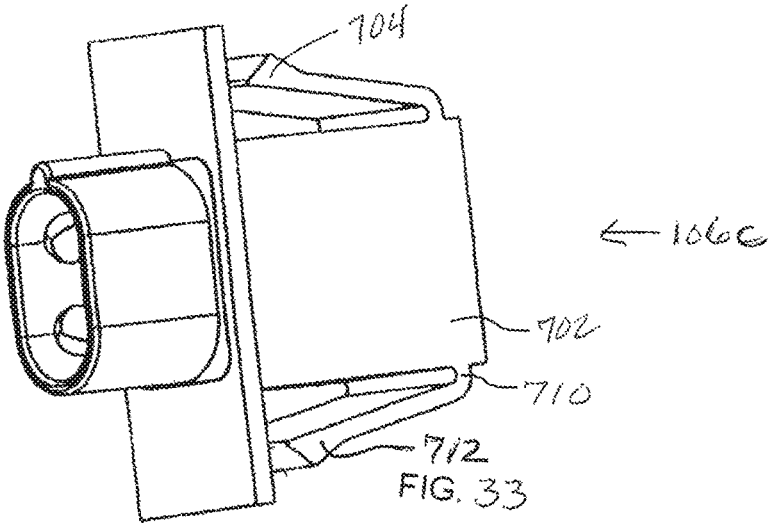
FIG. 33 depicts the front and top perspective view of an embodiment of a two-conductor plug assembly as provided on a light string wherein the two-conductor plug assembly is provided with a locking mechanism to lock the plug to the receptacle according to an embodiment of the disclosure.
Figure 34:
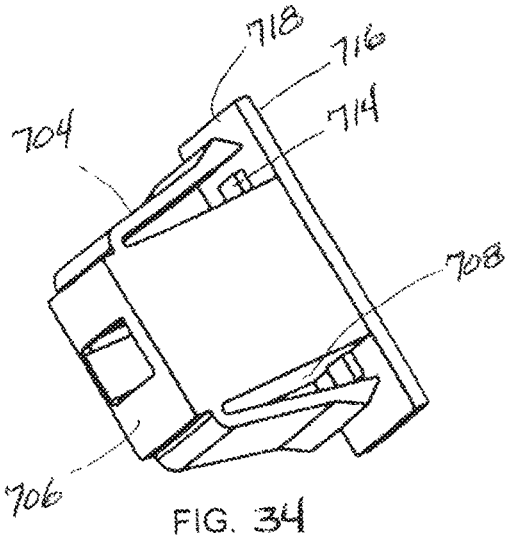
FIG. 34 depicts the rear perspective view of a two-conductor plug housing according to an embodiment of the disclosure.
Figure 35:
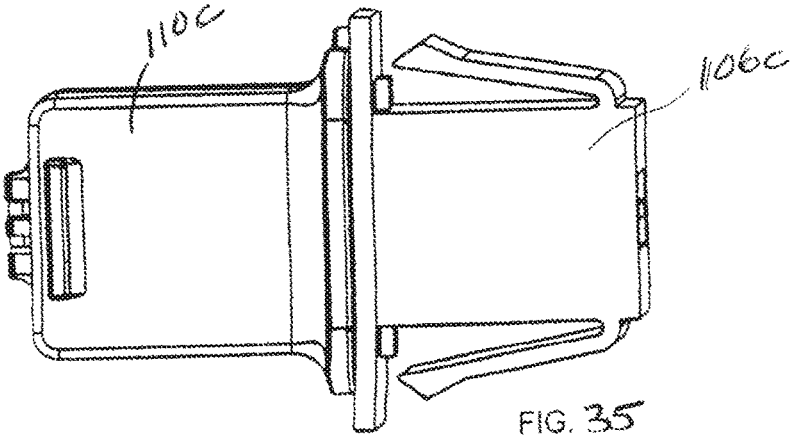
FIG. 35 depicts an embodiment of a plug having a locking mechanism and a receptacle when mated according to an embodiment of the disclosure.

Referring to FIGS. 33 and 34, a plug housing 702 with a locking arrangement 701 is depicted according to an embodiment of the disclosure. The locking arrangement 701 prevents the plug (e.g., plug 106*c*, as depicted) from disengaging from the receptacle assembly 110*c*. The locking arrangement 701 includes a pair of plug housing wings 704 integrated into the body of the plug housing 702 on the side wall(s) 708 nearer the closed end 706. Each wing 704 includes a fixed end 710 and a free end 712, the fixed end being connected to the plug housing 702 proximate the closed end 706. Movably attached to the plug housing 702 are a pair of retractable tabs 714 positioned behind a back 718 of a flange 716 and extending into the plug housing 702. Upon squeezing the plug housing wings 704 toward the plug housing 702, the plug housing wings 704 flex about the fixed ends 710 so that the free end 712 of the plug housing wings engage the retractable tabs 714, causing the retractable tabs 714 to retract into the plug housing 702 and engage, for example, a catch (not depicted), enabling the plug 106*c* to be disengaged from the receptacle assembly 110*c*. FIG. 35 illustrates plug 106*c* engaged with receptacle assembly 110*c* in the locked position. While not depicted, it is contemplated that similar, or identical, locking features can be incorporated on four-conductor plug assemblies 106*a*, 106*b*. The plug housing wing 704 are depicted as extending from the plug housing 702.

Figure 36A:
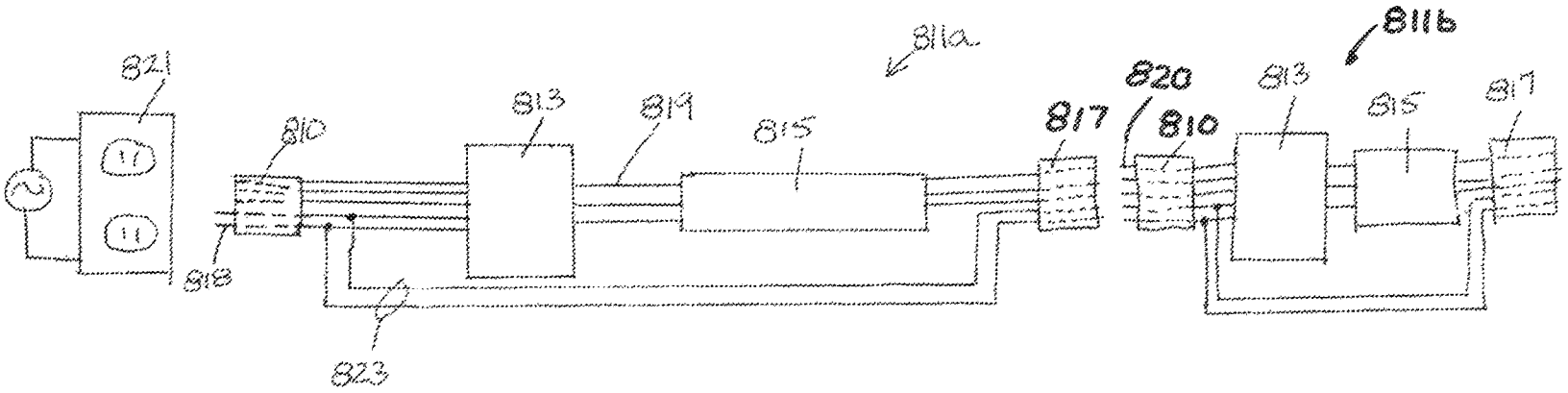
FIG. 36A is a schematic of a light string according to an embodiment of the disclosure.
Figure 36B:
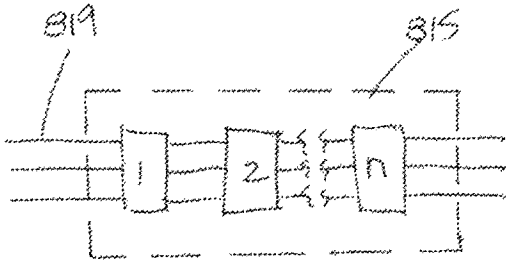
FIG. 36B is a schematic of the lights of the light string of FIG. 36A according to an embodiment of the disclosure.

Referring to FIGS. 36A and 36B, a light string 811*a*, 811*b* is depicted according to an embodiment of the disclosure. The light string 811*a*, 811*b* includes a plug assembly 810, a controller 813, an array of lights 815, a receptacle assembly 817, and a plurality of wires 819. Plug assembly 810 can be a five terminal plug assembly 810 where two terminals 818 are primary power terminals and connect to a power source, which can be a standard wall outlet 821 or a light string 811*a*, 811*b* receptacle assembly 817. A remaining three terminals 820 are able to be retracted into the plug assembly 810, as illustrated, allowing the plug assembly 810 to connect to a standard receptacle. The three terminals 820, when protracted (as shown in light string 811*b*) are generally low voltage terminals and can be connected to a data source, a power source, or a data/power source. It will be understood three terminals 820 may comprise more or fewer than three terminals. Light string 811*a*, 811*b* is comprised of a plug assembly 810 with five terminals 818, 820. Light string 811*a* plug assembly 810 is hard wired to a controller 813 that coordinates and powers subsequent light strings 811*b*. In an embodiment, controller 813 can comprise a transformer capable of converting AC power from the source to DC power. Data and power are fed from controller 813 to the array of lights 815. As detailed in FIG. 36B, lights 815 are wired in parallel to the plurality of wires 819. Shown is a three wire configuration but it is contemplated that more or less wires can be used. In one embodiment, one wire can carry negative DC, one wire can carry positive DC, and one wire can carry data. In another embodiment, the data can be overlaid on either the positive or the negative DC line.

Power is fed directly from plug assembly 810 to receptacle assembly 817 using two wires 823 bypassing controller 813 and lights 815 thus providing a direct connection from the power source to receptacle assembly 817. Receptacle assembly 817 is hard wired to lights 815 such that receptacle assembly 817 contains five wire feeds, three from lights 815 via wires 819 and two from plug assembly 810. Receptacle assembly 817 is provided with five ports, one per wire feed, for terminals 818, 820 of receiving plug assembly 810. As shown, light string 811*b* connects directly to light string 811*a*. Light string 811*b* plug assembly 810 terminals 820 are in the protracted position and are inserted into the receptacle assembly 817 so that data is transmitted through the plurality of light strings 811*a* or 811*b* via terminals 820. This data is then transmitted to the light string 811*b* controller 813 so that the lights 815 of light string 811*b* are coordinated with lights 815 of light string 811*a*.

Figure 37:
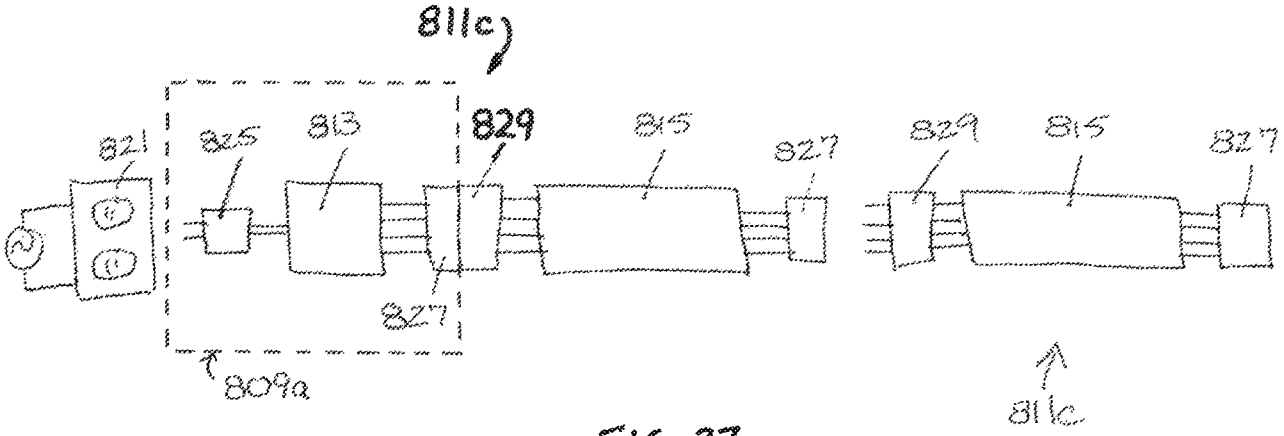
FIG. 37 is a schematic of multiple 4-wire light strings for connection to a controller module according to an embodiment of the disclosure.
Figure 38:
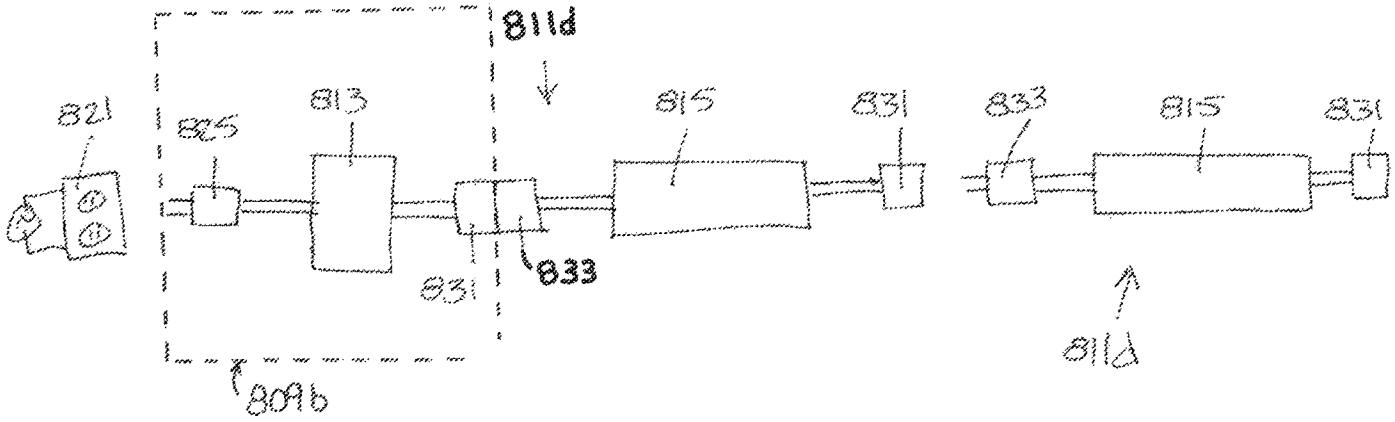
FIG. 38 is a schematic of multiple 2-wire light strings for connection to a controller module according to an embodiment of the disclosure.

Referring to FIGS. 37 and 38, controller modules 809*a* and 809*b* for modular connection to a plurality of light strings 811*c* and 811*d* are depicted according to embodiments of the disclosure.

The controller modules 809*a* and 809*b* include a controller 813, fed by a standard two blade electrical plug 825. Controller 813 output includes data and power, and is fed to a four port receptacle 827. A light string 811*c* comprising a four pin plug 829, a light array 815, and a four port receptacle 827 is mated via plug 829 to controller 813 string receptacle 827 so that controller 813 output controls and powers the light array 815. For the embodiment of FIG. 38, the controller 813 power and data output is fed to a two port receptacle 831. A light string 811*d* comprising a two pin plug 833, a light array 815, and a two port receptacle 831 is mated via plug 833 to controller 813 string receptacle 831 so that controller 813 output controls and powers the light array 815.

Functionally, the controller modules 809*a* and 809*b* enable modular assembly of a plurality of light strings 811*c*, 811*d* without permanently linking the controller 813 to one of the light strings. Accordingly, by not being hardwired, use of the controller module 809*a*, 809*b* is independent of the integrity of the first of the plurality of light strings 811*c*, 811*d*. That is, the first of the plurality of light strings 811*c*, 811*d* can be readily removed from the plurality of light string 811*c*, 811*d* in the event that the first string fails. The first of the plurality of light strings 811*c*, 811*d* can be replaced or the controller module 809*a*, 809*b* coupled to the next of the plurality of strings for continued operation. This reduces the expense of removing or replacing the first of the plurality of light strings 811*c* and 811*d*.

From a manufacturing standpoint, the controller module 809*a*, 809*b* may be manufactured exclusively at one facility, while the light strings 811*c*, 811*d* are manufactured exclusively at another facility. That is, there is no need for the facility manufacturing the controller module 809*a*, 809*b* to also manufacture the first of the plurality of light strings 811*c*, 811*d*. This may optimize the efficiency of the facilities manufacturing the controller module 809*a*, 809*b*, and the light strings 811*c*, 811*d*, which may require different manufacturing capabilities.

Figure 39A:
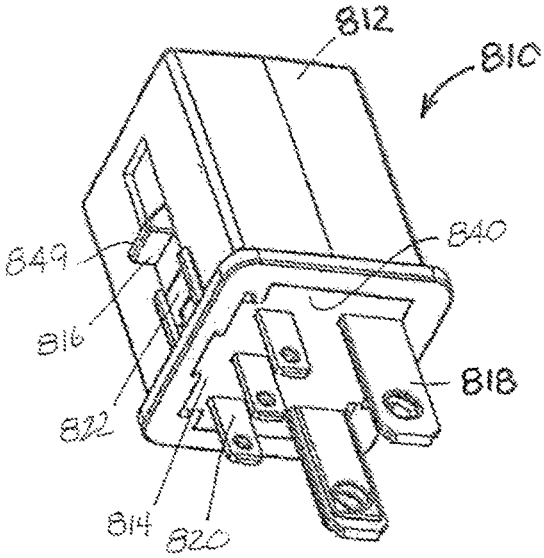
FIGS. 39A, 39B, and 39C are perspective views of a plug assembly having retractable low voltage conductors according to an embodiment of the disclosure.
Figure 39B:
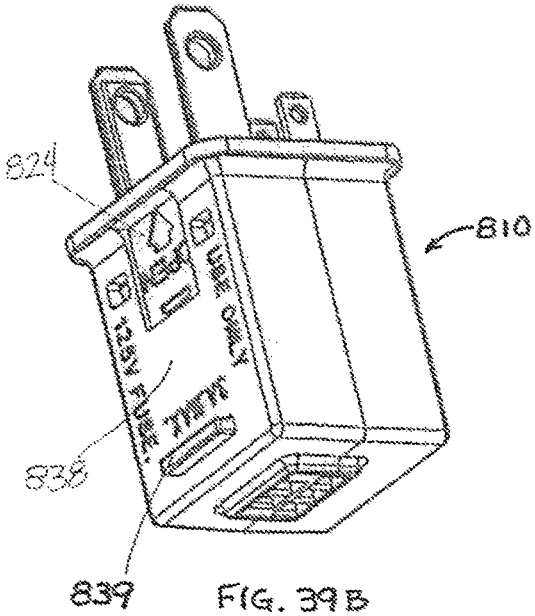
Figure 39C:
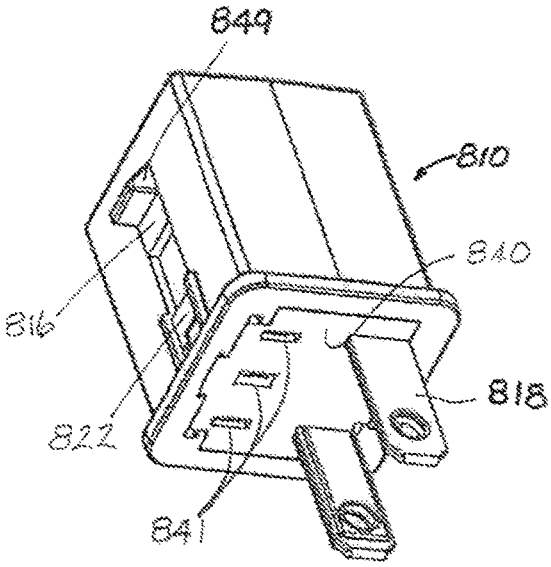
Figure 41:
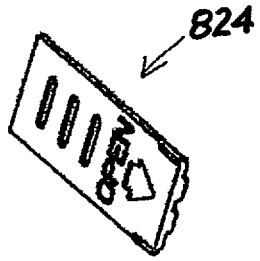
FIG. 41 is a perspective view of a fuse access door for the housing of the plug assembly of FIG. 39A according to an embodiment of the disclosure.
Figure 40:
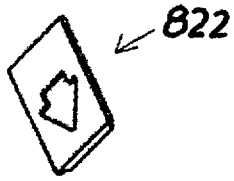
FIG. 40 is a perspective view of a cover plate for the housing of the plug assembly of FIG. 39A according to an embodiment of the disclosure.

Referring to FIGS. 39A, 39B, and 39C, a plug assembly 810 that can be used on a light string is depicted according to an embodiment of the disclosure. The lights may be LED, incandescent, or other. In some embodiments, plug assembly 810 can be used with a standard wall outlet 821 or standard receptacle. The plug assembly 810 is comprised of a plug housing 812, a plug insert 814, an activation mechanism 816, a plurality of fixed terminal blades 818, and a plurality of retractable terminal blades 820. The plug assembly 810 also comprises a cover plate 822 (detailed in FIG. 40) and a fuse access door 824 (detailed in FIG. 41). The plug assembly 810 is configured in a manner such that terminal blades 818 are fixed and not able to be retracted while terminal blades 820 are able to be retracted into the plug insert 814, allowing plug assembly 810 to be inserted into a standard wall socket or a standard receptacle. In an embodiment, terminal blades 818 are primary power terminals that are connected to a power source. Retraction and protraction of terminal blades 820 is performed by a user slidingly moving activation mechanism 816 via a protrusion 849. FIGS. 39A and 39B illustrate plug assembly 810, as described herein, having terminal blades 818 in the protracted position. FIG. 39C illustrates plug assembly 810, as described herein, having terminal blades 818 in the retracted position. As shown, protrusion 849 of activation mechanism 816 is moved towards the terminal end of plug assembly 810 to protract terminal blades 820 and moved in the opposite direction to retract terminal blades 820. In some embodiments, the distal ends 886 (FIG. 43) of the terminal blades 820 are recessed but reside within their respective slots 841 in the front wall 840 when retracted, to maintain alignment for protraction.

Figure 42:
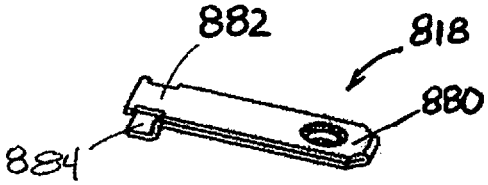
FIG. 42 is a perspective view of fixed terminal blade of the plug assembly of FIG. 39A for coupling to a primary power source according to an embodiment of the disclosure.

Referring to FIG. 42, a terminal blade 818 is used as a primary power terminal according to an embodiment of the disclosure. Terminal blade is manufactured of a conductive metal having a forward or distal end 880 and a rearward or proximal end 882. Disposed at the proximal end 882 can be a contact tab 884.

Figure 43:
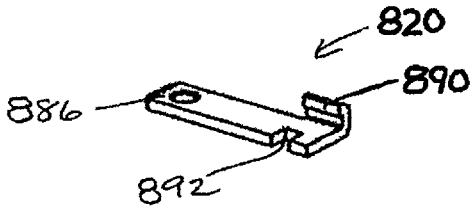
FIG. 43 is a perspective view of a retractable terminal blade of the plug assembly of FIG. 39A for coupling to a primary power source according to an embodiment of the disclosure.

Referring to FIG. 43, a terminal blade 820 used as a retractable power and/or data terminal is depicted according to an embodiment of the disclosure. Terminal blade 820 is manufactured of a conductive metal having a forward or distal end 886 and a rearward or proximal end 888. Disposed at the proximal end 888 can be a contact tab 890 and opposite the contact tab 890 a notch 892. Contact tab 890 is constructed to be perpendicular to the planar portion of the terminal blade 820.

Figure 44A:
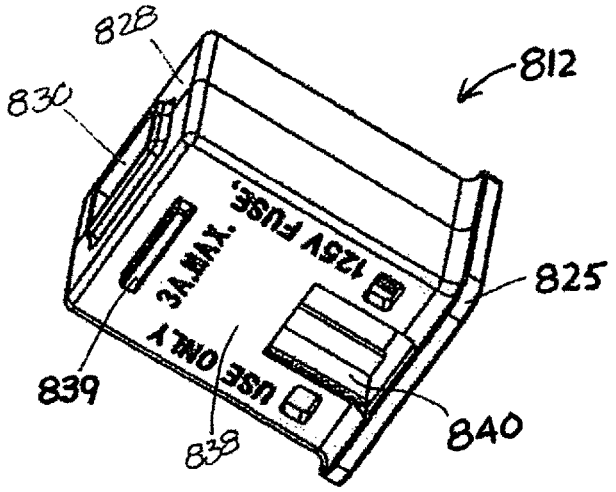
FIGS. 44A and 44B are perspective views of a plug housing of plug assembly of FIG. 39A according to an embodiment of the disclosure.
Figure 44B:
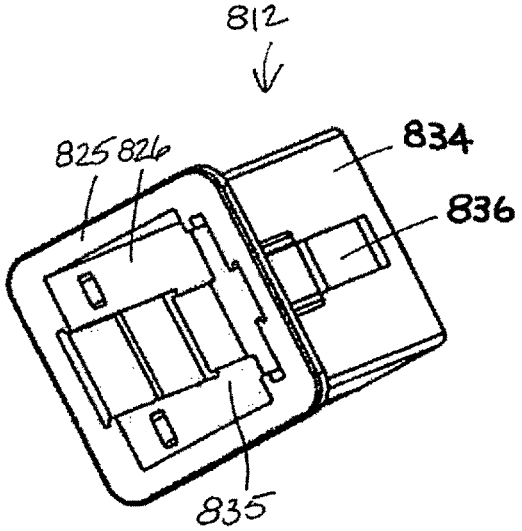

Referring to FIGS. 44A and 44B, the plug housing 812 is depicted according to an embodiment of the disclosure. In the depicted embodiment, the plug housing 812 is generally a hollow cuboid having an open end 826, a closed end 828 having a feedthrough aperture 830, and an inner cavity 835. In an embodiment, open end 826 can be flared at the edges so that edges 832 extend beyond the walls of the rectangular cube shape to provide a flange 825. Open end 826 is formed to correspond to the front wall 840 of the plug insert 814 (see FIGS. 45A and 45B). A top side 834 of plug housing 812 is provided with an aperture 836 that is sized and shaped to receive a protrusion 849 of activation mechanism 816 when activation mechanism 816 is placed within the inner cavity 835. Plug housing 812 bottom side 838 is provided with an aperture 840 that is sized and shaped to receive fuse access door 824. Plug housing 812 is further provided with a protrusion 839 extending from the surface of the bottom side 838 closer to the semi-closed end 828 of plug housing 812. Plug housing 812 can be a single formed piece of material or a plurality of formed pieces molded together and can be manufactured of a plastic or plastic composite.

Figure 45A:
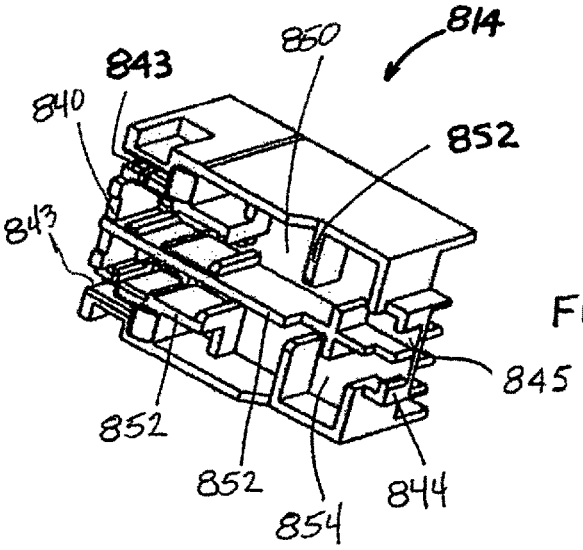
FIGS. 45A and 45B are perspective views of a plug insert of plug assembly of FIG. 39A according to an embodiment of the disclosure.
Figure 45B:
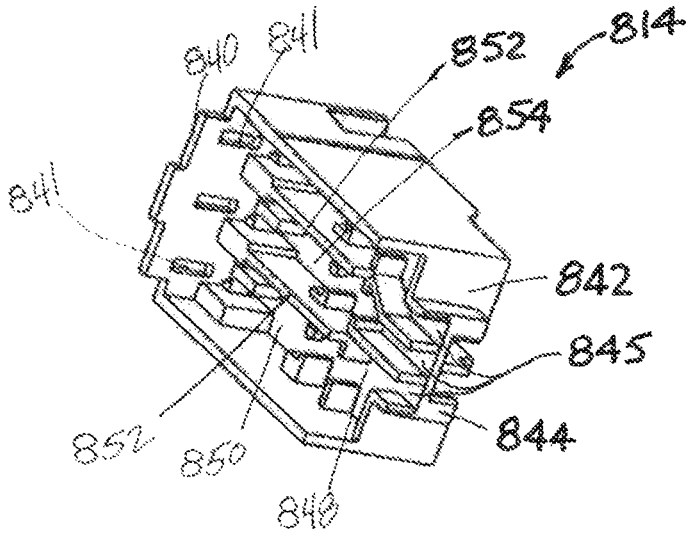

Referring to FIGS. 45A and 45B, bottom and top perspective views of the plug insert 814 are depicted according to an embodiment of the disclosure. Plug insert 814 may be manufactured of a plastic or plastic composite and, as discussed above. In the depicted embodiment, the front wall 840 of plug insert 814 is sized and shaped to correspond to the open end 826 of plug housing 812 so that when plug insert 814 is inserted into the inner cavity 835 of plug housing 812, the front wall 840 snap fits to the open end 826 and is secured in place. The front wall 840 is further provided with a plurality of apertures 841 sized to accept terminal blades 820. The front wall 840 is also provided with a plurality of slots 843 sized to accept terminal blades 818, the blades 818 being secured in place when inserted into the slots 843. The back wall 842 of plug insert 814 is formed so that a projection 844 is provided where projection 844 corresponds to and registers within the feedthrough aperture 830 of plug housing 812. In various embodiments, the back wall 842 also defines a channel access 845.

In some embodiments, plug insert 814 includes a bottom side 846 and a top side 848 where sides 846, 848 are separated from each other by a floor 850, the floor 850 being generally on a central plane between and perpendicular to front wall 840 and back wall 842. Extending perpendicular from the bottom side 846 and the top side 848 of the floor 850 are a plurality of walls 852, the walls 852 being of various heights and configurations, and disposed horizontally and vertically in relation to the front wall 840 and back wall 842. Walls 852 are disposed in such a way that channels 854 are formed on both sides 846, 848 of plug insert 814. Channels 854 run generally horizontally from the back wall 842 to the front wall 840 with vertically disposed walls 852 extending partially into channels 854 so that objects within the channels 854 bend, curve or form fit around the vertically disposed walls 852 such that the object is held in place. Walls 852 and floor 850 create partitions providing the additional benefit of isolating electrically conductive components from each other to prevent arcing across air gaps.

Figure 46A:
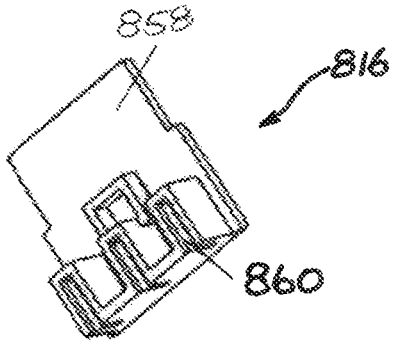
FIGS. 46A and 46B are perspective views of an activation mechanism of plug assembly of FIG. 39A according to an embodiment of the disclosure.
Figure 46B:
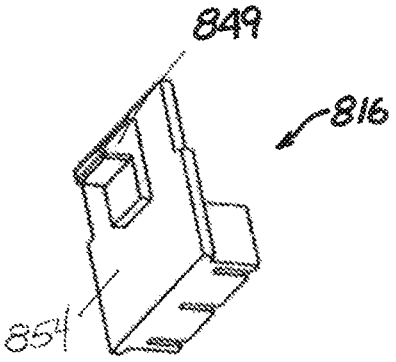

Referring to FIGS. 46A and 46B, bottom and top views of the activation mechanism 816 are depicted according to an embodiment of the disclosure. Activation mechanism 816 is configured to fixedly engage terminal blades 820. Activation mechanism 816 is provided with the protrusion 849 on the top side 856. The bottom side 858 is provided with a plurality of blade slots 860 each sized to accept and engage with the proximal end 888 of the terminal blade 820. Within the blade slot 860 can be a raised portion (not shown) configured to fixedly engage with notch 892 of terminal blade 820. When terminal blade 820 is inserted within the blade slot 860, tab 890 is disposed to be positioned over and adjacent blade slot 860, for contact with wire terminals (e.g., crimping terminal 891, discussed below).

Figure 47A:
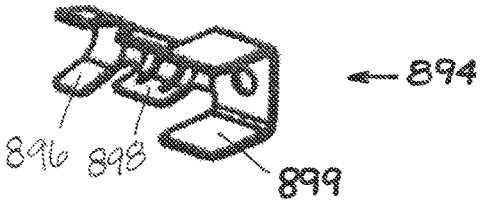
FIG. 47A is a perspective view of a terminal for use with fuses in the plug assembly of FIG. 39A according to an embodiment of the disclosure.

Referring to FIG. 47A, a crimping terminal 894 is depicted according to an embodiment of the disclosure. The crimping terminal 894 is manufactured of a conductive metal and comprising an insulation crimp 896, a conductor crimp 898, and a u-shaped tongue 899. U-shaped tongue 899 may be sized to accommodate a first end of a barrel fuse (not depicted). Crimping terminal 894 is fixedly connected to an individual wire of the plurality of wires 819. Crimping terminals 894 and wires 819 are disposed within channels 854 of the plug insert 814 positioned so that the wires 819 extend through the channel access 845 of the back wall 842 and crimping terminal 894 contacts the floor 850 with u-shaped tongue 899 facing away from floor 850.

Figure 47B:
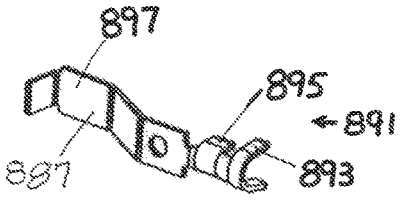
FIG. 47B is a perspective view of an alternative terminal for use in the plug assembly of FIG. 39A according to an embodiment of the disclosure.

Referring to FIG. 47B, a crimping terminal 891 is depicted according to an embodiment of the disclosure. The crimping terminal 891 may be manufactured of a conductive metal and comprising an insulation crimp 893, a conductor crimp 895, and a variably angled tongue 897. Crimping terminal 891 may be fixedly connected to an individual wire of the plurality of wires 819. Crimping terminal 891 and wire 819 are disposed within channels 854 of plug insert 814 positioned so that wire 819 extends through the channel access 845 of the back wall 842 and planar face 887 of tongue 897 of crimping terminal 891 being perpendicular to floor 850.

In assembling plug assembly 810, three crimping terminals 891 and two crimping terminals 894, with attached wire 819, are each disposed within channels 854 of plug insert 814. Crimping terminals 891 are disposed in the bottom side 846 of insert while crimping terminals 894 are disposed in the top side 848. Terminal blades 818 are disposed and fixed in slots 843 of inserts 814. Activation mechanism 816 with attached terminal blades 820 is disposed so that blades 820 extend through apertures 841 of the front wall 840. This assembly, wire end first, is inserted in the open end 826 of cavity 835 of plug housing 812 so that protrusion 849 extends through aperture 836 of the top side 834 and snap fits into place. During assembly, fuses (not depicted) can be installed such that a first end of a barrel fuse is positioned in the U-shaped tongue 899 of crimping terminal 894 such that there is one barrel fuse per crimping terminal 894. The second end of the barrel fuse makes direct contact with one of the contact tabs 884 of one of the terminal blades 818. In the case of terminal blade 820, contact tab 890 makes direct contact with the tongue 897 of crimping terminal 891 only when the blade 820 is in the protracted position, so that electrical connection with the wiring 819 is established via the crimping terminal 891 only when the blades 820 are in the protracted configuration.

Figure 48A:
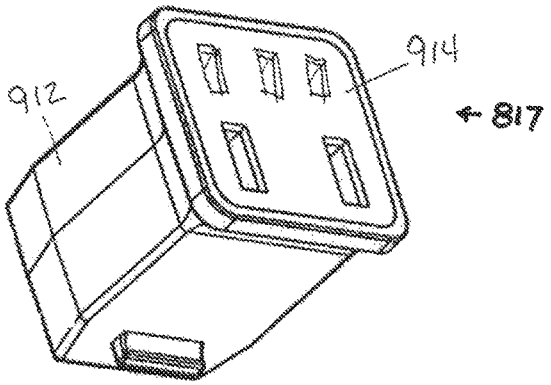
FIGS. 48A and 48B are perspective views of a receptacle assembly for receiving the plug assembly of FIG. 39A according to an embodiment of the disclosure.
Figure 48B:
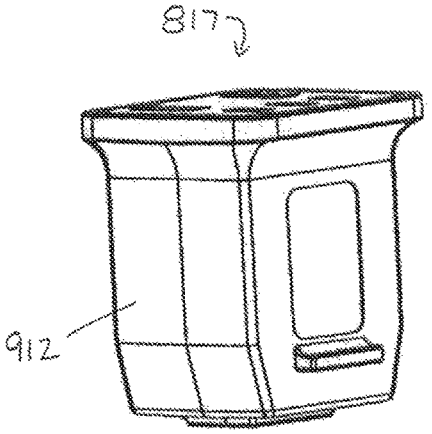

Referring to FIGS. 48A and 48B, a receptacle assembly 817 is depicted according to an embodiment of the disclosure. The receptacle may be configured to correspond with the plug assembly 810 as described above. Receptacle assembly 817 may be disposed on one end of a light string 811, opposite the end on which the plug assembly 810 is disposed. Receptacle assembly 817 includes a receptacle housing 912 and a receptacle insert 914.

Figure 49A:
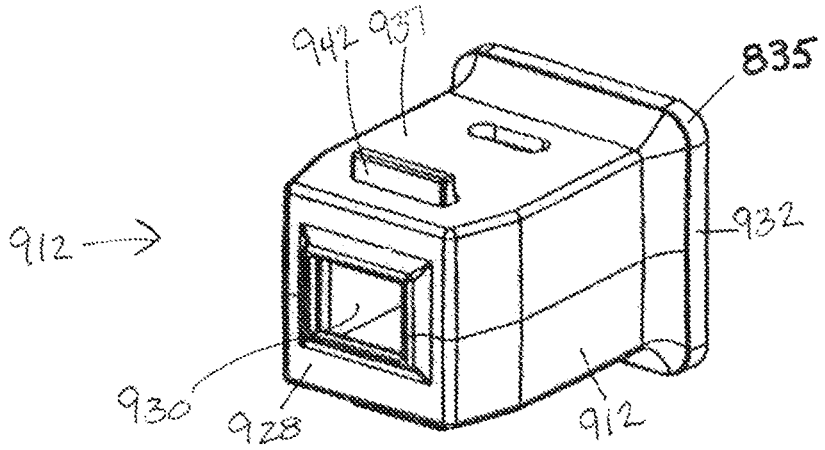
FIGS. 49A and 49B are perspective views of a receptacle housing of the receptacle assembly of FIG. 48A according to an embodiment of the disclosure.
Figure 49B:
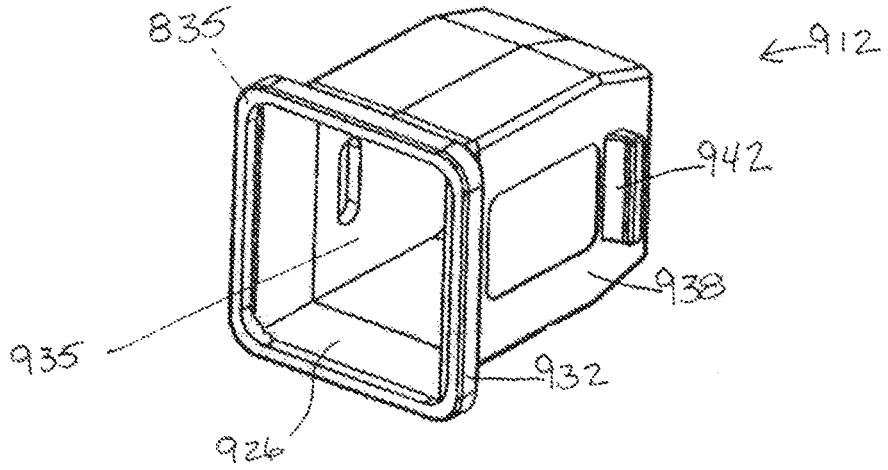

Referring to FIGS. 49A and 49B, the receptacle housing 912 is depicted according to an embodiment of the disclosure. In the depicted embodiment, the receptacle housing 912 is generally a hollow cuboid having an open end 926, a closed end 928 defining a feedthrough aperture 930, and an inner cavity 935. In an embodiment, open end 926 can be flared at the edges so that edges 932 extend beyond the walls of the rectangular cube shape to define a flange 835. In some embodiments, closed end 928 can be tapered. Open end 926 may be shaped to correspond to a front wall 940 of the receptacle insert 914 (see FIGS. 50A and 50B). Receptacle housing 912 is further provided with a plurality of protrusions 942 extending from the surface of the top side 937 and bottom side 938 closer to the semi-closed end 928 of receptacle housing 912. These protrusions 942 provide the user of the receptacle assembly 817 a gripping and pulling mechanism when attaching or detaching the plug assembly 810 and receptacle assembly 817. Receptacle housing 912 can be a single formed piece of material or a plurality of formed pieces molded together and can be manufactured of a dielectric material, such as plastic or plastic composite.

Figure 50A:
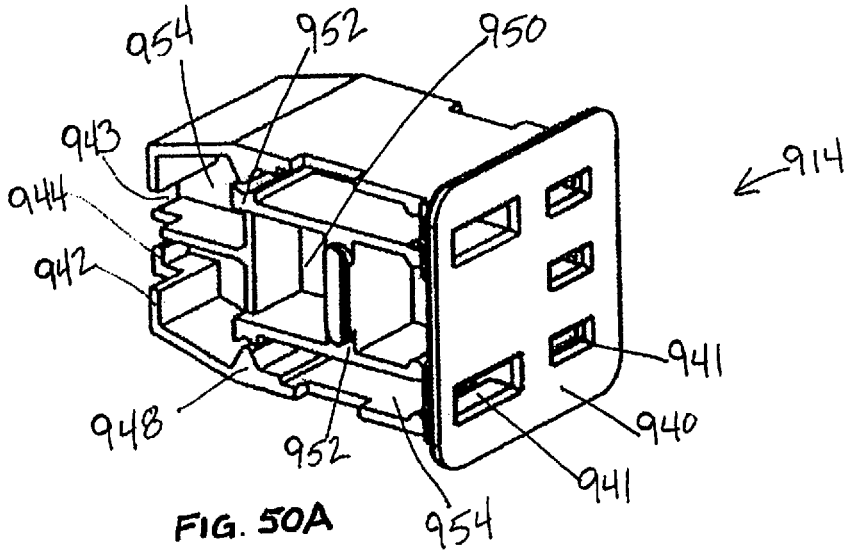
FIGS. 50A and 50B are perspective views of a receptacle insert of the receptacle assembly of FIG. 48A according to an embodiment of the disclosure.
Figure 50B:
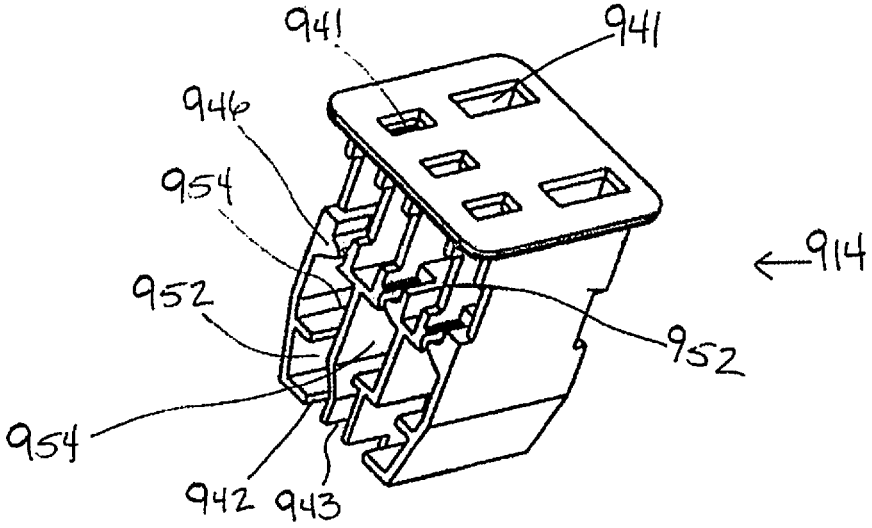

Referring to FIGS. 50A and 50B, receptacle insert 914 is depicted according to an embodiment of the disclosure. Receptacle insert 914 may be manufactured of a plastic or plastic composite and, as discussed above. In the depicted embodiment, the front wall 940 of receptacle insert 914 is sized and shaped to correspond to the open end 926 of receptacle housing 912 so that when receptacle insert 914 is inserted into the inner cavity 935 of receptacle housing 912, the front wall 940 snap fits to the open end 926 and is locked in place. The front wall 940 is further provided with a plurality of apertures 941 sized to accept terminal blades 818, 820. The back wall 942 of receptacle insert 914 is formed so that a projection 944 is provided where projection 944 corresponds to and fits in the feedthrough aperture 930 of receptacle housing 912. Back wall 942 may also define a feedthrough aperture 943 to allow for wire feeds.

Receptacle insert 914 may include a bottom side 946 and a top side 948 where sides 946, 948 are separated from each other by a floor 950, floor 950 generally on a central plane between and perpendicular to front wall 940 and back wall 942. Extending perpendicular from the bottom side 946 and the top side 948 of the floor 950 are a plurality of walls 952, the walls 952 being of various heights and configurations, and disposed horizontally and vertically in relation to the front wall 940 and back wall 942. Walls 952 are disposed in such a way that channels 954 are formed on both sides 946, 948 of receptacle insert 914. Channels 954 run generally horizontally from the back wall 942 to the front wall 940 with vertically disposed walls 952 extending partially into channels 954 so that objects within the channels 954 bend, curve, or form fit around the vertically disposed walls 952 so that the object is held in place. Walls 952 and floor 950 provide the additional benefit of isolating electrically conductive components from each other, which may otherwise arc across air gaps or come into contact with each other.

Figure 51:
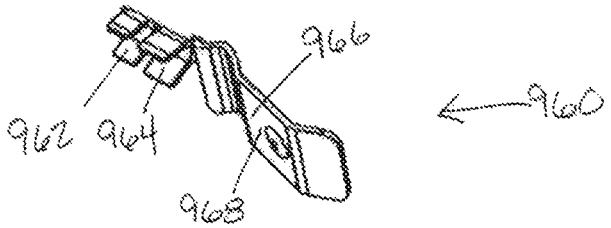
FIG. 51 is a perspective view of a terminal for use with the receptacle assembly of FIG. 48A for coupling to a primary power source according to an embodiment of the disclosure.

Referring to FIG. 51, a crimping terminal 960 is depicted according to an embodiment of the disclosure. The crimping terminal 960 may be manufactured of a conductive metal and comprising an insulation crimp 962, a conductor crimp 964, and tongue 966, the tongue 966 having a curved and angular planar surface 968. Crimping terminal 960 is fixedly connected to an individual wire.

Figure 52:
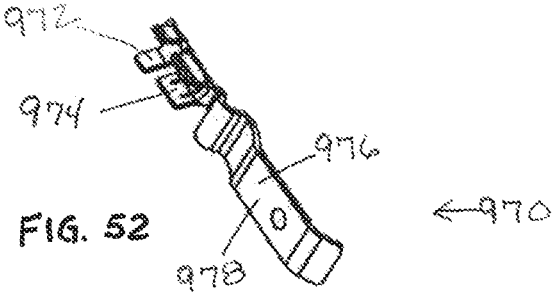
FIG. 52 is a perspective view of a terminal for use with the receptacle assembly of FIG. 48A for coupling to a low voltage source according to an embodiment of the disclosure.
Figure 53A:
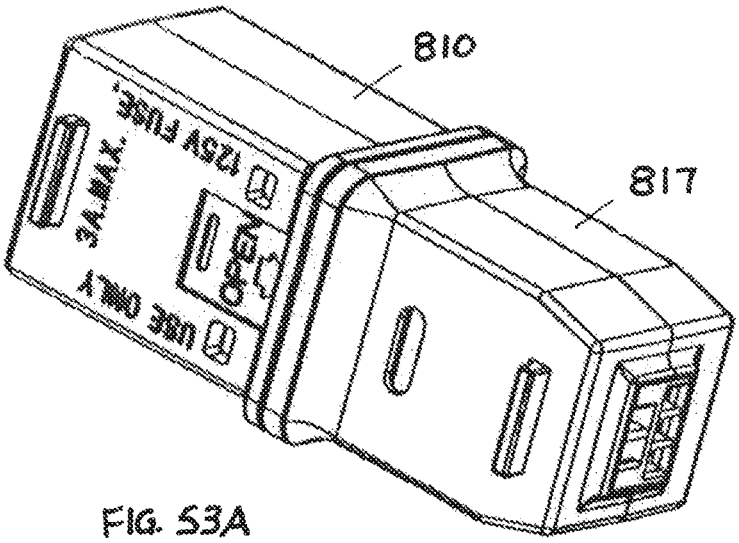
FIGS. 53A and 53B are perspective views of the plug assembly of FIG. 39A connected to the receptacle assembly of FIG. 48A according to an embodiment of the disclosure.
Figure 53B:
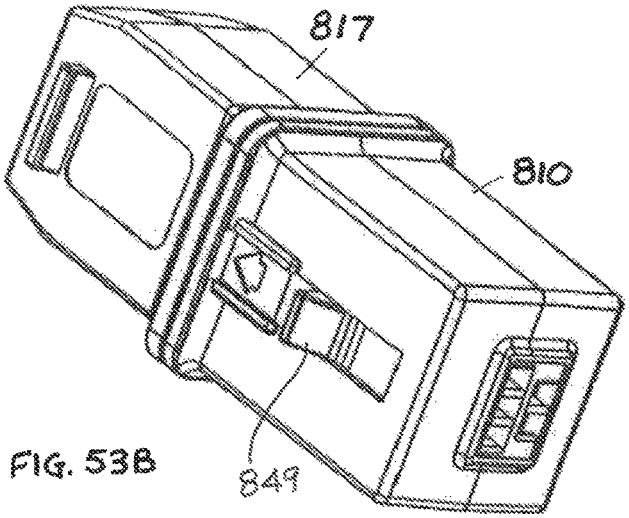
Figure 53C:
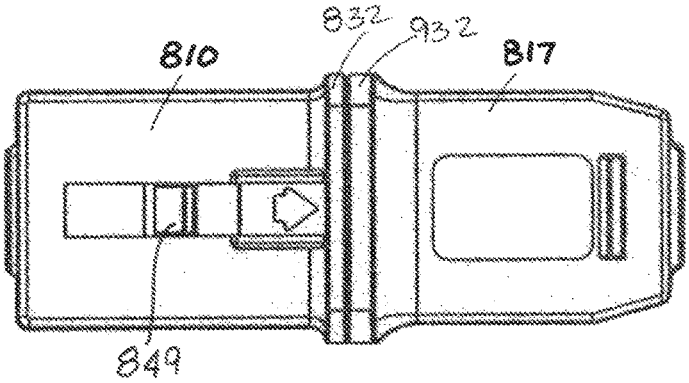
FIGS. 53C and 53D are plan views and elevational views, respectively, of connected plug and receptacle assemblies of FIG. 53A according to an embodiment of the disclosure.
Figure 53D:
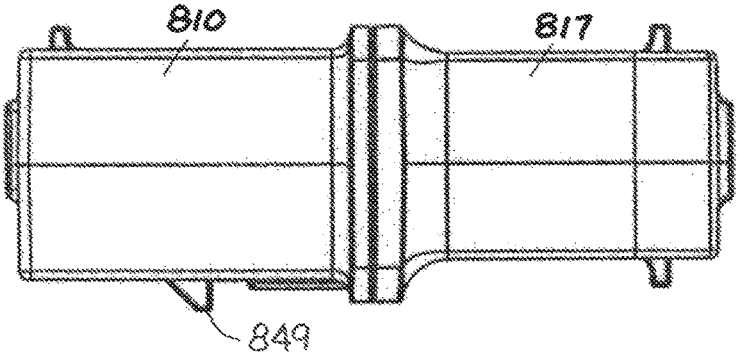

Referring to FIG. 52, a crimping terminal 970 is depicted according to an embodiment of the disclosure. Crimping terminal 970 may be manufactured of a conductive metal and comprising an insulation crimp 972, a conductor crimp 974, and tongue 976, the tongue 976 having a curved and angular planar surface 978. Crimping terminal 970 is fixedly connected to an individual wire. Crimping terminal 970 is smaller in width than crimping terminal 960.

Crimping terminals 960, 970 and wires are disposed within the channels 954 of receptacle insert 914, positioned so that wire extends through the feedthrough aperture 943 of back wall 942. Crimping terminals 960 are disposed in the top side 948 of receptacle insert 914 so that planar face 968 of the tongue 966 of crimping terminal 960 is perpendicular to floor 950. Crimping terminals 970 are disposed in the bottom side 946 of receptacle insert 914 so that planar face 978 of the tongue 976 of crimping terminal 970 is perpendicular to floor 950. Crimping terminals 960, 970 are formed so that the shape conforms to the pathway of channel 954.

The receptacle insert 914, having crimping terminals 960, 970 and attached wires, is inserted, wire end first, into the open end 926 of cavity 935 of receptacle housing 912 and snap fits into place to provide the plug as shown in the embodiment of FIG. 48A (figure does not illustrate wiring).

Referring to FIGS. 53A, 53B, 53C, and 53D, plug assembly 810 as engaged with receptacle assembly 817 is depicted according to an embodiment of the disclosure. Engaging the plug assembly 810 and receptacle assembly 817 in the depicted manner allows the user to connect light strings 811 end-to-end. Plug assembly 810 and receptacle assembly 817 are configured so that terminal blades 818, 820 are inserted into receptacle assembly 817 via apertures 941. When engaged, terminal blades 818, 820 reside within channels 954 of the receptacle assembly 817 and directly contact crimping terminals 960, 970 thereby making an electrical connection between plug assembly 810 and receptacle assembly 817. In an embodiment, flange 825 of plug assembly 810 and receptacle flange 835 are configured to have the same outer edge profile so that the outer edges are even with each other.

While the disclosure is amenable to various modifications and alternative forms, specifics thereof have been shown by way of example in the drawings and described in detail. It is understood however, that the intention is not to limit the application to the particular embodiments described. On the contrary, the intention is to cover all modifications, equivalents, and alternative falling with the spirit and scope of the disclosure as defined by the appended claims.

Persons of ordinary skill in the relevant arts will recognize that various embodiments can comprise more or fewer features than illustrated in any individual embodiment described above. The embodiments described herein are not meant to be an exhaustive presentation of the ways in which the various features may be combined. Accordingly, the embodiments are not mutually exclusive combinations of features; rather, the claims can comprise a combination of different individual features selected from different individual embodiments, as understood by persons of ordinary skill in the art.

References to "embodiment(s)", "disclosure", "present disclosure", "embodiment(s) of the disclosure", "disclosed embodiments", and the like contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A connector, comprising:

a receptacle assembly, including:

a receptacle housing including an open end and a closed end separated by at least one side wall, the receptacle housing defining a receptacle housing cavity;

a receptacle insert disposed in the receptacle housing cavity, the receptacle insert including a receptacle body having an outer peripheral surface that extends rearward from a forward face to a rearward face, the receptacle body including an internal bulkhead and defining a first forward cavity forward of the internal bulkhead, a first rodular projection extending forward from the internal bulkhead into the first forward cavity and being centered about a first rodular projection axis, the first rodular projection axis being perpendicular to the internal bulkhead, an outer surface of the first rodular projection cooperating with an inner surface of the first forward cavity to define a first annular gap that surrounds the first rodular projection, the first rodular projection defining a first pair of terminal bores extending through the first rodular projection and through the internal bulkhead, the first pair of terminal bores defining a first pair of terminal bore axes that are perpendicular to the internal bulkhead, the first pair of terminal bore axes being parallel and defining a plane, a first receptacle partition wall extending rearward from the receptacle body, the first receptacle partition wall extending between the bores of the first pair of terminal bores and perpendicular to the plane of the first pair of terminal bore axes, and a first pair of female electrical terminals, each disposed in a respective one of the first pair of terminal bores, the first pair of female electrical terminals extending rearward from the receptacle insert adjacent opposing sides of the first receptacle partition wall.

2. The connector of claim 1, wherein:

the receptacle housing includes one of a detent and a recess formed on the at least one side wall of the receptacle housing;

the receptacle insert includes the other of the detent and the recess formed on surface of the receptacle body; and the detent is arranged and configured to snappingly engage within the recess when the receptacle insert is inserted into the receptacle housing to secure the receptacle insert within the receptacle housing.

3. The connector of claim 1, wherein one of the inner surface of the receptacle housing and the outer peripheral surface of the receptacle body includes a receptacle spline extending perpendicular to the open end of the receptacle housing, and the other of the inner surface of the receptacle housing and the outer peripheral surface of the receptacle body defines a receptacle groove extending perpendicular to the open end, the receptacle spline being disposed within the receptacle groove.

4. The connector of claim 1, wherein:

the inner surface of the first forward cavity includes one of a first spline and a first groove formed thereon that extends perpendicular to the internal bulkhead.

5. The connector of claim 1, wherein the closed end defines a receptacle feedthrough aperture, and wherein a portion of the first receptacle partition wall is registered within the receptacle feedthrough aperture.

6. The connector of claim 1, wherein:

the receptacle body defines a first pair of receptacle catch plate slots that extend rearward of the internal bulkhead, each of the first pair of receptacle catch plate slots being adjacent a respective one of the first pair of terminal bore axes and is accessible from the rearward face of the receptacle body; and each of the first pair of female electrical terminals includes a catch plate disposed in a respective one of the first pair of receptacle catch plate slots.

7. The connector of claim 1, comprising:

a plug assembly, including:

a plug housing including an open end and a closed end separated by at least one side wall, the plug housing defining a plug housing cavity;

a plug insert disposed in the plug housing cavity of the plug housing, the plug insert including a plug body having an outer peripheral surface that extends rearward from a front wall to a rearward face, the front wall defining a first pair of terminal apertures extending therethrough, the first pair of terminal apertures defining a first pair of terminal aperture axes that are perpendicular to the front wall, the first pair of terminal aperture axes being parallel and defining a plane, a first tubular projection centered about a first tubular projection axis that is perpendicular to the front wall, the first tubular projection extending forward from the front wall of the plug insert and surrounding the first pair of terminal apertures, and a first plug partition wall extending rearward from the plug body, the first plug partition wall extending between the apertures of the first pair of terminal apertures and perpendicular to the plane of the first pair of terminal aperture axes; and a first pair of male electrical terminals, each disposed in a respective one of the first pair of terminal apertures, the first pair of male electrical terminals extending rearward from the plug insert adjacent opposing sides of the first plug partition wall, wherein the first tubular projection is configured for insertion into the first annular gap of the receptacle assembly, the first tubular projection is configured to receive the first rodular projection of the plug assembly, and the first pair of male electrical terminals are configured for insertion into the first pair of female electrical terminals of the receptacle assembly.

8. The connector of claim 1, wherein:

the inner surface of the first forward cavity includes one of a first spline and a first groove formed thereon that extends perpendicular to the internal bulkhead;

an outside surface of the first tubular projection includes the other of the first spline and the first groove formed thereon that extends perpendicular to the front wall; and the first spline is configured to slidingly engage the first groove when the plug assembly is inserted into the receptacle assembly.

9. The connector of claim 7, wherein the closed end defines a plug feedthrough aperture, and wherein a portion of the first plug partition wall is registered within the plug feedthrough aperture.

10. The connector of claim 7, wherein:

the plug body defines a first pair of plug catch plate slots that extend rearward of the front wall, each of the first pair of plug catch plate slots being adjacent a respective one of the first pair of terminal aperture axes and is accessible from the rearward face of the plug body; and each of the first pair of male electrical terminals includes a catch plate disposed in a respective one of the first pair of plug catch plate slots.

11. The connector of claim 1, wherein:

the receptacle body defines a second forward cavity forward of the internal bulkhead;

a second rodular projection extends forward from the internal bulkhead into the second forward cavity and is centered about a second rodular projection axis, the second rodular projection axis being perpendicular to the internal bulkhead, an outer surface of the second rodular projection cooperating with an inner surface of the second forward cavity to define a second annular gap that surrounds the second rodular projection, the second rodular projection defining a second pair of terminal bores extending through the second rodular projection and through the internal bulkhead, the second pair of terminal bores defining a second pair of terminal bore axes that are perpendicular to the internal bulkhead;

a second receptacle partition wall extending rearward from the receptacle body and perpendicular to the first receptacle partition wall and extending between the first pair of apertures and the second pair of apertures; and a female electrical terminal disposed in one of the second pair of terminal apertures, the female electrical terminal extending rearward from the receptacle insert adjacent the first plug partition wall and the second plug partition wall.

12. The connector of claim 11, wherein:

the front wall of the plug body defines a second pair of terminal apertures extending therethrough, the second pair of terminal apertures defining a second pair of terminal aperture axes that are perpendicular to the front wall;

a second tubular projection centered about a second tubular projection axis that is perpendicular to the front wall, the second tubular projection extending forward from the front wall of the plug insert and surrounding the second pair of terminal apertures; and a second plug partition wall extending rearward from the plug body, the second plug partition wall extending between the apertures of the first pair of terminal apertures and between the apertures of the second pair of terminal apertures and perpendicular to the first plug partition wall; and a male electrical terminal disposed in a respective one of the second pair of terminal apertures, the male electrical terminal extending rearward from the plug insert adjacent the second plug partition wall, wherein the second tubular projection is configured for insertion into the second annular gap of the receptacle assembly, the second tubular projection is configured to receive the second rodular projection of the plug assembly, and the male electrical terminal is configured for insertion into the female electrical terminal of the receptacle assembly.

13. The connector of claim 12, wherein:

the inner surface of the first forward cavity includes one of a first spline and a first groove formed thereon that extends perpendicular to the internal bulkhead;

an outside surface of the first tubular projection includes the other of the first spline and the first groove formed thereon that extends perpendicular to the front wall;

the inner surface of the second forward cavity includes one of a second spline and a second groove formed thereon that extends perpendicular to the internal bulkhead;

an outside surface of the second tubular projection includes the other of the second spline and the second groove formed thereon that extends perpendicular to the front wall; and the first spline is configured to slidingly engage the first groove and the second spline is configured to slidingly engage the second groove when the plug assembly is inserted into the receptacle assembly.

14. The connector of claim 11, wherein the female electrical terminal disposed in one of the second pair of terminal bores is one of a second pair of female electrical terminals, each disposed in a respective one of the second pair of terminal bores, the second pair of female electrical terminals extending rearward from the plug insert adjacent opposing sides of the first plug partition wall.

15. The connector of claim 14, wherein each female electrical terminal includes a crimping end and a female barrel separated by a catch plate, wherein a semi-spherical projection is disposed on the inside surface of the female barrel.

16. The connector of claim 14, wherein the female barrel defining a slit that extends longitudinally along the female barrel.

17. The connector of claim 15, wherein:

each male electrical terminal includes a crimping end and a male barrel separated by a catch plate;

a semi-spherical indentation is disposed on the outside surface of the male barrel; and the semi-spherical indentation of the male electrical terminal and the semi-spherical projection of the female electrical terminal are positioned and configured to mate together when the plug assembly is connected to the receptacle assembly.

18. The connector of claim 17, wherein:

a semi-spherical end cap defines a plurality of slits; and one of the plurality of slits of the semi-spherical end cap extends longitudinally along the male barrel.

19. The connector of claim 14, comprising:

a second plug assembly, including:

a second plug housing including an open end and a closed end separated by at least one side wall, the second plug housing defining a second plug housing cavity;

a second plug insert disposed in the second plug housing cavity of the second plug housing, the second plug insert including a second plug body having an outer peripheral surface that extends rearward from a second front wall to a rearward face, the second front wall defining a second pair of terminal apertures extending therethrough, the second pair of terminal apertures defining a second pair of terminal aperture axes that are perpendicular to the second front wall, the second pair of terminal aperture axes being parallel and defining a plane, a second tubular projection centered about a second tubular projection axis that is perpendicular to the second front wall, the second tubular projection extending forward from the second front wall of the second plug insert and surrounding the second pair of terminal apertures, and a second plug partition wall extending rearward from the second plug body, the second plug partition wall extending between the apertures of the second pair of terminal apertures and extending perpendicular to the plane of the second pair of terminal aperture axes; and a second pair of male electrical terminals, each disposed in a respective one of the second pair of terminal apertures, the second pair of male electrical terminals extending rearward from the plug insert adjacent opposing sides of the second plug partition wall, wherein the second tubular projection is configured for insertion into the second annular gap of the receptacle assembly, the second tubular projection is configured to receive the second rodular projection of the second plug assembly, and the second pair of male electrical terminals are configured for insertion into the second pair of female electrical terminals of the receptacle assembly.

20. The connector of claim 14, wherein the male electrical terminal disposed in one of the second pair of terminal apertures is one of a second pair of male electrical terminals, each disposed in a respective one of the first pair of terminal apertures, the second pair of male electrical terminals extending rearward from the plug insert adjacent opposing sides of the first plug partition wall.

21. The connector of claim 20, wherein:

the plug body defines a first pair of plug catch plate slots that extend rearward of the front wall, each of the first pair of plug catch plate slots being adjacent a respective one of the first pair of terminal aperture axes and is accessible from the rearward face of the plug body, each of the first pair of male electrical terminals including a catch plate disposed in a respective one of the first pair of plug catch plate slots; and the plug body defines a second pair of plug catch plate slots that extend rearward of the front wall, each of the second pair of plug catch plate slots being adjacent a respective one of the second pair of terminal aperture axes and is accessible from the rearward face of the plug body, each of the second pair of male electrical terminals including a catch plate disposed in a respective one of the second pair of plug catch plate slots.

22. The connector of claim 12, comprising:

a fastener aperture defined through the at least one side wall of the receptacle housing;

a retaining bridge extending from the first tubular projection to the second tubular projection, the retaining bridge defining a tap hole; and a fastener disposed through the fastener aperture and into the tap hole to secure the receptacle assembly to the plug assembly.

* * * * *